US011007113B2

(12) United States Patent
Haddock et al.

(10) Patent No.: US 11,007,113 B2
(45) Date of Patent: May 18, 2021

(54) PRESSURE FIELD STIMULATOR HAVING A CUP INTEGRATED WITH A SHEATH

(71) Applicant: Uccellini LLC, Bend, OR (US)

(72) Inventors: Lora LeeAnne Haddock, Bend, OR (US); Ada-Rhodes Short, Corvallis, OR (US); Avery Smith, Albany, OR (US); Kim Porter Henneman, Bend, OR (US); Douglas S. Layman, Bend, OR (US); Blake Michael Larkin, Eugene, OR (US); Brian Scott Gaza, Naperville, IL (US); Mark Hazelton, Philomath, OR (US); Mazie Houchens, Corvallis, OR (US); Lola Vars, Corvallis, OR (US)

(73) Assignee: Uccellini LLC, Bend, OR (US)

( * ) Notice: Subject to any disclaimer, the term of this patent is extended or adjusted under 35 U.S.C. 154(b) by 0 days.

(21) Appl. No.: 16/569,722

(22) Filed: Sep. 13, 2019

(65) Prior Publication Data

US 2020/0085679 A1 Mar. 19, 2020

Related U.S. Application Data

(63) Continuation-in-part of application No. 29/675,567, filed on Jan. 3, 2019, now Pat. No. Des. 884,206, and
(Continued)

(51) Int. Cl.
*A61H 19/00* (2006.01)
*A61H 15/00* (2006.01)

(52) U.S. Cl.
CPC ..... *A61H 19/34* (2013.01); *A61H 15/00* (2013.01); *A61H 19/44* (2013.01);
(Continued)

(58) Field of Classification Search
CPC .... A61H 15/00; A61H 15/0078; A61H 19/34; A61H 19/40; A61H 19/44;
(Continued)

(56) References Cited

U.S. PATENT DOCUMENTS 1,755,144 A 4/1930 Arranz
2,076,410 A 4/1937 McGerry
(Continued)

FOREIGN PATENT DOCUMENTS

AU 2018200317 A1 2/2018
CN 105596194 5/2016
(Continued)

OTHER PUBLICATIONS

EP Application No. 19817568.9, Partial Search Report, dated Jul. 17, 2020, 37 pgs.
(Continued)

*Primary Examiner* — Christine H Matthews
(74) *Attorney, Agent, or Firm* — Maxine Lynn Barasch; Keohane & D'Alessandro, PLLC

(57) ABSTRACT

Embodiments of the invention relate to a pressure field stimulation device including a sheath having an integrated cup. The sheath and cup are together formed of (or consist of) a single piece of material. The pressure field stimulator has a cup and a driver, where the driver is configured to vary a volume of the cup. The pressure field stimulator has a housing that has an opening therein with an edge on which a portion of the cup rests when installed. The sheath is tightly bound to the housing such that a driver can make contact with the cup. In some embodiments, the pressure field stimulator has a shaft portion, which may include a second stimulation device. The sheath can be bound over the shaft portion as well as the pressure field stimulator housing.

21 Claims, 41 Drawing Sheets

Related U.S. Application Data a continuation-in-part of application No. 29/695,752, filed on Jun. 21, 2019, which is a continuation-in-part of application No. 29/675,567, filed on Jan. 3, 2019, now Pat. No. Des. 884,206.

(60) Provisional application No. 62/731,836, filed on Sep. 15, 2018, provisional application No. 62/731,835, filed on Sep. 15, 2018, provisional application No. 62/731,838, filed on Sep. 15, 2018, provisional application No. 62/731,839, filed on Sep. 15, 2018, provisional application No. 62/731,840, filed on Sep. 15, 2018, provisional application No. 62/787,930, filed on Jan. 3, 2019, provisional application No. 62/868,279, filed on Jun. 28, 2019, provisional application No. 62/868,266, filed on Jun. 28, 2019, provisional application No. 62/868,331, filed on Jun. 28, 2019, provisional application No. 62/868,218, filed on Jun. 28, 2019, provisional application No. 62/868,203, filed on Jun. 28, 2019, provisional application No. 62/868,247, filed on Jun. 28, 2019, provisional application No. 62/868,232, filed on Jun. 28, 2019, provisional application No. 62/868,312, filed on Jun. 28, 2019, provisional application No. 62/869,008, filed on Jun. 30, 2019.

(52) U.S. Cl.
CPC ..... *A61H 2201/1215* (2013.01); *A61H 2201/1418* (2013.01); *A61H 2201/5097* (2013.01)

(58) Field of Classification Search
CPC .... A61H 2009/0064; A61H 2015/0042; A61H 21/00; A61H 2201/1215; A61H 2201/1418; A61H 2201/1654; A61H 2201/1669; A61H 2201/5007; A61H 2205/087; A61H 23/02
See application file for complete search history.

(56) References Cited

U.S. PATENT DOCUMENTS

| | | | |
|---|---|---|---|
| 6,099,463 | A | 8/2000 | Hockhalter |
| 6,733,438 | B1 | 5/2004 | Dann et al. |
| 7,530,944 | B1 | 5/2009 | Kain |
| 8,308,631 | B2 | 11/2012 | Kobashikawa et al. |
| 8,579,837 | B1 | 11/2013 | Makower et al. |
| D712,059 | S | 8/2014 | Sedic |
| 9,339,434 | B1 | 5/2016 | Mayfield |
| 9,737,458 | B1 | 8/2017 | Olivares et al. |
| 9,763,851 | B2 | 9/2017 | Lenke |
| 9,849,061 | B2 | 12/2017 | Lenke |
| 9,937,097 | B2 | 4/2018 | Lenke |
| 10,004,659 | B1 | 6/2018 | Campbell |
| D825,073 | S | 8/2018 | Lenke |
| D848,013 | S | 5/2019 | Fuhner et al. |
| 2003/0176817 | A1 | 9/2003 | Chang |
| 2004/0082831 | A1 | 4/2004 | Kobashikawa et al. |
| 2004/0186344 | A1 | 9/2004 | Jannuzzi |
| 2005/0240122 | A1 | 10/2005 | Gander et al. |
| 2005/0256369 | A1 | 11/2005 | Gloth |
| 2005/0273024 | A1 | 12/2005 | Nan |
| 2007/0142754 | A1 | 6/2007 | Nan |
| 2008/0071138 | A1 | 3/2008 | Mertens et al. |
| 2009/0069730 | A1 | 3/2009 | Knyrim |
| 2009/0118573 | A1 | 5/2009 | Tsao |
| 2010/0041943 | A1 | 2/2010 | Hovland et al. |
| 2010/0268021 | A1 | 10/2010 | Standfest et al. |
| 2011/0124959 | A1 | 5/2011 | Murison |
| 2013/0012769 | A1 | 1/2013 | Carlson |
| 2013/0178769 | A1 | 7/2013 | Schmidt |
| 2014/0228628 | A1 | 8/2014 | De Alva |
| 2014/0309565 | A1 | 10/2014 | Allen |
| 2015/0196455 | A1 | 7/2015 | Mertens et al. |
| 2016/0022532 | A1 | 1/2016 | Makower et al. |
| 2016/0045392 | A1 | 2/2016 | Massey et al. |
| 2016/0213557 | A1 | 7/2016 | Lenke |
| 2017/0027809 | A1 | 2/2017 | Lenke |
| 2017/0065483 | A1 | 3/2017 | Lenke |
| 2017/0100303 | A1 | 4/2017 | Kotlov |
| 2017/0216135 | A1 | 8/2017 | Lenke |
| 2017/0281457 | A1 | 10/2017 | Witt |
| 2018/0092799 | A1 | 4/2018 | Lenke |
| 2018/0140502 | A1 | 5/2018 | Shahoian et al. |
| 2018/0153764 | A1 | 6/2018 | Lenke |
| 2018/0243161 | A1 | 8/2018 | Lenke |
| 2018/0243162 | A1 | 8/2018 | Lenke |

FOREIGN PATENT DOCUMENTS

| | | | |
|---|---|---|---|
| CN | 206198255 | | 5/2017 |
| EP | 3300712 | A1 | 4/2018 |
| JP | 10165465 | | 6/1998 |
| JP | 2007082990 | A | 9/2005 |
| WO | 9802124 | | 1/1998 |
| WO | 2011094799 | A1 | 8/2011 |
| WO | 2013067367 | A1 | 5/2013 |
| WO | 2014085736 | A1 | 6/2014 |
| WO | 2017158107 | A1 | 9/2017 |
| WO | 2017205860 | A1 | 11/2017 |

OTHER PUBLICATIONS

Eaton, Kit, "New Sasi Sex Toy Gets Intelligent With Your Nether Regions", GIZMODO, https://gizmodo.com/new-sasi-sex-toy-gets-intelligent-with-your-nether-regi-346406, Jan. 18, 2008, 4 pgs.
Sloan, Kate, "Review: JeJoue Sasi", GirlyJuice, https://girlyjuice.net/review-jejoue-sasi/, Mar. 11, 2013, 2 pgs.
Sutra, Cara, Je Joue Sasi Review (& LELO ORA Oral Sex Simulator Comparison), CARASUTRA, https://carasutra.com/review/je-joue-sasi-review-lelo-ora-oral-sex-simulator-comparison/, Feb. 24, 2014, 6 pgs.
Alptraum, Lux, "The Vibrator of the Future Won't Vibrate", Motherboard Tech by VICE, https://www.vice.com/en_us/article/qkjz8x/the-vibrator-of-the-future-wont-vibrate, Jul. 14, 2016, 6 pgs.
"Je Joue SaSi Vibrator, Plum", Amazon, https://camelcamelcamel.com/Je-Joue-SaSi-Vibrator-Plum/product/B002T5LKMQ, 2010, 5 pgs.
"Je Joue Sasi, Tongue Massager, AliExpress", https://www.aliexpress.com/item/552706705.html, 2008, 5 pgs.
"SASI Product", 2008, 5 pgs.
Rodriguez, Ariana, "Womanizer Releases New Products, hits Sales Milestone", XBIX.com, Jan. 19, 2018, 13 pgs.
"Irresistible", by Shots, www.ean-online.com/ebooks/EAN_06_2019, 2019, 1 pgs.
"Shots—Irresistible—Mythical—Touchless Clotorial Stimulation", www.youtube.com/watch?v=9hjxKpQBCVU, May 31, 2019, 4 pgs.
"Shots—Irresistible Collection—Promo" https://www.youtube.com/watch?v=ixi_jvwV8g8, Mar. 26, 2019, 1 pg.
Young, Lee, International Application No. PCT/US2019/50936, Search Report & Written Opinion, dated Dec. 4, 2019, 8 pgs.
Matthews, Christine Hopkins, U.S. Appl. No. 16/569,701, Final Office Action dated Dec. 1, 2020, 17 pgs.
Matthews, Christine Hopkins, U.S. Appl. No. 16/569,715, Office Action dated Dec. 9, 2020, 23 pgs.
EP Application No. 198175697-1126, Supplementary Partial EP Search Report, dated Sep. 22, 2020, 16 pgs.
EP Application No. 19817570.5-1126, Search Report, dated Sep. 23, 2020, 15 pgs.

t=t0 t=t1 t=t2 t=t3

PRESSURE FIELD STIMULATOR HAVING A CUP INTEGRATED WITH A SHEATH

FIELD

The invention relates to stimulation devices, and more particularly to a pressure field stimulation device including a sheath having an integrated cup.

BACKGROUND

There are various devices available for sexual stimulation. They are typically configured to stimulate the clitoris and/or the Grafenberg Spot. Such area, also known as the "G-spot," is a nerve reflex area inside the vagina along the anterior surface. The glans clitoris is a portion of the clitoris that is on the vulva, external to the vagina. The glans clitoris has thousands of nerve endings, and the vulva is sexually responsive. Stimulation of a person's glans clitoris or G-spot increases blood flow to the area and provides sexual pleasure. The prostate is a gland surrounding the neck of the bladder in men. Products for G-spot or prostate massage are entirely manually operated, or are provided with internal motors that achieve stimulation by shape, texture and vibration. There exists a need for improvements in devices for stimulation of the clitoris, G-spot and the prostate.

SUMMARY

Embodiments of the invention relate to a pressure field stimulation device including a sheath having an integrated cup that are a single piece. The pressure field stimulator has a cup and a driver, where the driver is configured to vary a volume of the cup. The pressure filed stimulator has a housing that has an opening therein with an edge on which a portion of the cup rests when installed. The sheath is tightly bound to the housing such that a driver can make contact with the cup. In some embodiments, the pressure field stimulator has a shaft portion, which may include a second stimulation device. The sheath can be bound over the shaft portion as well as the pressure field stimulator housing.

In some embodiments, there is provided a device comprising: a cup; a housing comprising an opening; a driver, disposed inside the housing, configured to vary a volume of the cup; a sheath bound to the housing; and wherein the cup is disposed within the opening of the housing; and wherein the sheath and the cup are integral with one another.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
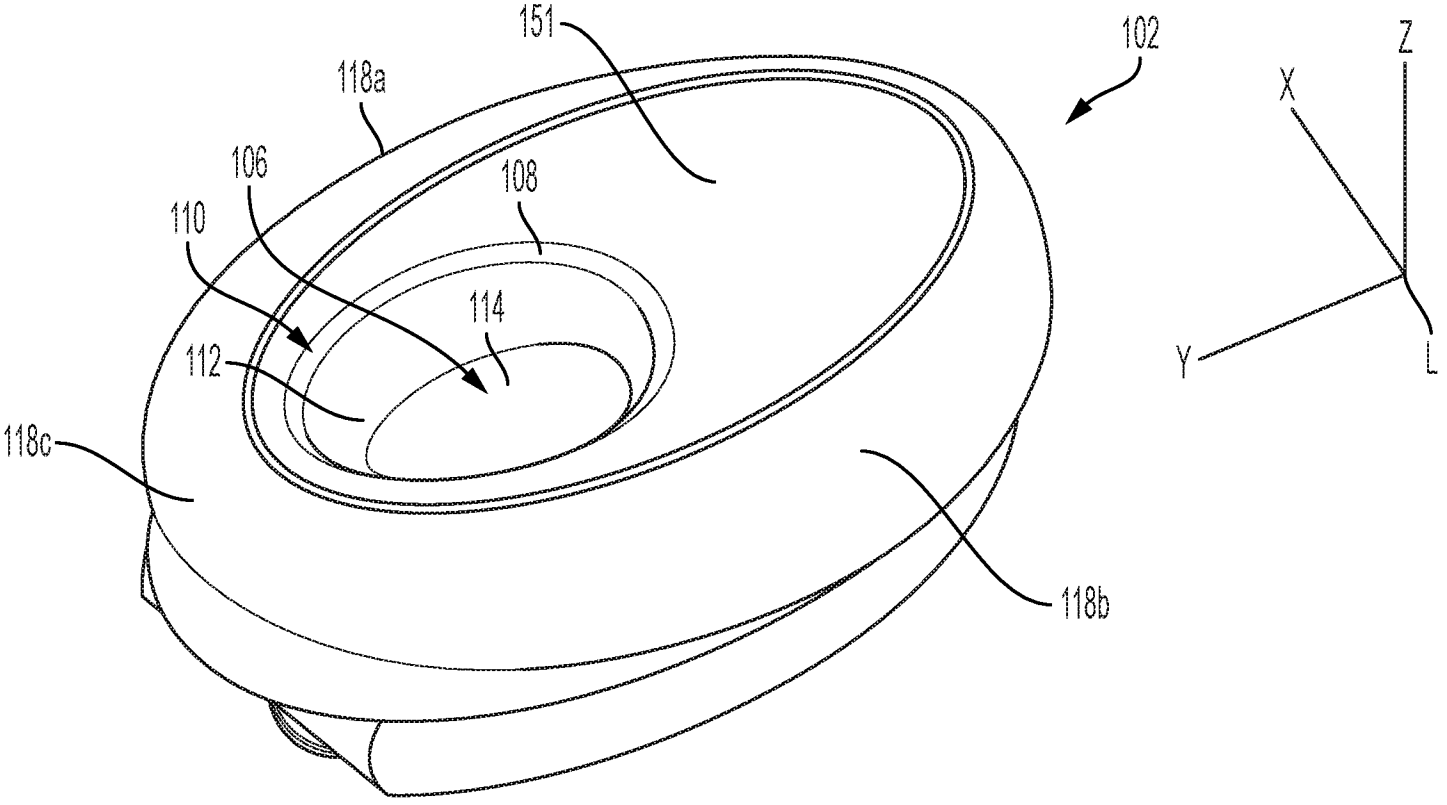
FIG. 1A is a perspective view of an example cup in accordance with some embodiments of the present invention.

The drawings are not necessarily to scale. The drawings are merely representations, not necessarily intended to portray specific parameters of the invention. The drawings are intended to depict only example embodiments of the invention, and therefore should not be considered as limiting in scope. In the drawings, like numbering may represent like elements. Furthermore, certain elements in some of the figures may be omitted, or illustrated not-to-scale, for illustrative clarity.

DETAILED DESCRIPTION

Embodiments of the invention relate to a pressure field stimulation device including a sheath having an integrated cup. The pressure field stimulator has a cup and a driver, where the driver is configured to vary a volume of the cup. The pressure filed stimulator has a housing that has an opening therein with an edge on which a portion of the cup rests when installed. The sheath is tightly bound to the housing such that a driver can make contact with the cup. In some embodiments, the pressure field stimulator has a shaft portion. In some embodiments, the shaft portion is insertable. In some embodiments, the shaft may include a second stimulator, such as a roller massager. In some embodiments, the shaft may be a handle by which a user can manually manipulate the device during use. The sheath can be bound over the shaft portion as well as the pressure field stimulator housing.

Reference throughout this specification to "one embodiment," "an embodiment," "some embodiments", "embodiments," or similar language means that a particular feature, structure, or characteristic described in connection with the embodiment is included in at least one embodiment of the present invention. Thus, appearances of the phrases "in one embodiment," "in an embodiment," "in some embodiments", "in embodiments," and similar language throughout this specification may, but do not necessarily, all refer to the same embodiment.

Moreover, the described features, structures, or characteristics of the invention may be combined ("mixed and matched") in any suitable manner in one or more embodiments. It will be apparent to those skilled in the art that various modifications and variations can be made to the present invention without departing from the spirit and scope and purpose of the invention. Thus, it is intended that the present invention cover the modifications and variations of this invention provided they come within the scope of the appended claims and their equivalents. Reference will now be made in detail to the preferred embodiments of the invention.

The terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. The term "set" is intended to mean a quantity of at least one. It will be further understood that the terms "comprises" and/or "comprising", or "includes" and/or "including", or "has" and/or "having", when used in this specification, specify the presence of stated features, regions, integers, steps, operations, elements, and/or components, but do not preclude the presence or addition of one or more other features, regions, and/or elements.

For the purposes of disclosure, the word, "substantially" is defined as "for the most part". It means "to a great extent," but having some room for some minor variation.

Throughout this disclosure, a legend "L" is used to indicate orientation of the various views of disclosed embodiments with respect to an X, Y, and Z axis.

FIG. 1A is a perspective view of an example cup 102 in accordance with some embodiments of the present invention. Cup 102 includes a cavity 106. In some embodiments, cavity 106 is sized and configured to fit over a region of skin of a user's body. In some embodiments, the cavity is sized and configured to fit over the region of skin on a vulva surrounding a glans clitoris of a user. Cavity 106 has a rim 108 defining an opening 110 of the cavity. Cavity 106 is defined by an interior lateral wall 112 and a base 114 (bottom in the orientation shown). The lateral wall 112 and base 114 may together be a single continuous substantially-rounded concave wall, or may include edges between flat surfaces. The cavity 106 may be any suitable shape. In some embodiments, cavity 106 is oval in shape as shown here. In some embodiments, lateral wall 112 and base 114 are comprised of a single continuous material with the cup 102.

The cup 102 (and, therefore, cavity lateral wall 112 and base 114) is preferably comprised of a non-permeable flexible resilient material. In some embodiments, the flexible resilient material has a Shore durometer value ranging from A5 to D60. In some embodiments, the flexible resilient material has a Shore durometer value ranging from A10 to D40. In some embodiments, the cup is comprised of silicone. In some embodiments, the cup is comprised of rubber, TPE, plastic, or other suitable material.

The cup's cavity 106 is adapted such that when rim 108 is placed on the skin of a user with the opening 110 over the area to be stimulated, a chamber filled with air is formed among the cavity walls 112, base 114, and the user's skin. The chamber is preferably sealed or substantially-sealed. Note that although herein, a "chamber" is referred to, in some embodiments, the chamber is comprised of several separate but connected compartments, such that air can flow between the compartments. Accordingly, the use of the word "chamber" in the singular is not meant to exclude split-chamber or multi-chamber configurations. "Pressure" as used herein refers to air pressure.

In some embodiments, the cup 102 additionally has a wing region formed thereon. There may be side wings 118*a*, 118*b* on each side of the cup 102, as well as a front wing 118*c*. In use for stimulation of a vulva, front wing 118*c* extends under the labia and under the mons pubis of a user to assist in holding the cup 102 to the skin of the user. This creates an improved seal of the chamber. Side wings 118*a* and 118*b* make contact with the labia during use for an improved seal and stimulation of the labia. Some embodiments may further include a basin 151 for improved seal.

Figure 1B:
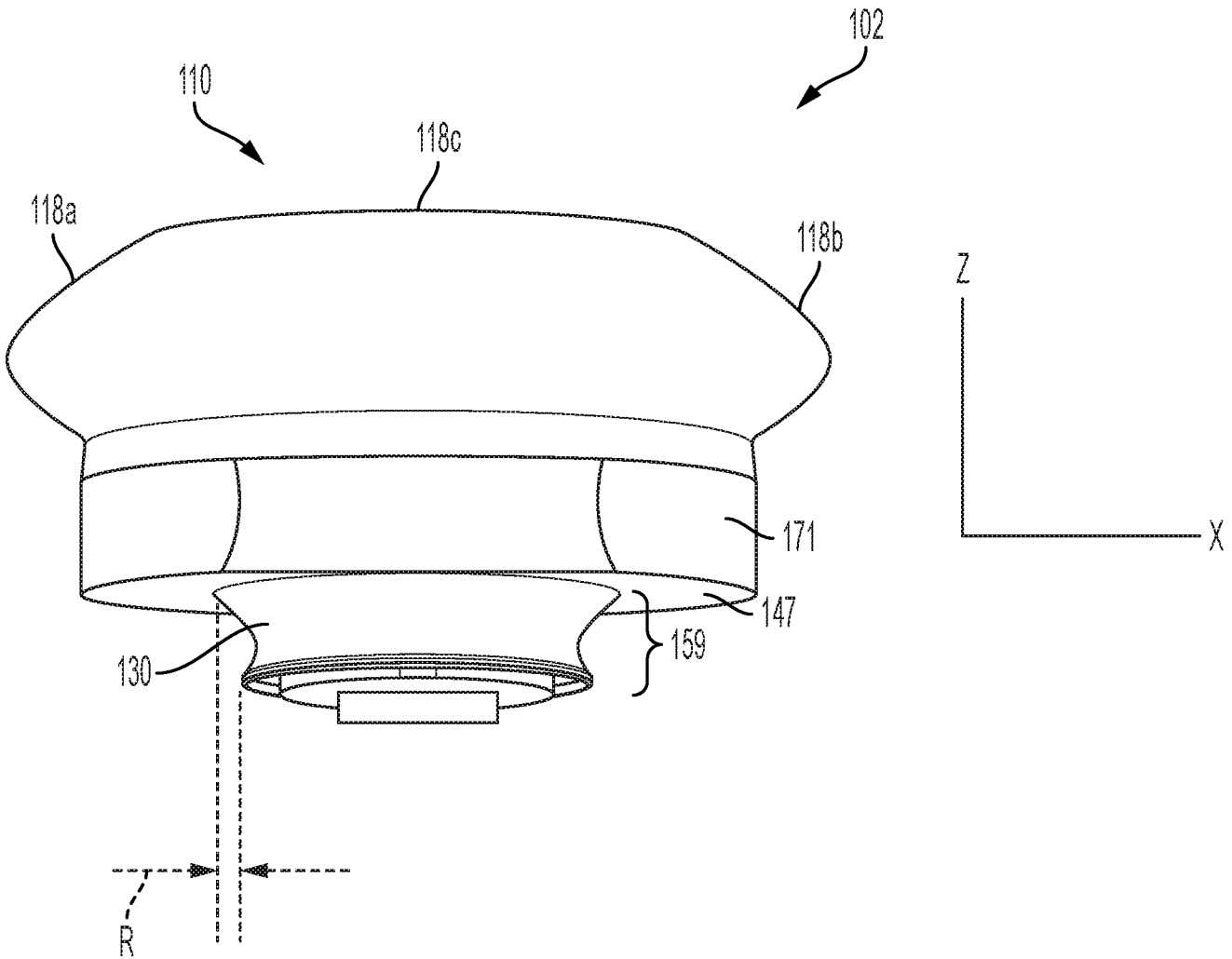
FIG. 1B is a front view of the cup of FIG. 1A.

FIG. 1B shows a front of the cup 102 of FIG. 1A. In this view, the wing regions 118*a*, 118*b*, and 118*c* are prominently shown. A buckle region wall 130 and an anchor wall 171 of cup 102 are each in view. The buckle region wall 130 compresses and uncompresses (i.e. expands) during operation of the pressure field stimulation device, resulting in a variable volume of the cavity 106 (FIG. 1) of cup 102. The anchor wall 171 serves as an anchor for the buckling of the buckle region wall 130. The buckle region wall 130 forms a resilient protrusion 159 that extends from the underside (floor) 147 of the anchor wall 171 of the cup 102.

Figure 1C:
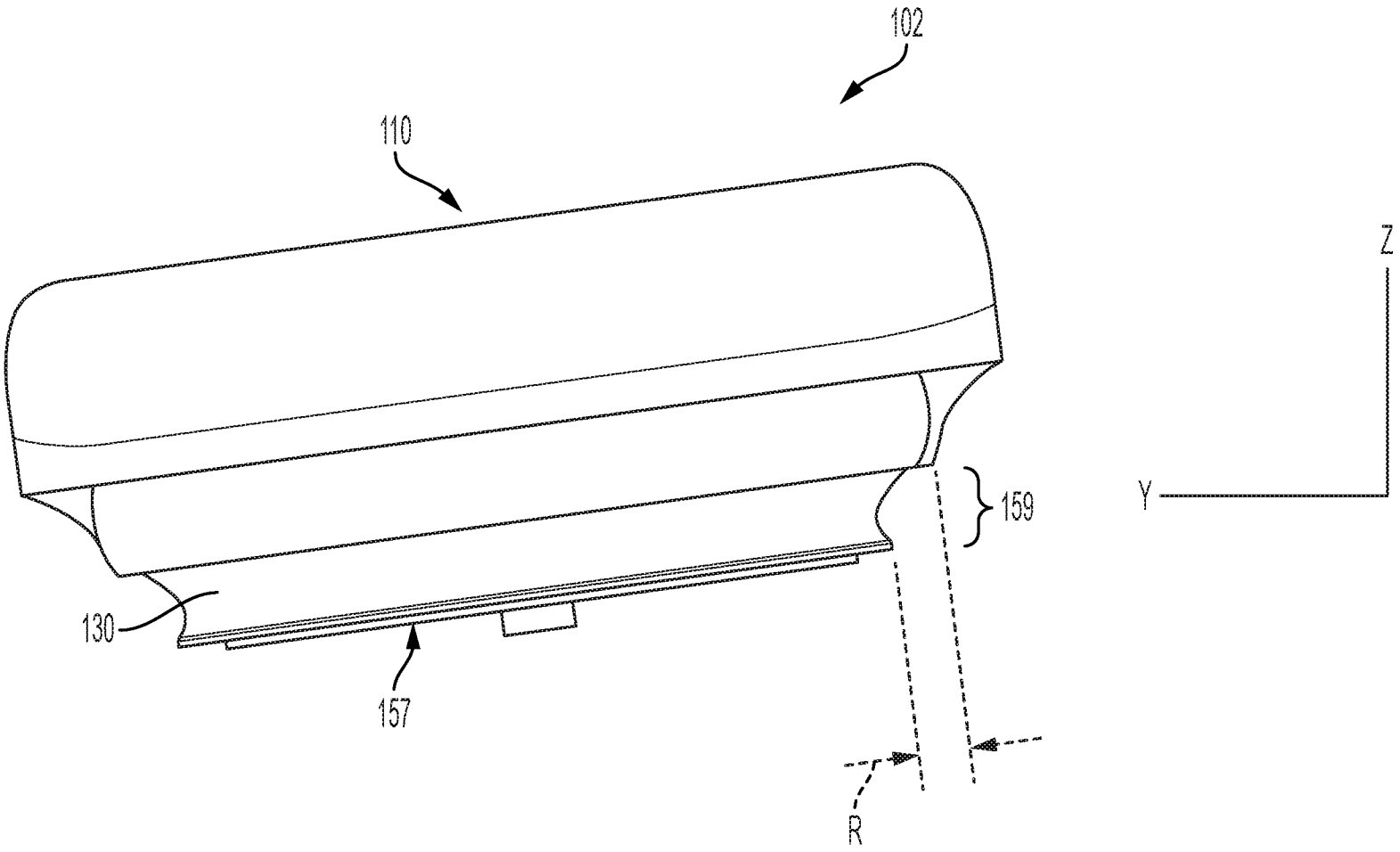
FIG. 1C is a side view of the cup of FIG. 1A.

FIG. 1C is a side view of the cup 102 of FIG. 1A. The opposite side of the cup 102 looks symmetrical in embodiments. The buckle region wall 130 forms a resilient protrusion 159, which is the buckle region, that extends from the underside 147 (FIG. 1B) of the anchor wall 171 of cup 102.

Figure 1D:
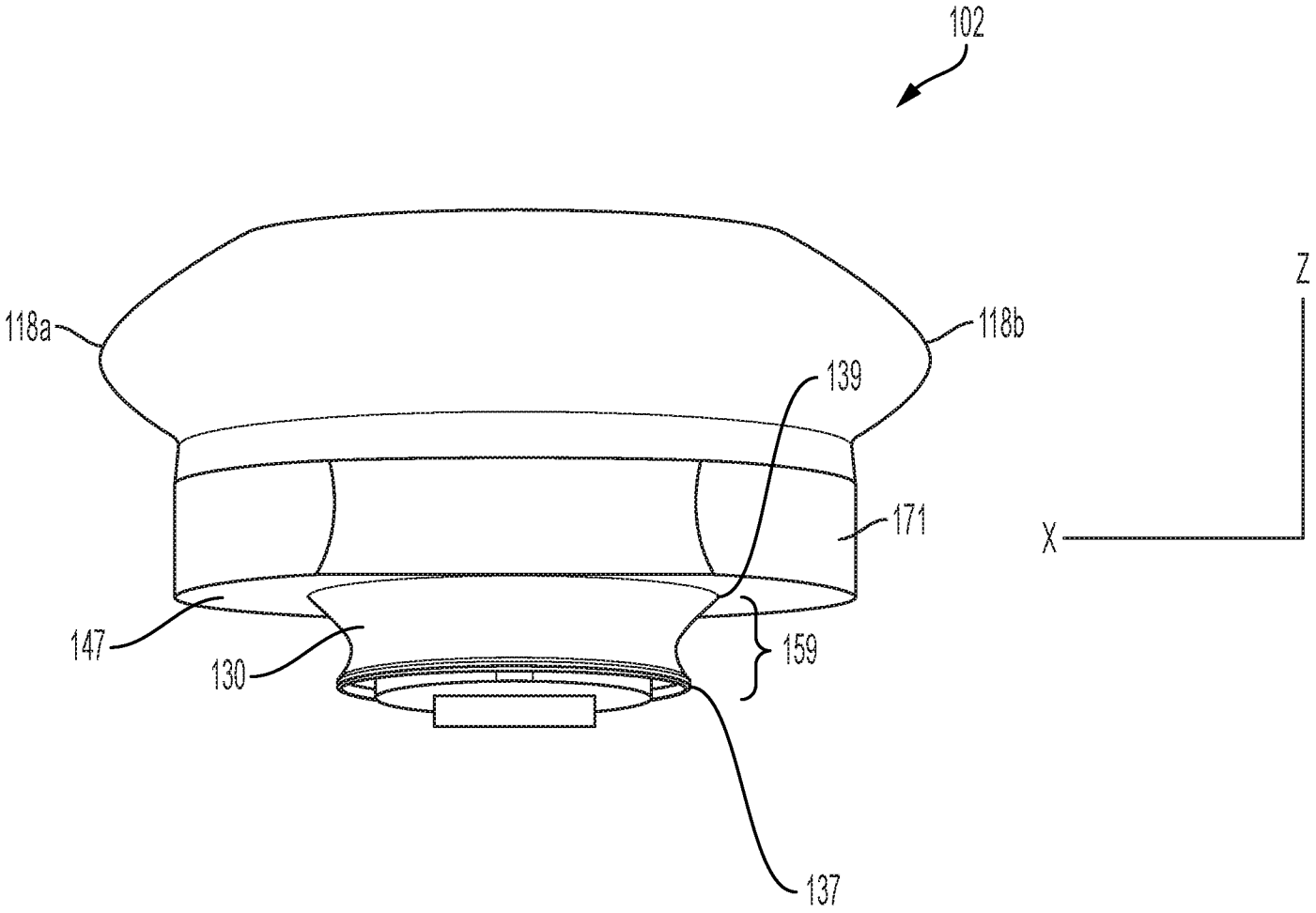
FIG. 1D shows a rear view of the cup of FIG. 1A.

FIG. 1D shows a rear view of the cup 102 of FIG. 1A. The buckle region wall 130 is in view with exterior first edge 139 and a second edge 137. First edge 139 is an upper exterior edge and second edge is a lower exterior edge shown ("exterior" is only used to denote that these edges are on the exterior of the cup, rather than interiorly inside the cavity). "Upper" and "lower" are used in description of the orientation shown, and not meant to be limiting. Buckle region wall 130 protrudes from the underside surface 147 of the anchor wall 171 of cup 102, and forms the protrusion 159. Anchor wall 171 has a wall thickness larger than the wall thickness of buckle region wall 130.

Figure 1E:
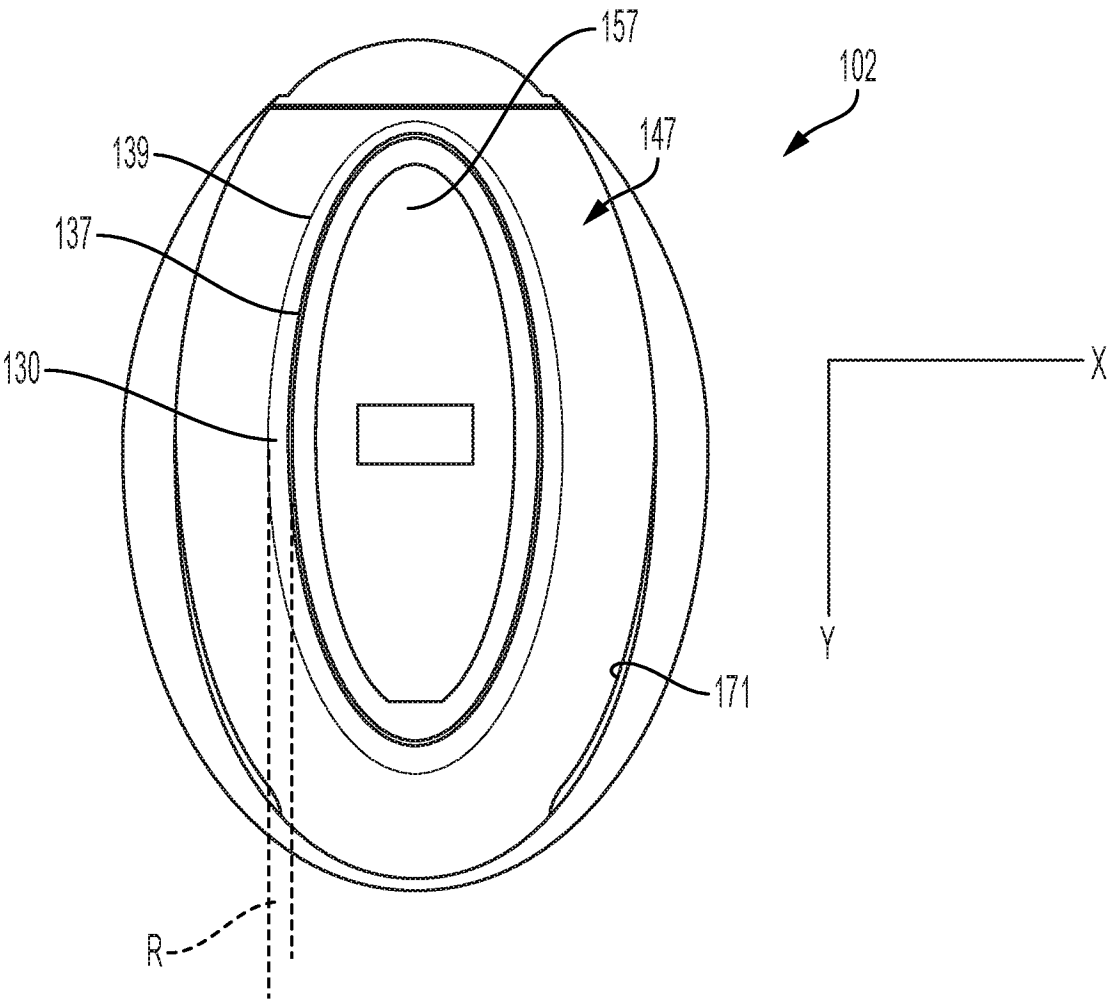
FIG. 1E is a bottom-up view of the cup of FIG. 1A.

FIG. 1E is a bottom-up view of the cup 102 of FIG. 1A. The buckle region is in view with the first edge 139 and the second edge 137 shown. A reveal R between edges 137 and 139 is configured to assist the buckle wall region in buckling under a compression force (also referred to herein interchangeably with "push force") from a driver. The buckling of buckle region wall 130 typically occurs prior to any warping of anchor wall 171. In some embodiments, the anchor wall 171 does not buckle or warp. In some embodiments, the anchor wall 171 does not substantially buckle or warp.

The reveal R is the difference in the X and Y dimensions, between the edge 137 and the edge 139, also as indicated in FIG. 1B, FIG. 1C, and FIG. 1D. In the embodiment shown, R is equal around the perimeters of edges 137 and 139. In other embodiments, R could have some irregularities.

In some embodiments, the buckle region wall 130 is concave in shape on its exterior surface. Thus, in some embodiments, the buckle region wall 130 has a concave exterior surface. In some embodiments, the first edge 139 is of a larger perimeter than the second edge 137. This creates the reveal R. In embodiments, the ovular shape outlined by the second edge 137 is oriented concentrically with respect to the ovular shape outlined by the first edge 139. In some embodiments, the buckle region 130 is formed with an ovular shape as shown in FIG. 1E. In some embodiments, the buckle region wall 130 is of a shape other than an oval. Any suitable shape is included within the scope of the invention.

The buckle wall region 130, with reveal R, is also configured such that it will spring back out to default (i.e. extended/relaxed) position when the compression force is removed. The buckle region wall 130 is made of a material that, when the second edge 137 is compressed towards the first edge 139 by a force of a mechanical member such as a cam of a driver, and then the force is subsequently removed from the second edge 137, the buckle region wall 130 quickly/abruptly returns to its default position (expanded position) with a spring-like motion. The buckle region behaves similar to a spring having a spring constant that causes the buckle region wall to abruptly return to its default position once the driver force is removed.

The cup 102 (and, therefore its components, including the cavity lateral wall 112, base 114, and buckle region 130) is preferably comprised of a non-permeable flexible resilient material. In some embodiments, the flexible resilient material has a Shore durometer value ranging from A5 to D60. In some embodiments, the flexible resilient material has a Shore durometer value ranging from A10 to D40. In some embodiments, the cup material is comprised of silicone. In some embodiments, the cup is comprised of rubber, TPE, plastic, or other suitable material. The material may be any elastomeric material.

Figure 2A:
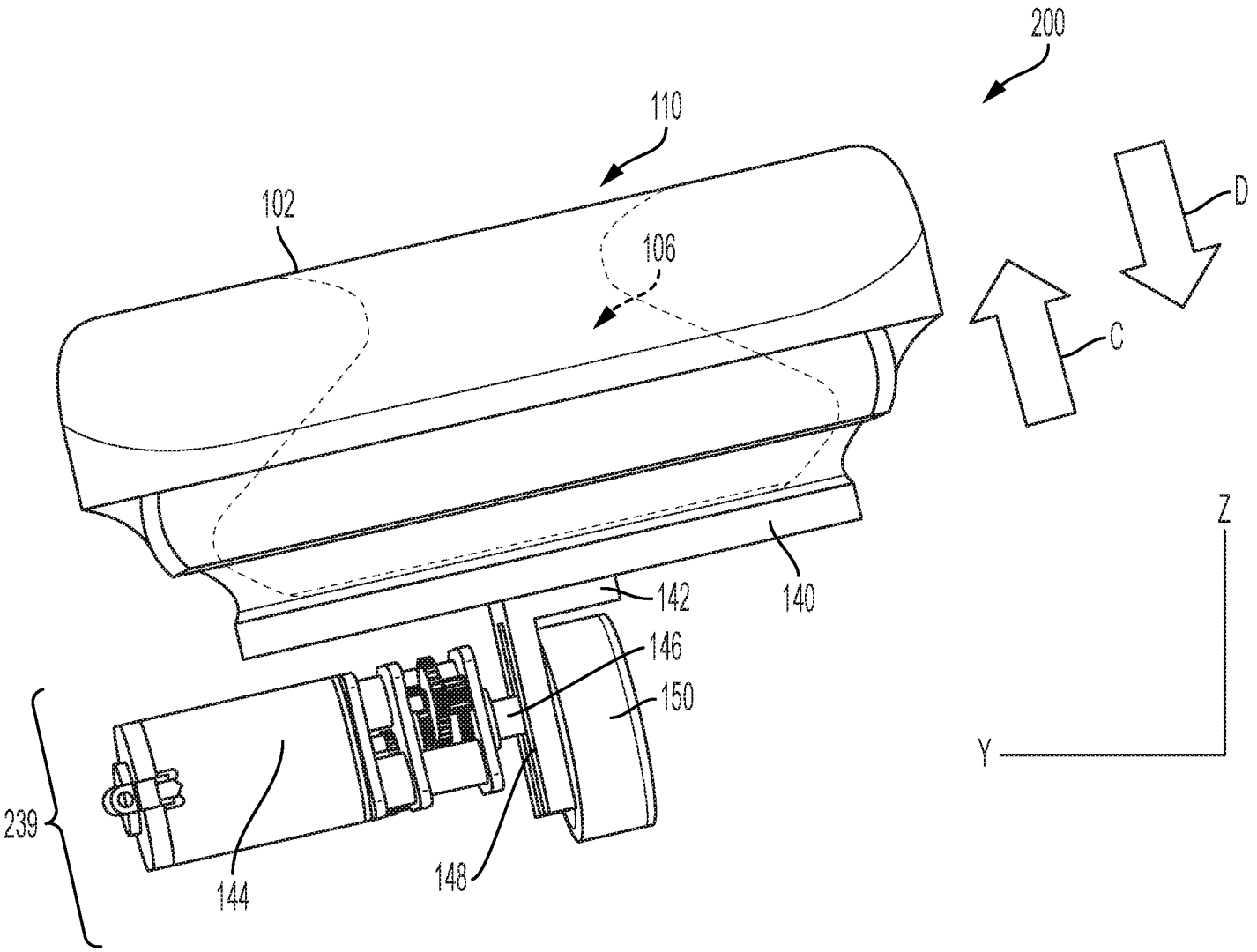
FIG. 2A is a side view of an embodiment 200 of example cup and example driver assembly in accordance with some embodiments of the present invention where the buckle region wall 130 is in default position.
Figure 2B:
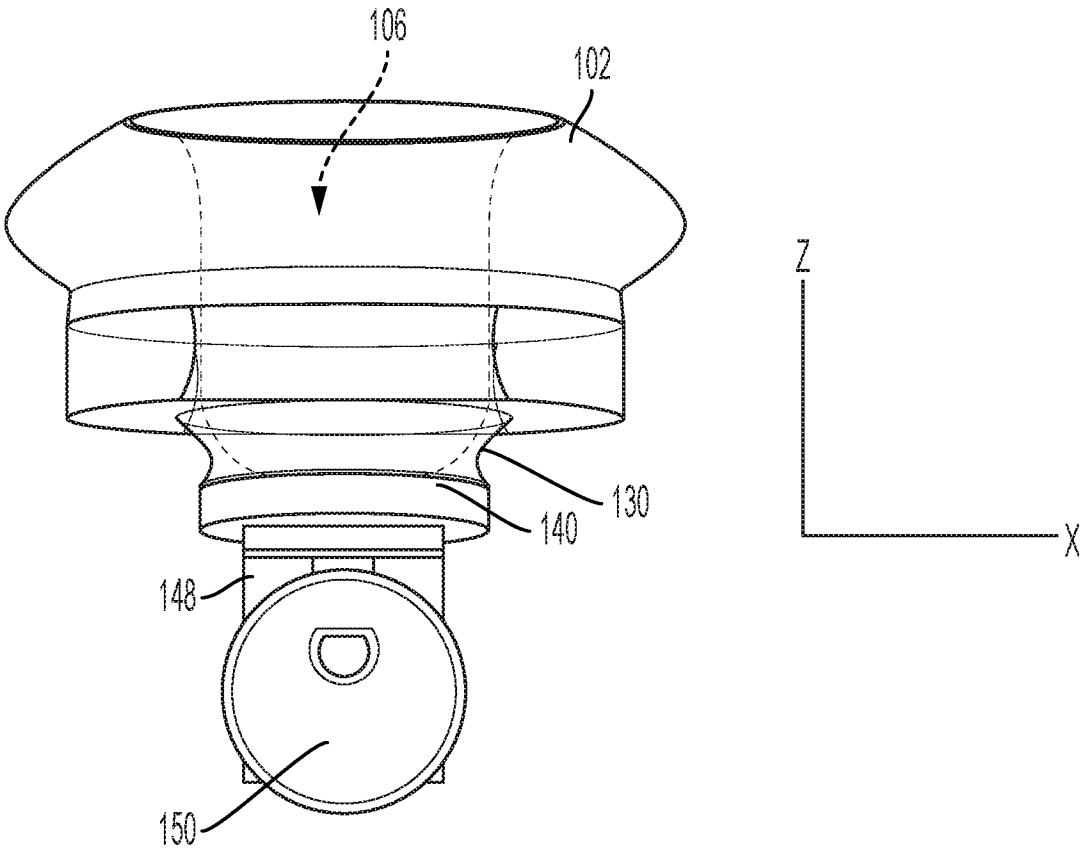
FIG. 2B is a front view of the cup and driver assembly in accordance with some embodiments of the present invention where the buckle region wall 130 is in default position.
Figure 2C:
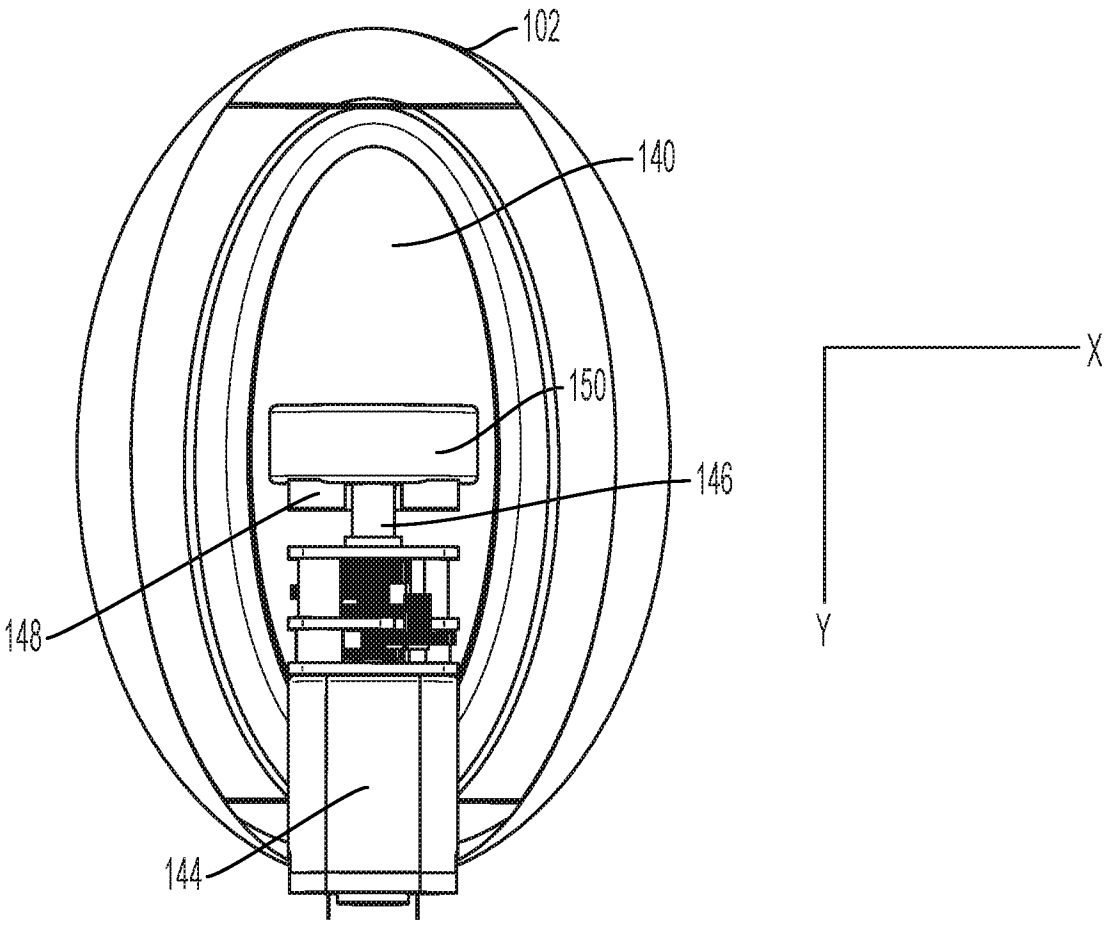
FIG. 2C is a bottom view of the cup and driver assembly in accordance with some embodiments of the present invention.
Figure 2D:
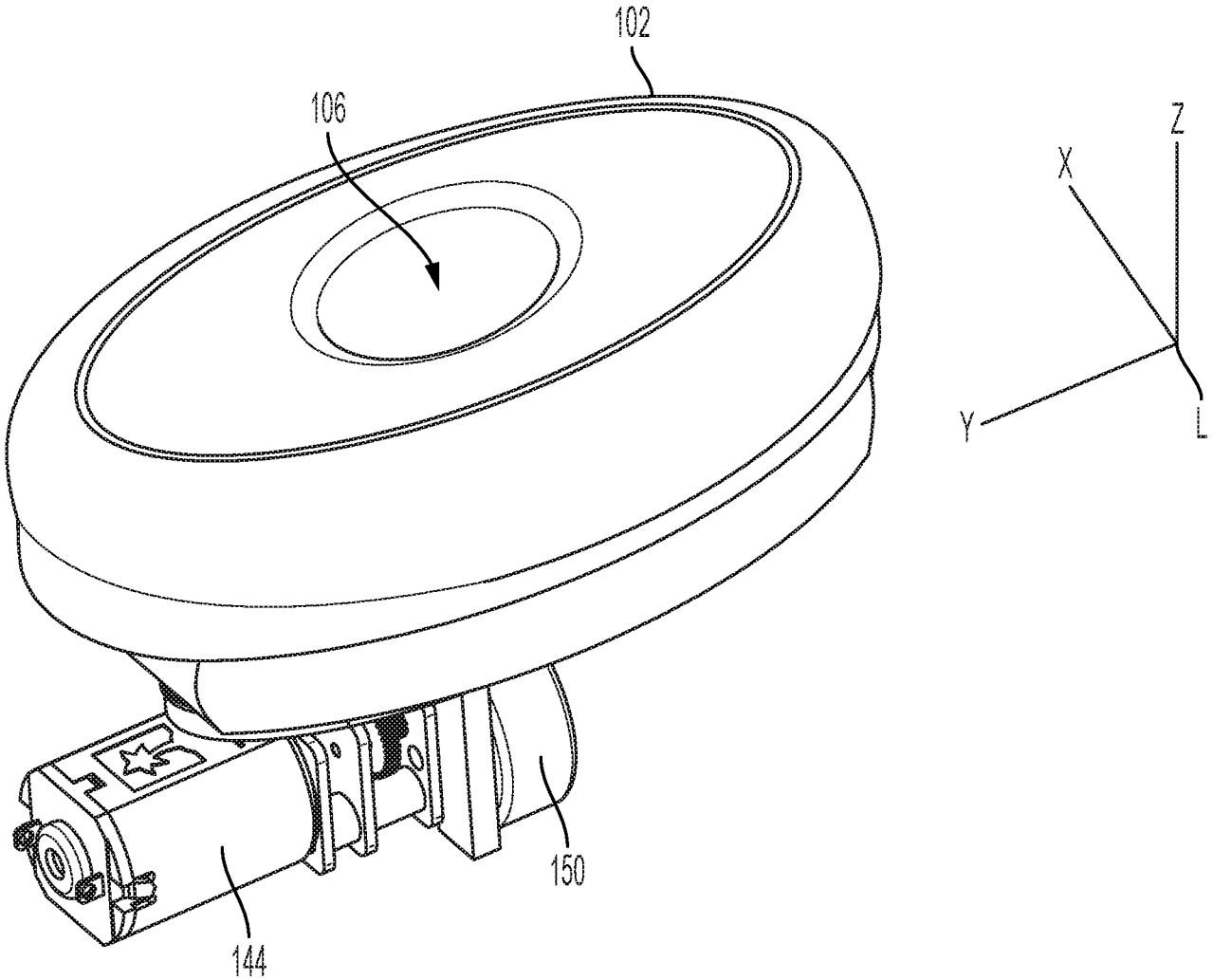
FIG. 2D is a perspective view of the cup and driver assembly in accordance with some embodiments of the present invention.

FIG. 2A is a side view of an embodiment 200 of example cup and driver assembly in accordance with some embodiments of the present invention where the buckle region wall 130 is in default position. FIG. 2B is a front view of the cup and driver assembly in accordance with some embodiments of the present invention where the buckle region wall 130 is in default position. FIG. 2C is a bottom view of the cup and driver assembly in accordance with some embodiments of the present invention. FIG. 2D is a perspective view of the cup and driver assembly in accordance with some embodiments of the present invention.

Referring now to FIGS. 2A-2D, there is shown a driver assembly 239 comprising a plate 140, a cam 150, and a motor 144. In embodiments, there is a cam 150 disposed adjacent to the plate 140. In the example, although the cam 150 and the plate 140 intermittently make contact with one another, they are not permanently connected to one another. In embodiments, the plate is disposed on an underside surface of the buckle region wall 130 of the cup. In embodiments, the driver also includes any additional mechanical coupling such as gears, pullies, shafts, and/or other devices to impart motion to components of the pressure field stimulation device. In some embodiments, the plate 140 is rigid, or substantially-rigid. It can have some flexibility, but must have a hardness such that the cam 150 can vary the position of the plate 140. The hardness/flexibility of the cup as compared with that of the plate is such that when the cup puts a force on the plate, the plate does not flex. In some embodiments, the plate 140 is comprised of plastic, metal, silicone, and/or other suitable material. The cam 150 is rigid or substantially rigid such that it can apply a push force on the plate 140. The push force is a force that can result in compression of a portion of the cup 102, such as the buckle region wall 130 of the cup. In embodiments, the cam 150 is made of plastic, metal, or other suitable material. Driver 239 pushes plate 140 in a direction indicated by arrow C, reducing the volume of cavity 106. The cavity 106 returns to default position in direction indicated by arrow D, increasing the volume of cavity 106.

Plate 140 is in contact with an underside (157 of FIG. 1E) of buckle region wall 130. Plate 140 may be adhered, welded, integral with, pinned, or otherwise connected with the underside of the cup. In the example, the plate 140 is substantially rigid, and comprised of plastic, metal, and/or other suitable material. In some embodiments, motor 144 is configured such that a motor shaft 146 is disposed within a motor shaft guide 148 (comprised of a flange on each side of the motor shaft 146). The shaft guide 148 keeps the alignment of the plate 140 above the cam 150, ensuring that the force of the cam 150 is toward the plate 140, minimizing force to the sides A cam 150 is mechanically coupled to the motor 144 via shaft 146. In some embodiments, the plate has a connected, or integral, or monolithic cam strike 142. The cam strike may be a protrusion from the plate, to which contact is made by the cam 150. In some embodiments, a cam strike 142 is not present, and the cam 150 contacts a substantially flat portion of the underside of the plate 140.

Referring to FIG. 1E, in some embodiments, the underside wall 157 of protrusion 159 is rigid enough to function as the plate of the driver. Accordingly, the plate can be integral with the underside of the buckle region wall 130. In such instances, the wall 157 may be a silicone of a Shore durometer value ranging from A20 to D60, while the buckle region wall 130 of the cup is resilient, being of a Shore durometer value ranging from A5 to D30. In some embodiments, a separate plate, such as 140 of FIGS. 2A-2D or 740 of FIGS. 7A-7E, is connected to wall 157 on underside of buckle region wall 130, so the wall 157 does not have to be rigid.

Referring now again to FIG. 2A, during operation, the motor 144 rotates the cam 150. During the rotation cycle, cam 150 makes intermittent contact with the plate 140, which pushes plate 140 in direction C to cause compression of the buckle region wall 130 of cup 102, bringing cavity 106 from a first volume (V1) to a second volume (V2). When the cam 150 continues to rotate, it eventually abruptly loses contact with the plate 140 (or cam strike 142, if present). In order to abruptly remove the push force from the underside of the cup, the cam 150 rotates at a speed such that the contact edge of the cam 150 is moved away from the plate 140 faster than the buckle region wall 130 can spring back to its default position. During this time of non-contact, the buckle region 130 of cup 102 expands in direction D, or "springs" out, to the first volume (V1). The expansion is due to the configuration of the buckle region wall 130 (without electrically-assisted pull or push). In some embodiments, the driver does not pull or push it to spring back. The volume of the cavity is varied as the buckle region wall 130 changes positions cyclically (i.e. repeatedly), creating a pressure field in the chamber.

Various settings are associated with corresponding speeds of the driver (e.g., rotations per minute of the cam). Accordingly, a user may choose that the pressure field stimulation device generate greater or lower pressure for their comfort level. The higher the speed, generally, the more intense the stimulation, and vis versa. The general amount of pressure generated by the pressure field stimulation device is calibrated (factory-settings). Preferably, at its lowest setting, the pressure generated is of an amount great enough that most people would be able to feel on their body when the cup is applied, and at its highest setting, low enough such that it would not usually hurt a body part when applied. In embodiments, a user may modify the strength of the pressure field via user input to a user interface.

Figure 3A:
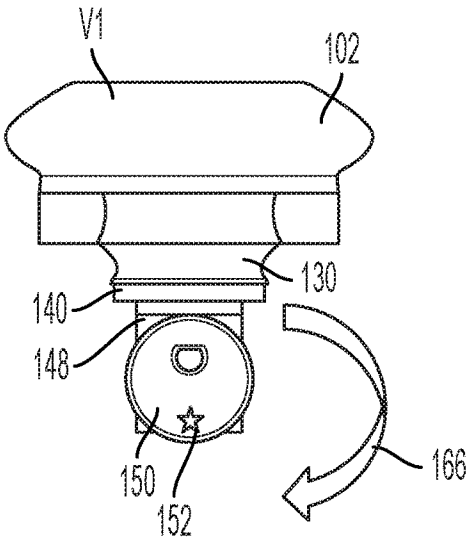
FIG. 3A shows an example motion sequence cycle for some embodiments of the present invention at t=t0.

FIGS. 3A-3D show an example motion sequence cycle for some embodiments of the present invention similar to the embodiment of FIGS. 2A-2D. FIG. 3A shows a starting position (before the cam begins to rotate) for the cam 150 at an initial time t=t0. As shown in FIG. 3A, the high point 152 of cam 150 is oriented away from the plate 140. The "high point" is the location of the cam farthest away from the point at which the cam is rotated by the motor shaft. Buckle region wall 130 is shown in a default position. The cavity of the cup 102 has a first volume (V1). In operation, the starting position shown in FIG. 3A represents a maximum volume Vmax for an operational cycle. Accordingly, V1=Vmax. In the example, the cam 150 rotates in a direction indicated by arrow 166. In some embodiments, the cam 150 may instead rotate in the opposite direction, the theory of operation is similar.

Figure 3B:
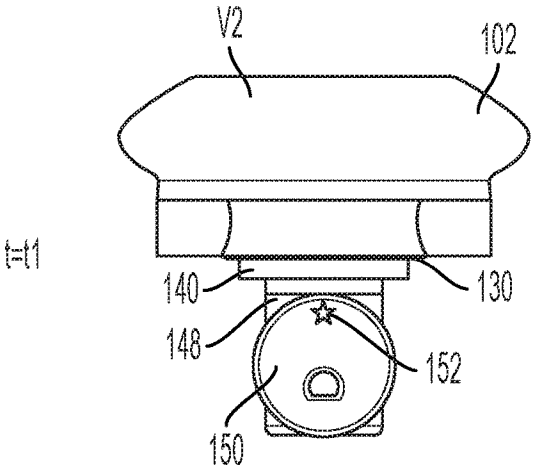
FIG. 3B shows an example motion sequence cycle for some embodiments of the present invention at t=t1.

FIG. 3B, shows the cam 150 at an intermediate position at time t=t1. The cam 150 is rotated 180 degrees such that the high point 152 of cam 150 has pushed the plate 140 such that it has caused the buckle region wall 130 of the cup 102 to buckle, or compress in the cavity (e.g., 106 of FIG. 1A), to a second volume (V2), which is a minimum volume Vmin.

Figure 3C:
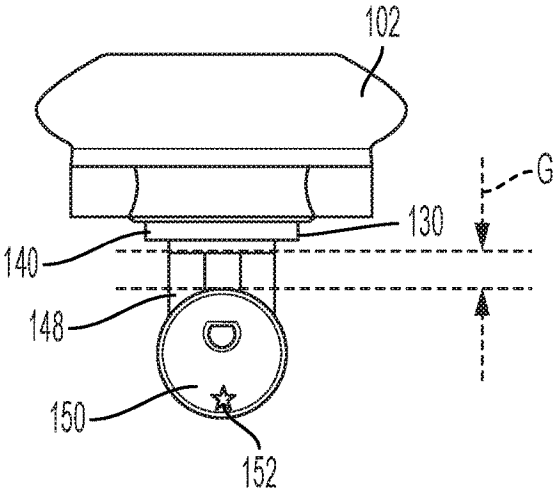
FIG. 3C shows an example motion sequence cycle for some embodiments of the present invention at t=t2

FIG. 3C, shows the cam 150 after a complete revolution of the cam 150 at time t=t2. The high point 152 has returned to the same position as it was in FIG. 3A. However, the rotation speed of the cam 150 is sufficiently fast such that the buckle portion 130 of cup 102 has not yet expanded to its default position, creating a gap G between the plate 140 and the cam 150.

Figure 3D:
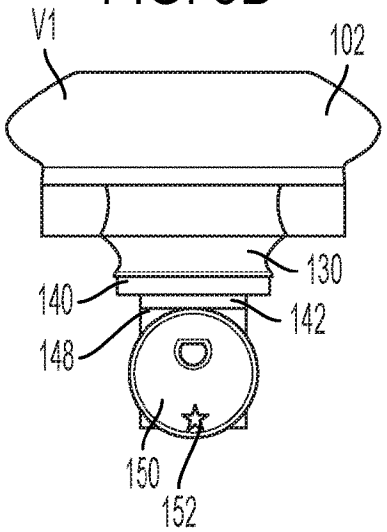
FIG. 3D shows an example motion sequence cycle for some embodiments of the present invention at t=t3.

FIG. 3D shows the cup 102 at time t=t3, at which time the buckle region 130 has expanded back to the default state (also shown at FIG. 3A), moving the plate 140 towards the cam 150. Therefore, at the end of the operational cycle, the volume of the cavity returns to V1, which is Vmax. Therefore, the buckle region 130 is configured such that it will return from V2 to V1 in time for the next strike of the cam 150 to plate 140 (in some cases, against the cam strike).

In some embodiments, the cavity returns from the second volume (V2) to the first volume (V1) due only to the elasticity of the flexible elastic material of the cup. In returning from V2 to V1, the buckle region expands from a compressed position to a default (expanded) position. In some embodiments, returning of the cavity from the second volume to the first volume is achieved without a force external to the cup material, such as electrical assistance or mechanical assistance from another article or device, such as the driver.

In some embodiments, the cavity of the cup returns from the second volume to the first volume, in between intermittent repetitions of the varying, as a result of the configuration of the cup 102, including buckle region wall 130. As the buckle region wall 130 of cup 102, expands or "springs out," the buckle region wall 130 causes a thud force, or a "thumping" effect" throughout the cup, including the anchor walls 171. Such thud force is imparted to the skin/labia of the user when the cup 102 is in contact with the skin/labia, creating a pleasurable effect for the user. Thus, the thud force is a transfer of mechanical energy from the springing out of the buckle, which is imparted to the user through the cup. It may feel like a jolt to the user during use. Wings 118*a*-118*c* (e.g., FIG. 1A), if present, may assist with imparting the force to the skin/labia.

In some embodiments, the cam rotation is continuous. In other embodiments, the cam may stop at the position indicated by FIG. 3D for a predetermined amount of time before starting another rotation cycle. As an example, in some embodiments, the cam 150 may remain in the position indicated at FIG. 3D for a duration ranging from 200 milliseconds to 800 milliseconds, before starting another rotation cycle as indicated at 166 of FIG. 3A. These duration and speed values are exemplary, and other values are included within embodiments of the present invention.

During usage, a rim (e.g., 108 of FIG. 1) of the cavity (e.g., 106 of FIG. 1) is placed in contact with the skin surrounding the clitoral region (or other region of the body to be stimulated) to form a sealed, or substantially-sealed, chamber. The opening of the cavity is disposed over the clitoral region (or other region of the body to be stimulated). In the example of FIG. 3A, the cam is initially at its lowest position (turned to a point where that it provides minimum actuation so as to provide minimal or no compression of the cup), such that the initial volume of the cavity, V1, is Vmax. The initial pressure in the chamber is P1. When the stimulation device is powered on, the cam is rotated by the motor, causing the cam to make contact with the cam strike (or plate). This pushes the plate 140 to compress the cavity to a lower volume, indicated as V2, which in the example is Vmin. This increases the pressure inside the chamber to a maximum pressure indicated as P2. As the cam continues to rotate, and loses contact with the cam strike (or plate), the cavity returns to the non-compressed/maximum volume initial default position indicated as V1, releasing pressure in the chamber back to the minimum pressure value of P1.

In other words, the pressure starts at P1 (a reference pressure), which is a gauge pressure reading of zero, which is the difference between the absolute pressure and the atmospheric pressure. This is measured at the geographic location currently where the stimulation device is being used. In other words, the gauge reading of zero is the ambient air pressure, at the geographic location that the user is using the stimulation device, that exists at the time the user uses the device. In the example of FIGS. 3A-3D, as the cavity is compressed from V1 to V2, the pressure increases to P2 (the maximum pressure). As the buckle region wall 130 expands the cavity from V2 to V1, the pressure returns back to the starting pressure (P1). Since, in the example, the varied volume of the cavity is never greater than the initial volume (V1) at start time, no pressure below the reference pressure (start pressure) is generated in the chamber. The start time is when both the cup is in place on the user's body, forming a chamber, and the device is powered on. Accordingly, only pressure at or above the reference pressure is generated.

In embodiments, the pressure field consists of pressure at or above a reference pressure. This varying pressure field stimulates a user's skin and/or clitoris by simulating a light touch similar to the way a person would stimulate themselves or another person by lightly touching them.

Figure 3F:
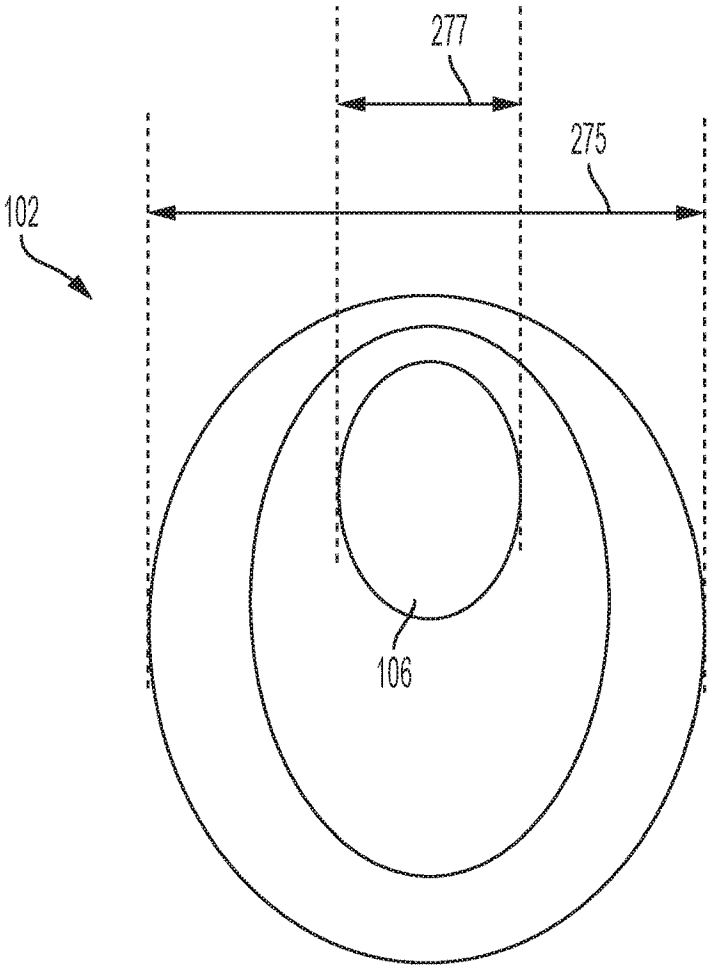
FIG. 3F is a top-down view of the cup as shown the compressed configuration of FIG. 3B.
Figure 3E:
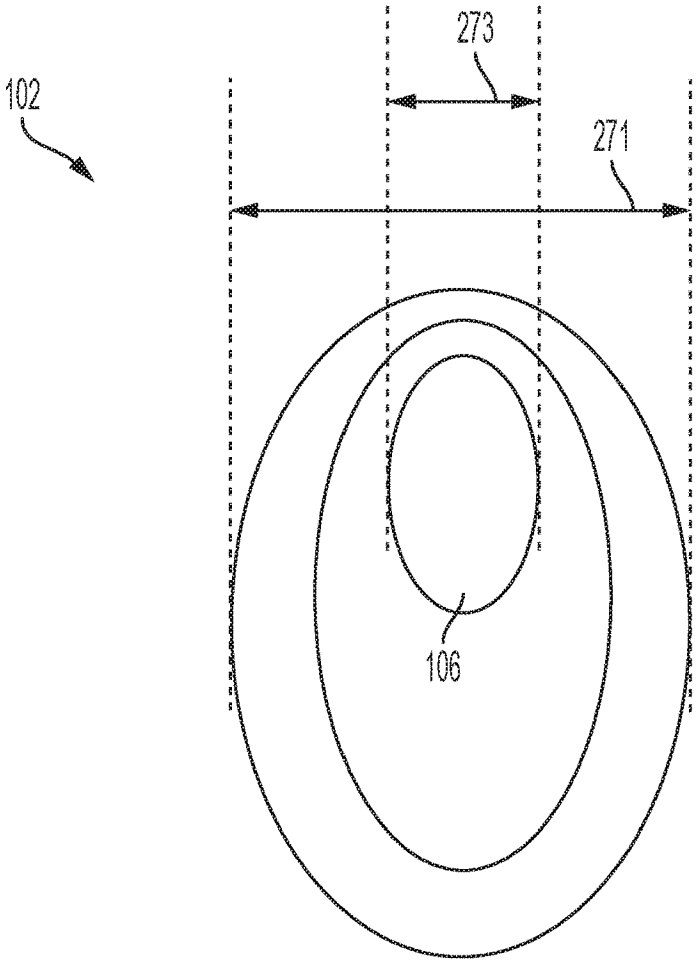
FIG. 3E is a top-down view of the cup as shown the uncompressed configuration of FIG. 3A.

FIGS. 3E-3F are top-down views that illustrate lateral expansion and contraction during the operation cycle illustrated in FIGS. 3A-3D. FIG. 3E corresponds to a top-down view of the cup 102 as shown the uncompressed configuration of FIG. 3A. In the uncompressed configuration, the cup 102 has an outer width 271, and a cavity width 273, corresponding to a width of cavity 106. FIG. 3F corresponds to a top-down view of the cup 102 as shown the compressed configuration of FIG. 3B. In the compressed configuration, the cup 102 has an outer width 275, and a cavity width 277, corresponding to a width of cavity 106. The compressed configuration widths are greater than the corresponding uncompressed configuration widths. Thus, width 275 is greater than width 271. Similarly, width 277 is greater than width 273. In some embodiments, for the uncompressed configuration, width 271 is 42 millimeters and width 273 is 10 millimeters. In those embodiments, for the compressed configuration, width 275 is 43 millimeters and width 277 is 11.5 millimeters. In some embodiments, the widths of the compressed configuration are between 3 to 15 percent greater than corresponding widths of the uncompressed configurations. In embodiments, a width of the cavity of the cup increases from a first width to a second width, during a transition from the second volume back to the initial volume, as depicted in the cycle of FIGS. 3A-3D. This expansion and contractions serves to mimic behavior of a human mouth engaged in oral sex with a vagina, serving to enhance the pleasure of the user during use of the device.

Figure 4:
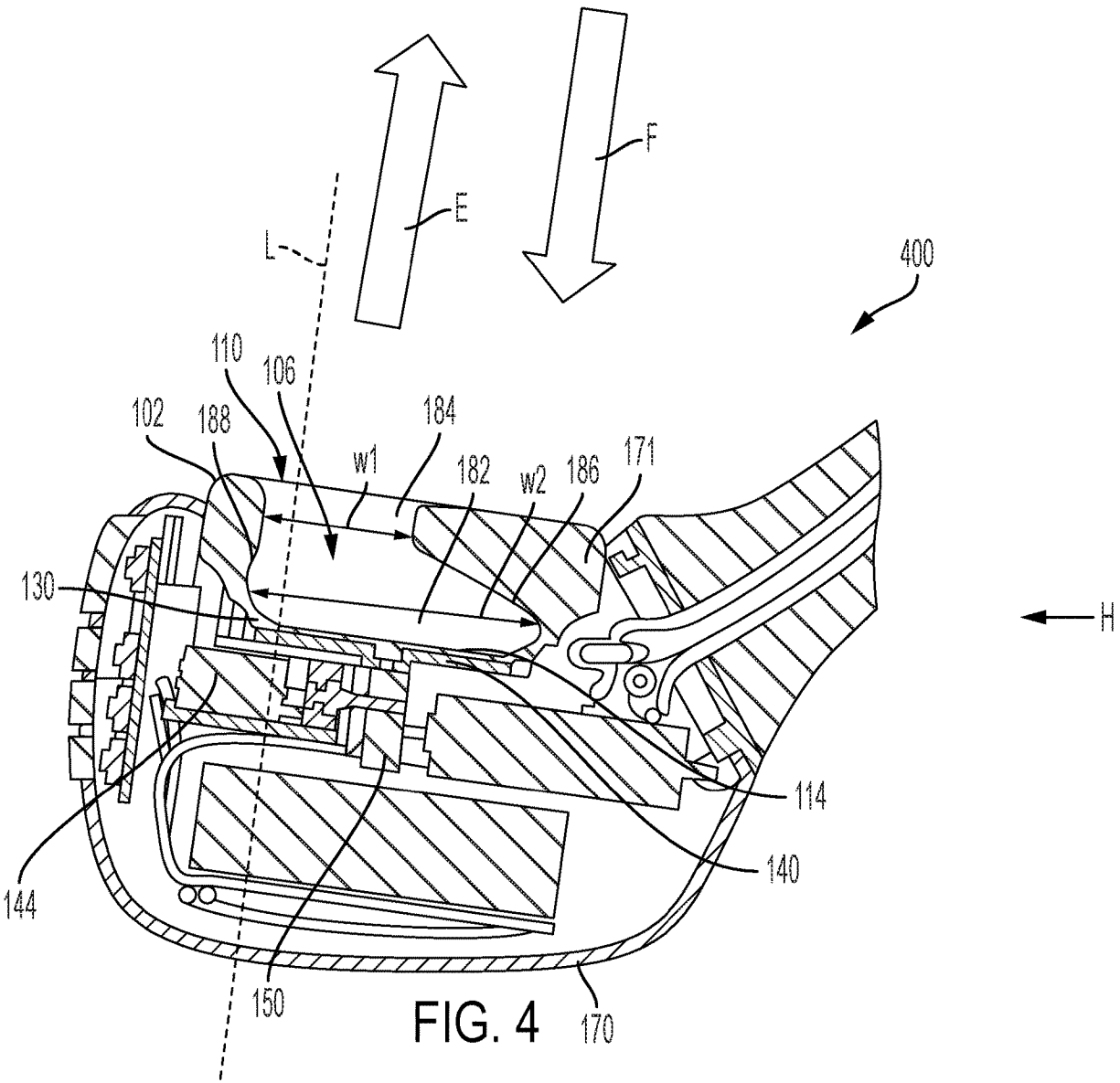
FIG. 4 shows a cross-section of an embodiment of the invention including a cup and a driver installed into a housing.

FIG. 4 shows a cross-section of an embodiment 400 of the invention including a cup and a driver installed into a housing. The cup 102 is, disposed on a housing 170. In some embodiments, housing 170 is made from plastic, metal, or other suitable rigid material. In some embodiments, cup 102 is molded into a sheath including a layer of silicone, TPE, or other suitable material, disposed on the housing. In some embodiments, the cup is adhered to, or otherwise attached directly to, the housing 170 without molding into a sheath. The components of the driver are disposed within the housing 170. In embodiments, the driver includes a motor 144, plate 140, and cam 150. During operation, the motor 144, mechanically coupled to cam 150, rotates the cam 150. When the cam 150 is in contact with plate 140, the cam 150 pushes plate 140 to compress the buckle region wall 130 of cup 102 in the direction indicated by arrow E, reducing the volume of the cavity 106 from V1 to V2. This increases the pressure in a chamber formed by the cavity 106 and skin of a user when the device is in use. When the cam 150 is not in contact with plate 140, the buckle region wall 130 of cup 102 expands back to V1 in the direction indicated by arrow F.

In the embodiment of FIG. 4, to increase the amount of air compression/pressure near the user's body, the cavity 106 comprises a first width W1 and a second width W2 where W1 is not equal to W2. In the example shown, W1, closer to the opening 110, is smaller than (<) W2, closer to the base 114. In some embodiments, W2 may be smaller than W1. Additionally, in some embodiments, the cross section of cavity 106 may be asymmetrical. For example, edge 186 of the lateral cavity wall has a dissimilar contour as compared to edge 188 of the lateral cavity wall. Thus, in some embodiments, the cavity 106 comprises an asymmetrical cross-section. In operation, as the base 114 of the cavity 106 is pushed by the plate 140, air is compressed from the wider, lower portion 182 into the more narrow, upper portion 184, resulting in an increase in air compression/pressure in the chamber (formed by the cavity and user's skin), providing a pleasurable sensation for the user.

Figure 5A:
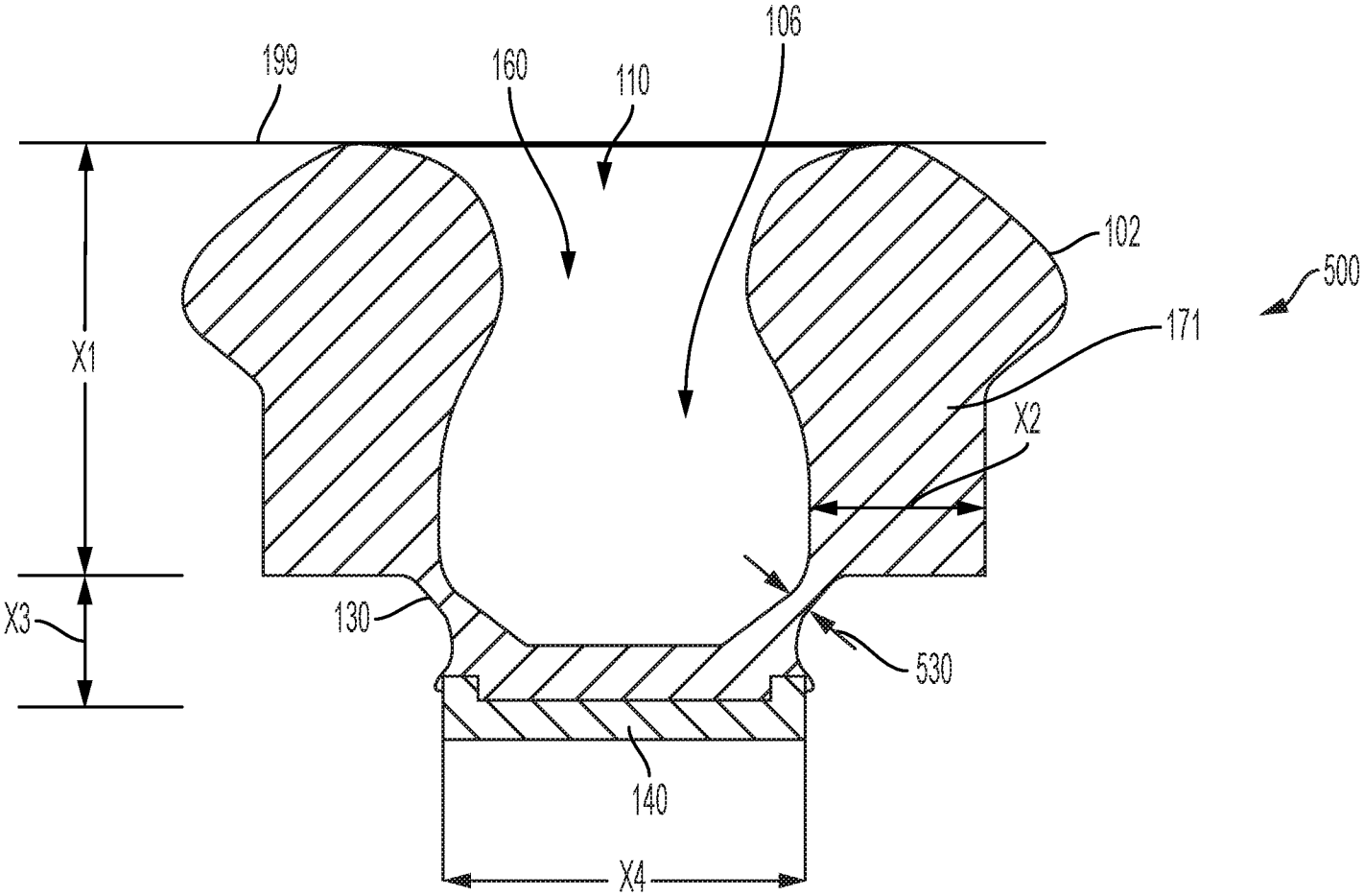
FIG. 5A shows a cross-section diagram of a cup and plate assembly in default position against skin of a user.

FIG. 5A shows a cross-section diagram (cut along line L of FIG. 4 viewed from direction indicated by arrow H of FIG. 4) of a cup and plate assembly 500 in default position against skin 199 of a user. Buckle region wall 130 is shown in default position. Anchor wall 171 is in view. The material of the buckle region wall 130 is "relaxed". In use, the user places the opening 110 of the cup 102 onto their skin 199. The skin 199 seals or substantially seals a cavity 106 to form a chamber 160.

Figure 5B:
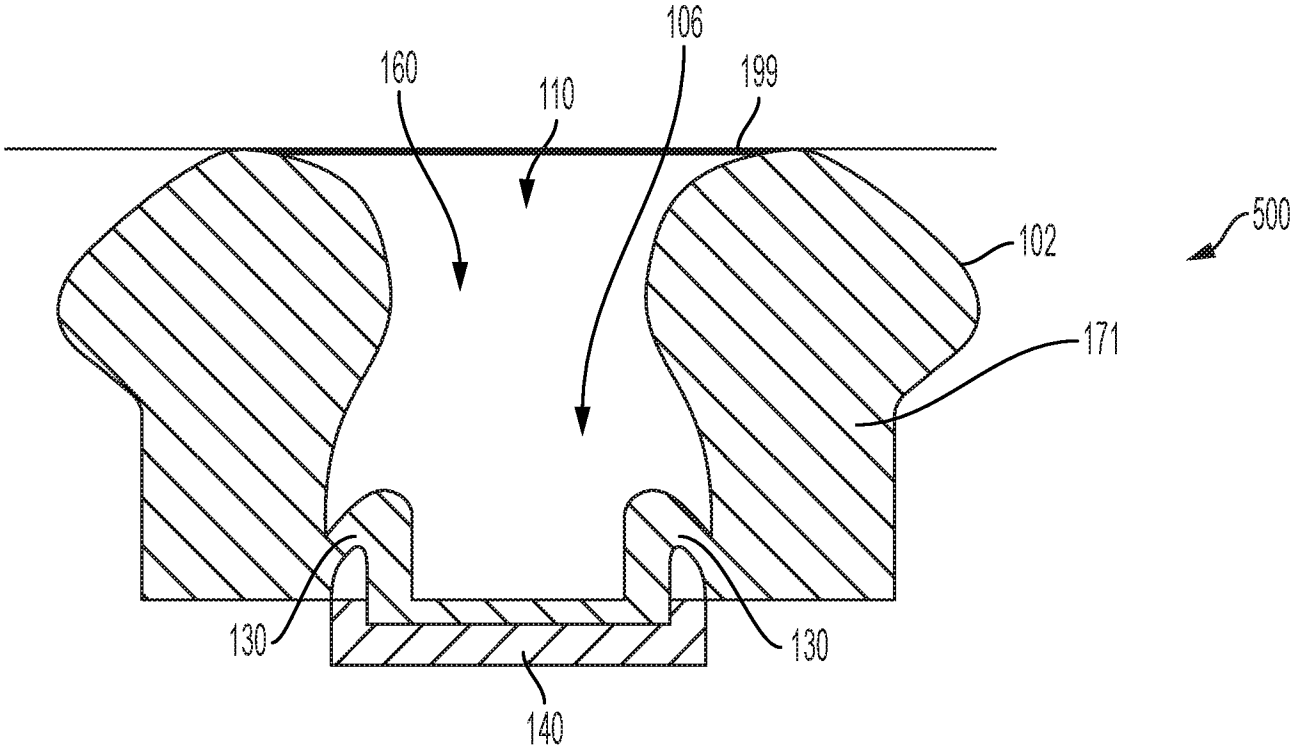
FIG. 5B shows a cross-section diagram of a cup and plate assembly of FIG. 5A in compressed position against skin of a user.

FIG. 5B shows a cross-section diagram of a cup and plate assembly 500 of FIG. 5A in compressed position against skin 199 of a user. As shown, buckle region wall 130 is compressed due to pushing force placed on it by the cam (e.g., FIGS. 3A-3D) through plate 140. Accordingly, the volume of the cavity 106 in FIG. 5B is different from the volume of the cavity 106 in FIG. 5A. Note that anchor wall 171 may buckle, or bend, in addition to the buckle region, in some embodiments. In such though, the buckle region wall 130 will buckle first.

As the stimulation device continues to operate from the compressed position shown in FIG. 5B, the buckle region 130 expands out to the default position (FIG. 5A) once the pushing force of the cam 150 is removed. In some embodiments, this expansion occurs without electrical assistance or mechanical assistance from a device external to the cup structure (meaning the material and the configuration of the cup). The cavity expands in volume during the time of non-contact of the cam 150 to the rigid plate 140. Accordingly, during the operational cycle, the volume of the cavity is cyclically varied to create a pressure field in the chamber during use.

The following configuration of the cup is optimal for expansion from compressed position to default position to create the thud force, without a force external to the cup structure. In embodiments, dimension X1 (height of the cup) ranges from 16 millimeters to 20 millimeters. In embodiments, dimension X2 (anchor wall 171) ranges from 6 millimeters to 10 millimeters. In embodiments, the buckle depth X3 ranges from 4 millimeters to 20 millimeters. In embodiments, the buckle width X4 ranges from 20 millimeters to 30 millimeters. In embodiments the minimum thickness 530 of the buckle region wall 192 ranges from 1 millimeter to 4 millimeters. In some embodiments the ratio of the buckle region wall minimum thickness 530 to the buckle depth ranges from 0.05 to 1.00. In some embodiments, the buckle region wall material has a Shore durometer value ranging from A5 to D30. In some embodiments, the Shore durometer is D30. Although these values are optimal, any suitable values for the variables described herein are included within the scope of the invention that can achieve the result described herein.

Note that in some embodiments, the cup may be configured differently, and therefore, return to V1 only due to the resilient nature of the cup material. In such cases, the return may be at a slower acceleration than when a cup with a configuration as shown herein is used. The slower acceleration will result in loss of the thud effect, and instead be a more "smooth" return.

In some embodiments, the speed of the rotation of the cam is 10 to 5000 rpm. In some embodiments, the speed ranges from 300 rpm to 600 rpm. In some embodiments, the speed of the cam rotation is a setting that is user-adjustable, allowing the user to customize the operation of the stimulation device for their preference. The user can choose a higher speed for an increased frequency of pressure changes (and vis versa), and also control the frequency of the resulting cyclical thud forces, if present.

Figure 6B:
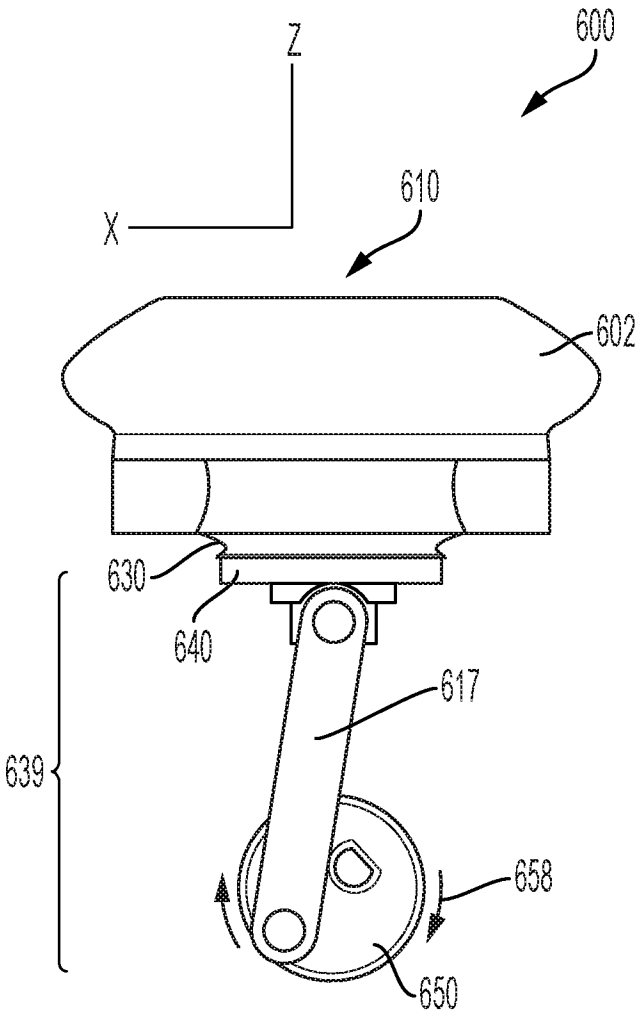
FIG. 6B shows a front view of an alternative driver and cup assembly.
Figure 6A:
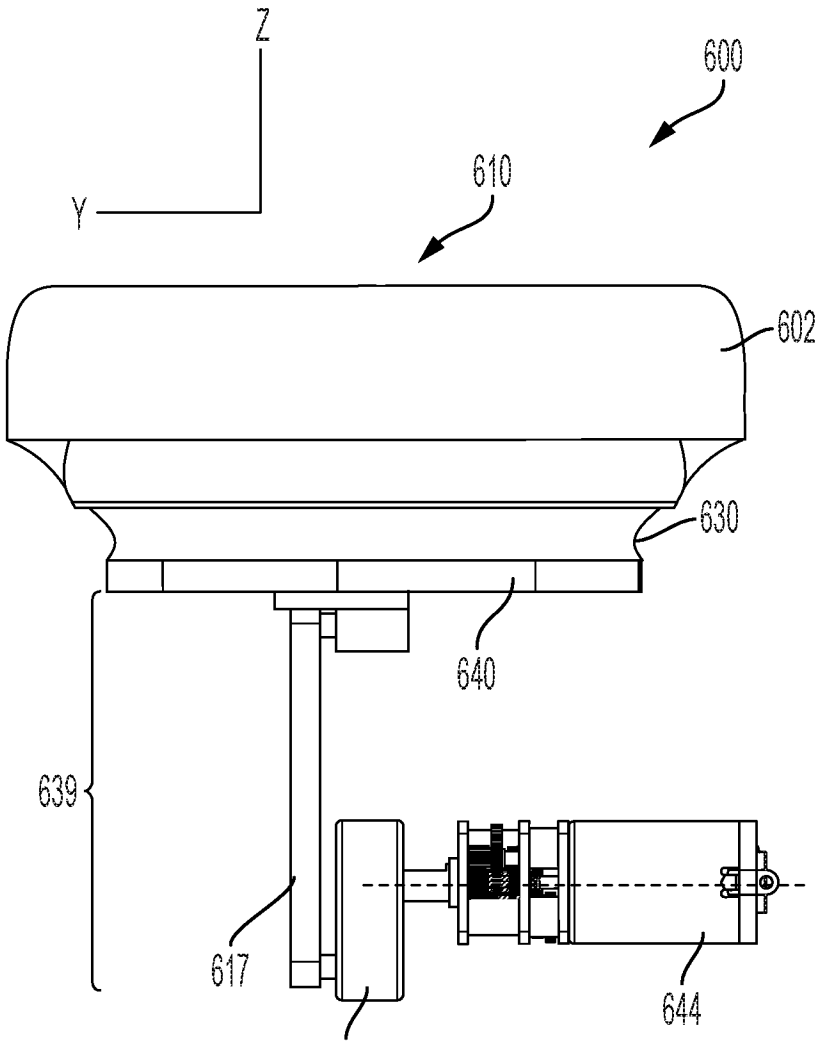
FIG. 6A shows a side view of an alternative driver and cup assembly.

FIG. 6A shows a side view of an alternative driver and cup assembly 600 at V1. FIG. 6B shows a front view of alternative driver and cup assembly 600 at V2 in a compressed position (note here in the non-limiting example that full compression is only partial). In other implementations, compression can be full compression. In the embodiment, the driver 639 comprises a plate 640 (disposed in contact with cup 602), a rod 617, a cam 650, and a motor 644. Various connection members are included such that rod 617 is rotatably connected to the plate 640 on a first end, and rotatably connected to cam 650 on a second end. Plate 640 is in contact with cup 602. During usage, a rim of the cup 602 is placed in contact with a user's skin to form a sealed, or substantially-sealed, chamber. The cavity has a first volume (V1) and the chamber has a first pressure (P1) (FIG. 5A). P1 is typically the gauge pressure having a reading of zero.

In FIG. 6A, the buckle region 630 is in default position. When powered on, the cam 650 is rotated by motor 644. As the cam 650 rotates up to 180 degrees in the direction as indicated by arrow 658 (FIG. 6B), the volume of the cavity 610 of the cup 602 is decreased to V2 (FIG. 5B), as the rod 617 is being pushed towards the cup 602, compressing the buckle region wall as shown in FIG. 6B. In FIG. 6B, the buckle region wall 630 is in compressed position. At V2, a second and maximum pressure (P2) is generated in the chamber. As the stimulation device continues to operate, the cam 650 is rotated, by the motor 644, up to 180 degrees back (still in direction 658) by pulling the rod 617 away from the cup 602 via the cam 650. This returns the cavity back to V1 and P1 in the position of FIG. 6A. Accordingly, in some embodiments, the cup is mechanically coupled to a motor such that the buckle portion of the cup is pushed inward toward the rim and pulled outward away from the rim in a 360 degree rotating cyclical motion. This variation of volume of the cavity is performed cyclically while the motor is activated, such that a pressure field is generated in a chamber formed by the cavity of the cup and a user's skin. In embodiments, such as this, where there is constant mechanical coupling of the driver to the cup (instead of intermittent non-contact like shown in FIGS. 3A-3D), a buckling region may not be included. Embodiments may utilize any of the cup shapes and/or cup features described herein, or now known or hereafter discovered. The pressure field consists of only pressure at or above a reference pressure.

Figure 7B:
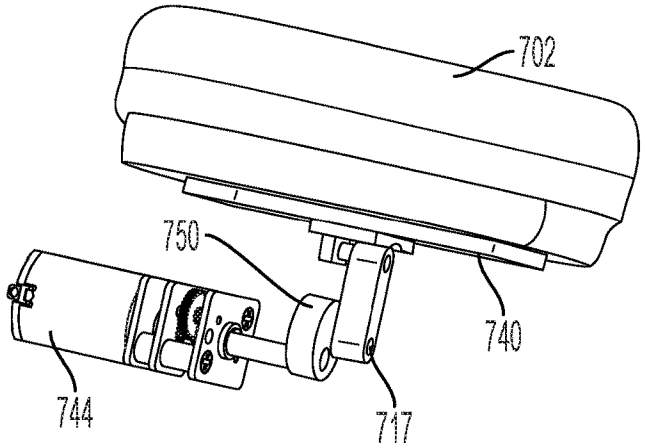
FIG. 7B shows details of the embodiment of FIG. 7A where the cup at V2.
Figure 7C:
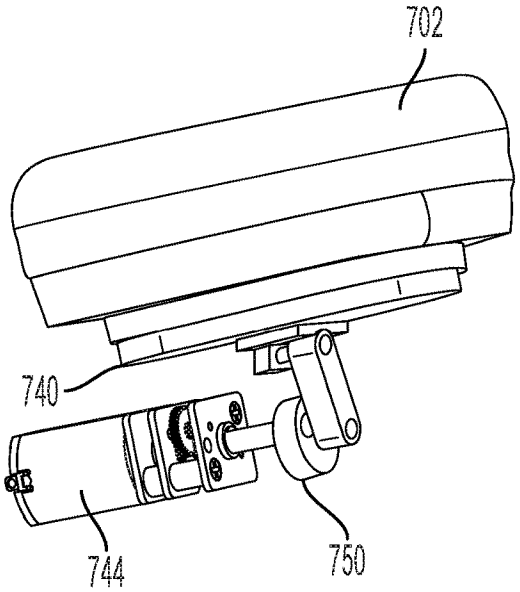
FIG. 7C shows details of the embodiment of FIG. 7A where the cup is at V1 in a position "mirroring" the position at FIG. 7A.
Figure 7A:
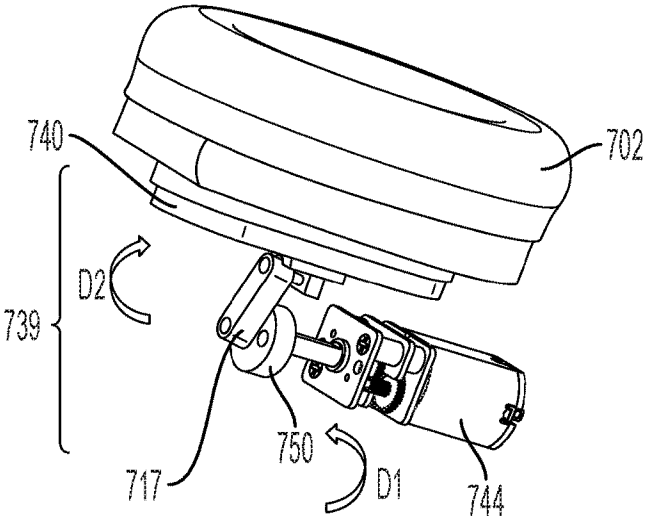
FIG. 7A show details of another embodiment where the cup at V1 is in a partially compressed position.

FIGS. 7A-7C show details of another embodiment where the cup at V1 is in a partially compressed (as opposed to default) position. FIG. 7A shows starting position. The driver comprises a motor 744, a rod 717, cam 750, and plate 740. Various connection members are included such that the rod 717 is rotatably connected to the cam 750 and the plate 740. In embodiments, an encoder is integrated into motor 744 to establish a home position. In embodiments, a processor utilizes the encoder to set the cam 750 such that the rod 717 is in the position as shown in FIG. 7A. The rod 717 is coupled to plate 740, which is mechanically coupled to cup 702. The processor, in conjunction with the encoder, ensures that the starting position is that shown in FIG. 7A. During use, user applies an opening of the cavity of the cup 702 against the clitoral region (or other region of the body s/he wishes to stimulate), and then activates the motor 744. The motor 744 oscillates between the position shown in FIG. 7A, and the position shown in FIG. 7C, with the position shown in FIG. 7B being a midway point. The position shown in FIG. 7A and that shown in FIG. 8C are equidistant from the midway point shown in FIG. 7B. The cavity is partially compressed in each of FIGS. 7A and 7C. In FIG. 7B, the rod 717 is at its highest position, pushing the plate 740 into the cup 702. The pushing of the plate 740 into the cup 702 compresses the cup to a minimum volume Vmin. In operation, the starting position shown in FIG. 7A represents V1, which is a maximum volume Vmax for an operational cycle. The motor 744 moves the cam in the direction shown by arrow D1 in FIG. 7A, continuing to the position shown in FIG. 7B (creating V2, which is Vmin), and then completing at the position shown in FIG. 7C (V1 again). The motor 74 then moves in the reverse direction as indicated by the arrow D2, and the cycle continues with the motor 744 moving back and forth between the position shown in FIG. 7A and the "mirror image" symmetrical position shown in FIG. 7C. Thus, FIG. 7A and FIG. 7C represent endpoints of the operational cycle. This variation of volume of the cavity is performed cyclically while the motor is activated, such that a pressure field is generated in a chamber formed by the cavity of the cup and a user's skin. The pressure field consists of only pressure at or above a reference pressure.

In some embodiments, the starting position is shown in FIG. 7C, with the position in FIG. 7A being the second position. The directions of D1 and D2 would be swapped in such embodiments.

Figure 8:
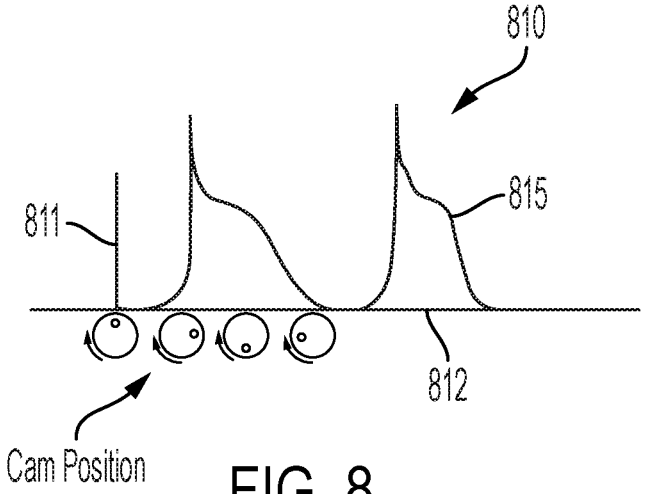
FIG. 8 shows is a time-pressure graph showing the time-pressure relationship of the cam of FIG. 3A-3D.

FIG. 8 shows is a time-pressure graph 810 showing the time-pressure relationship of the cam of FIGS. 3A-3D. Graph 810 comprises vertical axis 811 representing pressure, and horizontal axis 812 representing time. Zero on the vertical axis indicates gauge pressure at atmosphere. This is the ambient air pressure, at the geographic location that the user is using the stimulation device, that exists at the time the user uses the device. As the cam rotates, a time-pressure curve 815 is generated, indicating varying amounts of pressure that occur within the cavity during operation. Since, in the example, the varied volume of the cavity is never greater than the initial volume (V1) at start time, no pressure below the reference pressure (start pressure) is generated in the chamber.

Figure 9B:
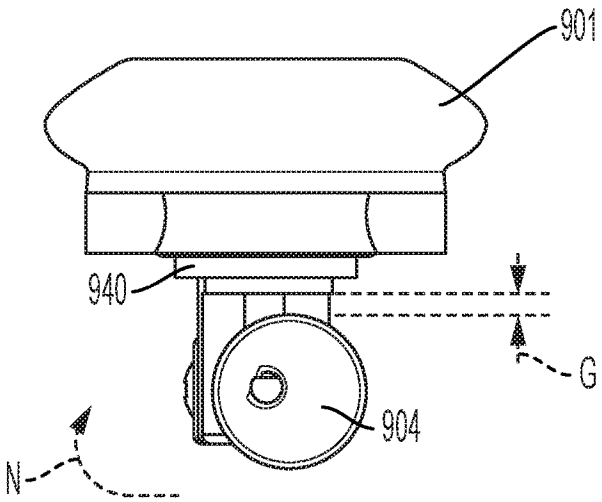
FIG. 9B shows the embodiment of FIG. 9A where the cam has rotated.
Figure 9C:
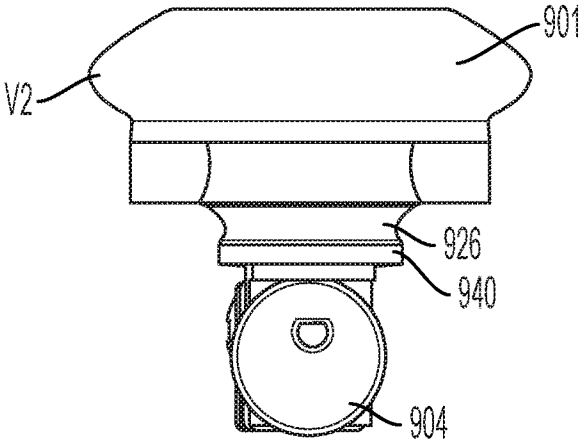
FIG. 9C shows the embodiment of FIG. 9B where the volume of the cup is V2.
Figure 9A:
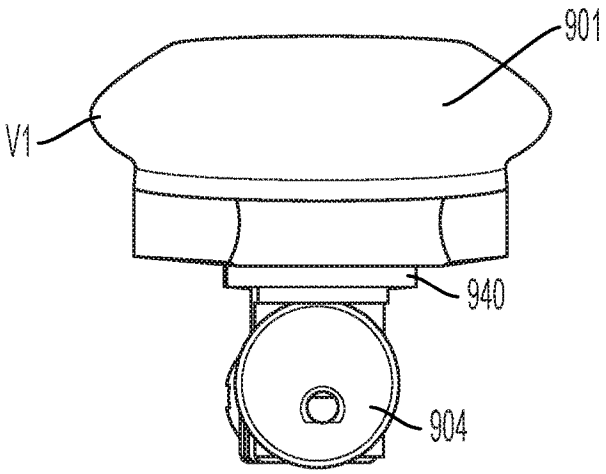
FIG. 9A shows an embodiment of the present invention, in accordance with another cycle, where the volume of the cup is at V1.

FIGS. 9A-9C show an alternative cycle for embodiments of the present invention. Note that cup 901 is substantially similar to cup 102, made of a resilient material and having a rim and a cavity. A plate 940 is connected to the bottom of the buckle region wall 926 cup 901. Components are the same as in FIGS. 2A-2D, except the cam is at a different position at start time. In the embodiment, the starting position at time t0 of the cup 901 is as shown in FIG. 9A, where cam 904 is in its highest position (turned to a point where that it provides maximum actuation so as to provide maximum or full compression of the cup). Buckle region 926 is in compressed position. Accordingly, the volume of the cavity of the cup 901 is Vmin (or minimum volume) having a pressure equal to gauge pressure. During use, the rim of the cavity of cup 901 is pressed against the clitoral region (or other region to be stimulated) of a user, creating a sealed or substantially sealed-chamber. At a later time t1, the cup 901 is in a position as shown in FIG. 9B. In FIG. 9B, the cam 904 has rotated in the direction indicated by arrow N, such that the cam 904 has rotated approximately 100 to 120 degrees from the starting position depicted in FIG. 9A. This causes a gap G to form between the cam 904 and the rigid plate 940. This gap G allows the buckle region to expand, increasing the volume in the cavity of cup 901, as illustrated in FIG. 9C. The expansion of the buckle region wall 926 induces negative pressure (as compared with gauge pressure) on the clitoral region of the user. In some embodiments, the cam may then continue rotation to restore the cup position to that shown in FIG. 9A. This variation of volume of the cavity is performed cyclically while the motor is activated, such that a pressure field is generated in a chamber formed by the cavity of the cup and a user's skin. Since, in the example, the varied volume of the cavity is never less than the initial volume (V1) at start time, no pressure above the reference pressure (start pressure) is generated in the chamber. Only pressure at or below the reference pressure is generated.

Figure 10:
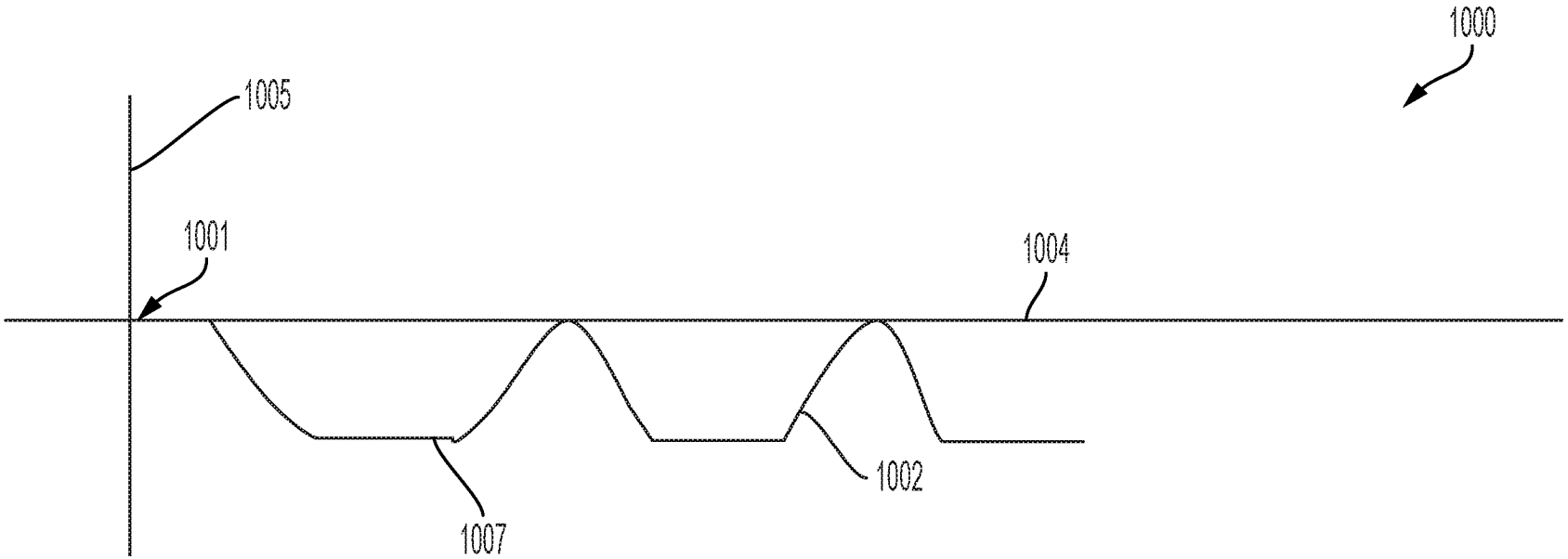
FIG. 10 shows a pressure curve over time graph for the embodiment shown in FIGS. 9A-9C.

FIG. 10 shows a pressure curve over time graph 1000 for the embodiment shown in FIGS. 9A-9C. Graph 1000 comprises vertical axis 1005 representing pressure, and horizontal axis 1004 representing time. Zero on the vertical axis indicates gauge pressure at atmosphere. Zero on the horizontal axis represents time T0. Pressure curve 1002 does not extend above the gauge pressure line 1004. From starting point 1001, the pressure gets more negative until point 1007, and then returns to the original pressure, and the cycle repeats. Note that the sine wave is disrupted, at points such as 1007, when the buckle region (130) springs out. Thus, in such embodiments, there is no positive pressure applied to the clitoral/stimulated region of the user's body.

Figure 11B:
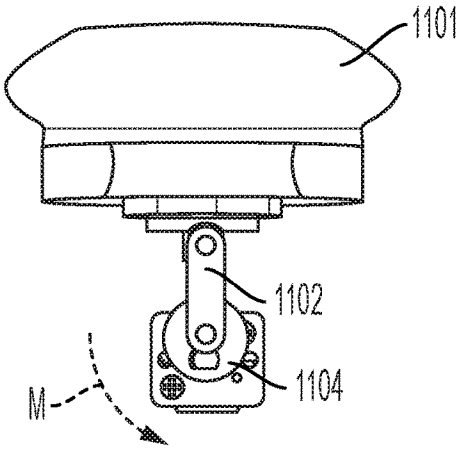
FIG. 11B shows the embodiment of FIG. 11A where the cam has rotated.
Figure 11C:
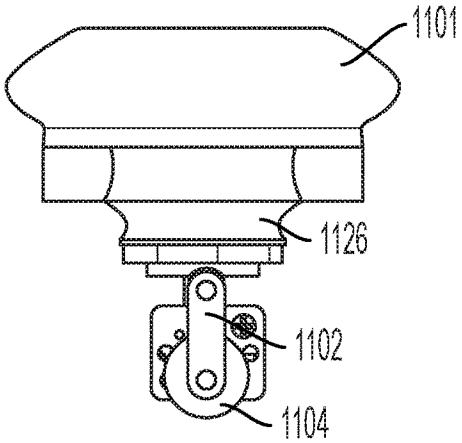
FIG. 11C shows the embodiment of FIG. 11A where the cam has rotated further from the point shown in FIG. 11B.
Figure 11A:
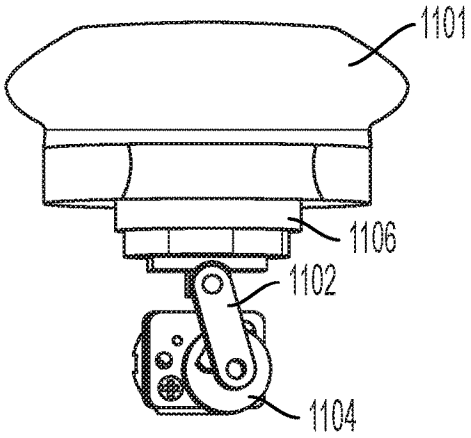
FIG. 11A shows an example apparatus and cycle for embodiments of the present invention utilizing both positive and negative pressure with respect to a reference pressure, at start time.

FIGS. 11A-11C show a cycle for embodiments of the present invention utilizing both positive and negative pressure with respect to a reference pressure. Note that cup 1101 is substantially similar to cup 102 or cup 702, made of a resilient material and having a rim and a cavity. In these embodiments, the starting position at time t0 of the cup 1101 is as shown in FIG. 11A, where the rod 1102 is in an intermediate position between the highest and lowest possible positions, due to orientation of the cam 1104. During use, the rim of the cavity of cup 1101 is pressed against the clitoral region (or other region to be stimulated) of a user, creating a sealed or substantially-sealed chamber. At a later time t1, the cup 1101 is in a position as shown in FIG. 11B. In FIG. 11B, the cam 1104 has rotated in the direction indicated by arrow M, such that the cam 1104 has rotated approximately 100 to 120 degrees from the starting position depicted in FIG. 11A such that the rod 1102 pushes the buckle region 1126, creating a minimal volume in the cavity of cup 1101, and causing a positive pressure (meaning above gauge pressure) in the cavity of cup 1101. The cam 1104 continues rotating to the position shown in FIG. 11C, where the buckle region 1126 is fully expanded. The volume in the cup 1101 is increased over the volume of the cavity of cup in FIG. 11A, thus creating a negative pressure (meaning below gauge pressure). Thus, the embodiment shown in FIGS. 11A-11C create both positive and negative pressure with respect to a reference pressure, which is gauge pressure at atmosphere.

Figure 12:
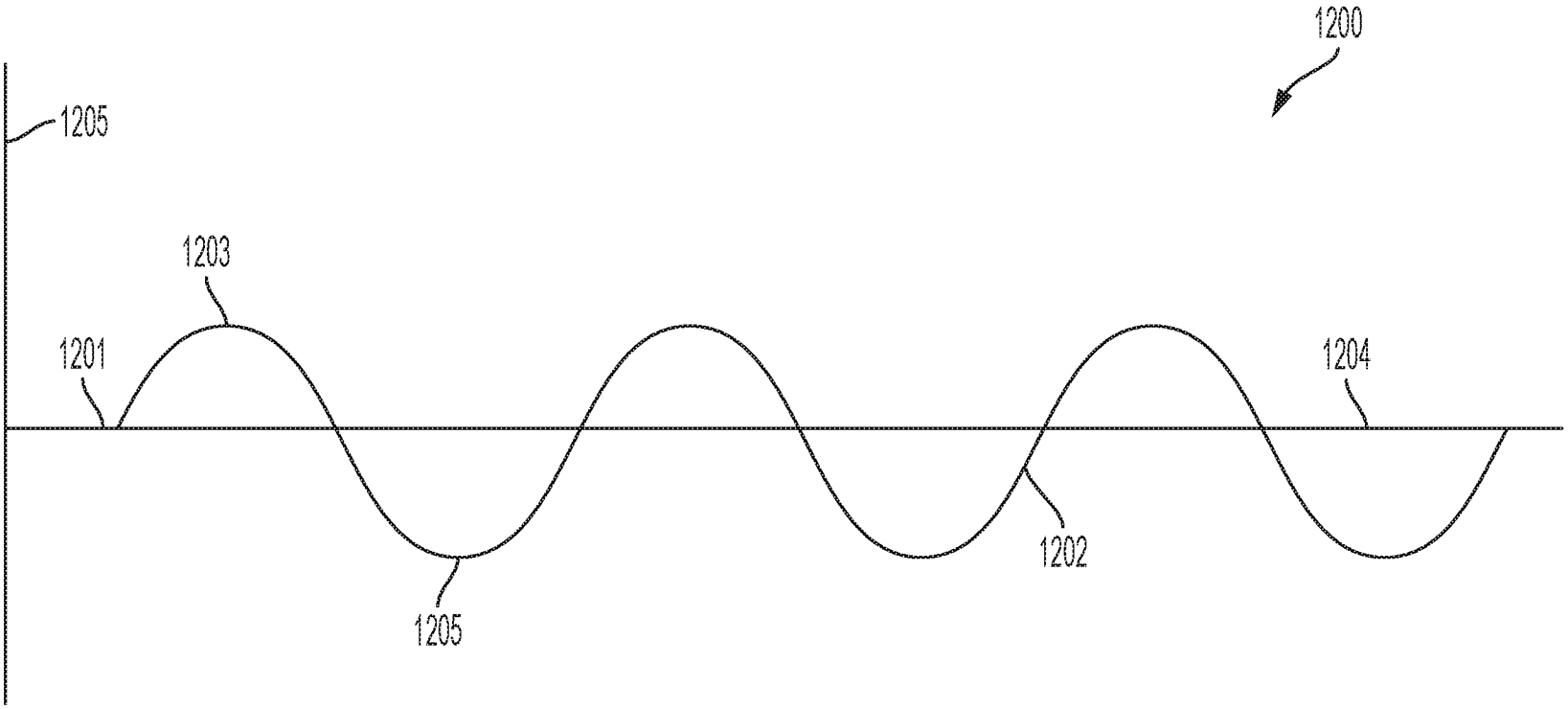
FIG. 12 shows a pressure curve for the embodiment shown in FIGS. 11A-11C.

FIG. 12 shows a pressure curve for the embodiment shown in FIGS. 11A-11C. Graph 1200 comprises vertical axis 1205 representing pressure, and horizontal axis 1204 representing time. Zero on the vertical axis indicates gauge pressure at atmosphere. Zero on the horizontal axis represents time zero (T0). Pressure curve 1202 starts at point 1201, and increases above the gauge pressure line 1204 up until point 1203. From point 1203, the pressure reduces and then becomes negative (with respect to gauge pressure) until point 1205. Then, the cycle repeats. Thus, in the embodiment of FIGS. 11A-11C, there is both positive pressure and negative pressure with respect to the reference pressure is generated in a chamber formed by a cavity and a user's skin.

Figure 13A:
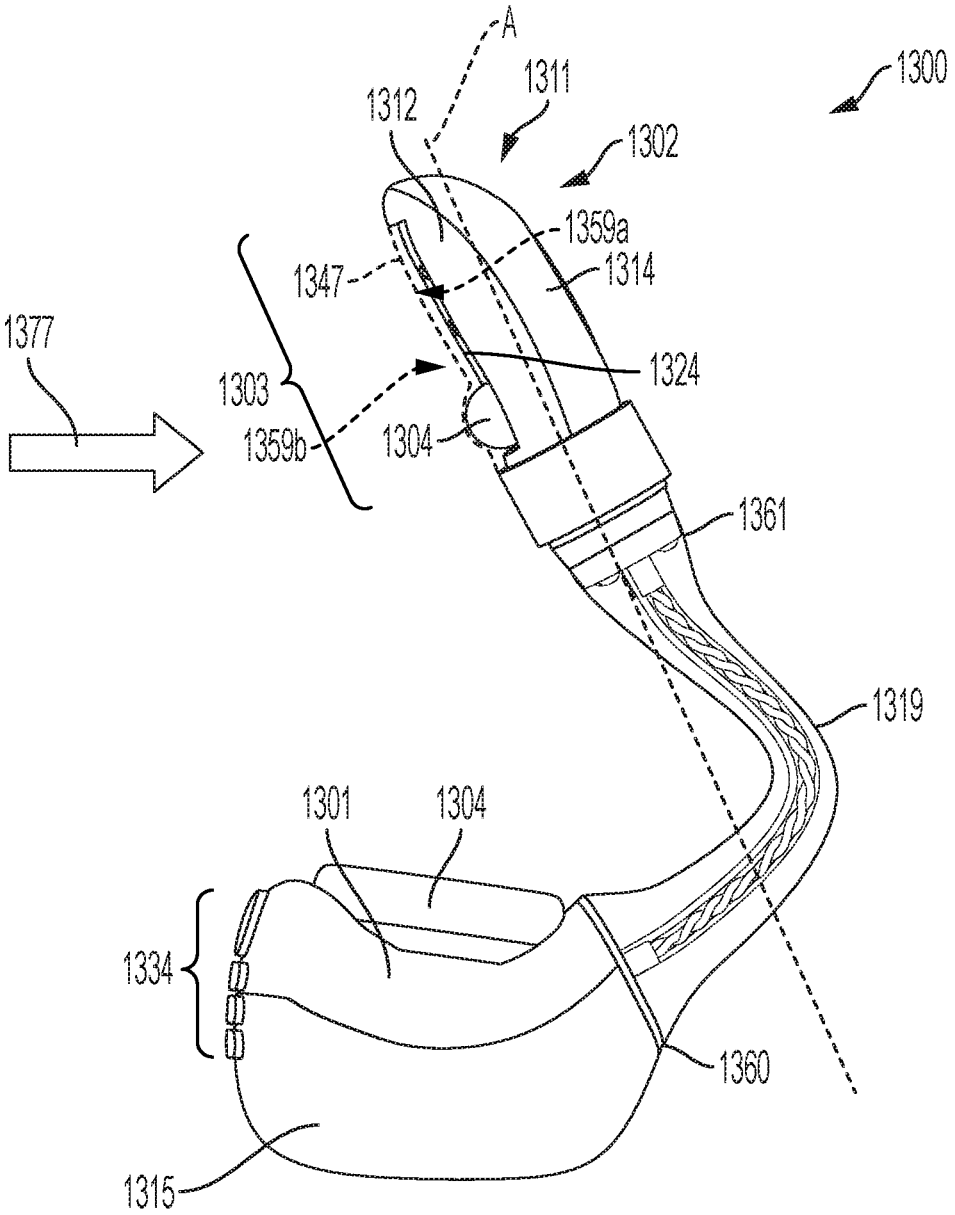
FIG. 13A shows an embodiment having a pressure field stimulator affixed to a first end of a flexible arm and a roller massager affixed to a second end of the flexible arm.

FIG. 13A shows an example device 1300 having a pressure field stimulator 1301 in a base 1315, having a cup 1304, affixed to a first end of an arm 1319. A second stimulator 1303 is shown affixed to the arm 1319 on a second end of the arm 1319. In some embodiments, the second stimulator 1303 is insertable into a vagina or rectum of a user. The second stimulator 1303 includes a roller 1304 disposed adjacent a flexible sheath (a portion of which is represented at 1347).

In some embodiments, the second stimulator includes an insertable shaft 1302. In some embodiments, the shaft 1302 includes a roller 1304 disposed on a threaded post (1310 of FIG. 13B) adjacent a flexible sheath (a portion thereof is represented at 1347). The sheath is tightly bound to the shaft 1302. Shaft 1302 may be, or include, enclosure 1311. The roller 1304 protrudes from the enclosure 1311 through an opening 1324 in the enclosure. The roller 1304 is disposed to traverse a path under sheath 1347, during usage. In embodiments, the roller 1304 is adjacent an interior side 1359*a* of the sheath 1347 and the massage surface is the exterior side 1359*b* of the sheath. The roller 1304 may roll over the interior side 1359*a* to reduce friction from otherwise rubbing. The enclosure, threaded post, and roller are sized such that, during operation, the roller remains within the opening of the enclosure, and does not travel around the threaded post in between the interior walls of the enclosure.

In the example shown, the enclosure 1311 has an enclosure first portion 1314 and an enclosure second portion 1312. Although depicted as two portions, in some embodiments, the enclosure may comprise only a single one-piece contiguous portion or more than two portions. In embodiments, the enclosure is substantially rigid, made from plastic, metal, glass, or other suitable material.

In some embodiments, the enclosure 1311 is made from plastic, silicone, hard rubber, composite, metal or other suitable material. In some embodiments, the roller 1304 is made from plastic, silicone, hard rubber, composite, metal or other suitable material. In some embodiments, the threaded post 1310 is made from plastic, silicone, hard rubber, composite, metal or other suitable material.

A massage surface represented at 1359*b*, of a sheath represented at 1347, is disposed over the opening 1324 such that roller 1304 can impart stimulation from the massager device 1300 to a user's body. In some embodiments, the sheath may additionally extend over portions of the massage device other than only the opening. In embodiments, the sheath 1347 is comprised of silicone, rubber, plastic, or other suitable flexible elastic material such that the roller 1304 can protrude and extend the material outward. As the position of the roller 1304 changes, the material the roller is not currently pressing against may return to its original position.

User interface 1334 is represented as four buttons. A user may power on and off the device, as well as set parameters of usage, such as speed of the shaft motor 1355 of FIG. 13E (and therefore, the roller motion), or functionality of the pressure field stimulator, from the user interface. In some embodiments, the user interface may be on the shaft 1302. In some embodiments the device may be controlled via a user interface on a remote controller.

Figure 13D:
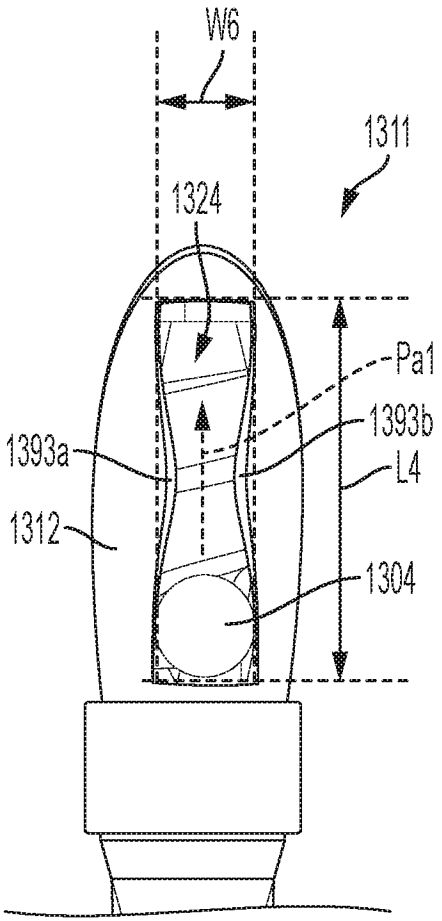
FIG. 13D is a front view of the roller massager of FIG. 13A in accordance with embodiments of the present invention showing detail of the enclosure upper portion.
Figure 13C:
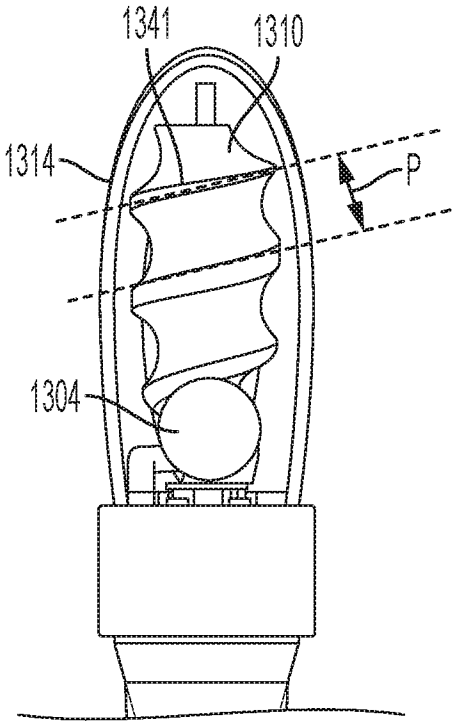
FIG. 13C is a front view showing detail of the roller massager of FIG. 13A.
Figure 13B:
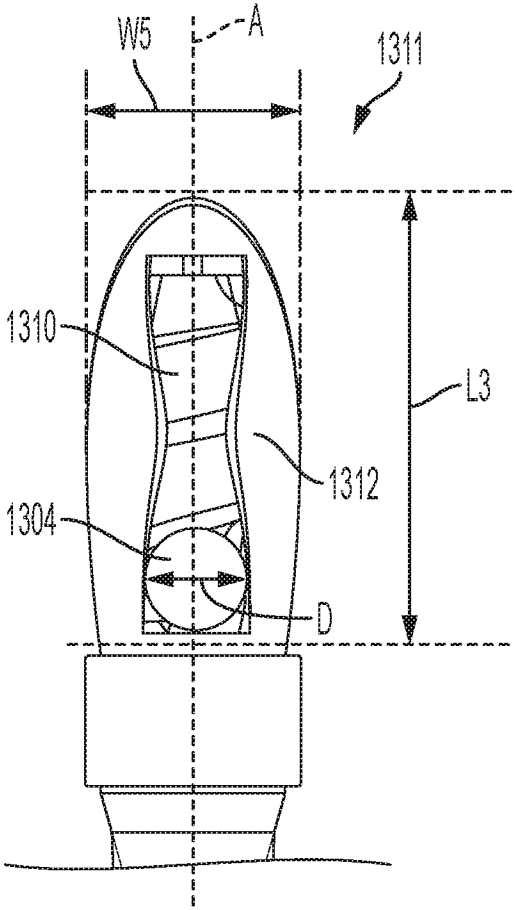
FIG. 13B is a front view showing details of an example roller massager of FIG. 13A.

FIG. 13B is a front view showing detail of the insertable stimulator in accordance with embodiments of the present invention as viewed from the direction of arrow 1377 of FIG. 13A. In some embodiments, the roller 1304 is spherical or other suitable shape. The roller 1304 has a width D. In some embodiments, D ranges from 12 millimeters to 30 millimeters. In some embodiments, D ranges from 19 millimeters to 24 millimeters. In some embodiments, the enclosure 1311 may be an elongate shape having a length L3, and a width W5, where L3 is greater than W5. In some embodiments, L3 has a value in the range from 8 centimeters to 17 centimeters, and W5 has a value in the range from 3 centimeters to 7 centimeters. In some embodiments, roller 104 is disposed to traverse a path, along or in alignment with, longitudinal axis A of the elongate shape of the enclosure. In some embodiments, roller 1304 is disposed to traverse a path, substantially along or in alignment with, the elongate shape of the enclosure 1311. This creates a "come hither" like motion with the roller 104 moving back and forth along a length of the enclosure 1311, imitating movement of a finger.

FIG. 13C is a front view showing detail of the insertable stimulator of FIG. 13A in accordance with embodiments of the present invention with the enclosure upper portion removed to illustrate additional parts. In this view, the threaded post 1310 is shown. The threaded post has threads, an example of which is pointed out at 1341. The threads are a protrusion that extend around the elongate core of the threaded post like a screw. The threads have a pitch P. The pitch P corresponds to the width D of the roller 1304. The roller 1304 is disposed within the plurality of threads. During operation, as the threaded post rotates in an alternating clockwise and counterclockwise motion (or vis versa), the spherical roller 1304 moves along the threaded post to perform a massage stimulation function. The roller 1304 is shown as a sphere, but it can be any suitable shape.

FIG. 13D is a front view of a portion of a massager device in accordance with embodiments of the present invention showing detail of the enclosure portion 1312 without a sheath thereon. The enclosure portion 1312 has an opening 1324 which allows the roller 1304 to protrude outside of the enclosure 1311. In embodiments, the elastic sheath presses the roller 1304 firmly against the threaded post 1310, keeping the roller 1304 disposed within the threads 1341. The opening 1324 of the enclosure 1311 serves as a guide for the roller 1304. The opening 1324 has rails, indicated as 1393*a* and 1393*b*, disposed along two sides of a longitudinal axis of the threaded post with the roller 1304 disposed therein between.

As the threaded post 1310 rotates, the roller 1304 travels along path Pa1 within the length L4 of the opening, which is defined by the rails of opening 1324. In embodiments, the roller travels along a linear path. In some embodiments, the opening 1324 is of a size such that its maximum width W6 is less than the width D of the roller 1304 such that the roller 1304 may protrude without being able to completely pass through opening 1324.

Figure 13F:
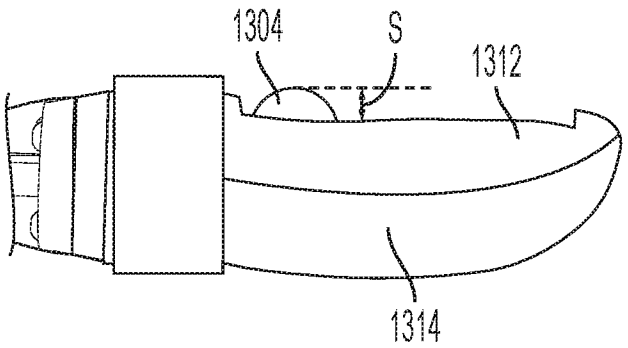
FIG. 13F is a side view showing additional detail of the roller massager of FIG. 13A in accordance with embodiments of the present invention.
Figure 13E:
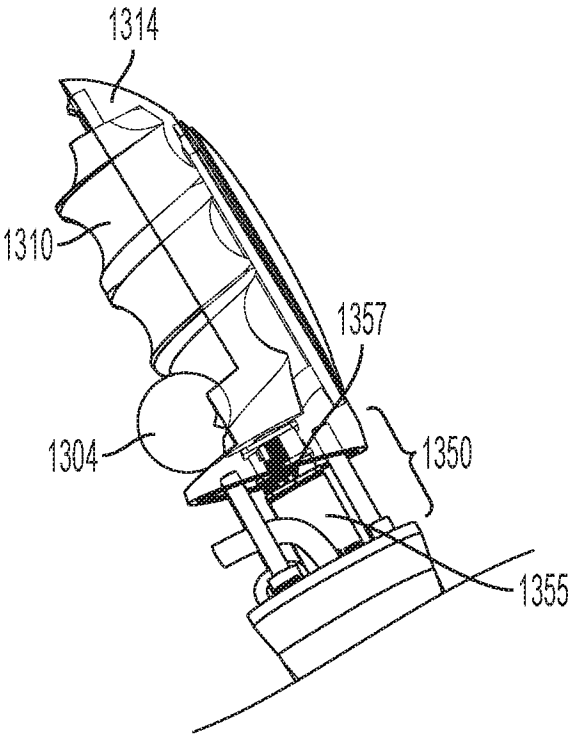
FIG. 13E is a view showing additional details of the roller massager of FIG. 13A in accordance with embodiments of the present invention.

FIG. 13E is a view showing additional details of the insertable stimulator of FIG. 13A in accordance with embodiments of the present invention. In this view, the enclosure is removed to show details of an example driver 1350. The driver 1350 has a motor 1355 and an encoder 1357. The driver 1350 includes the motor, encoder, as well as additional mechanical coupling such as shafts, gears, and/or other components for coupling the threaded post to the motor. The motor 1355 is an electric motor that operates in a reciprocating manner to alternate between clockwise and counterclockwise (or vis versa) rotation. The encoder 1357, or other suitable mechanism, may be used for tracking the position of the threaded post 1310 relative to an initial "home" position. In some embodiments, the encoder 1357 may be integrated into the motor 1355.

FIG. 13F is a side view showing detail of the insertable stimulator of FIG. 13A in accordance with embodiments of the present invention. In this view, it can be seen that the roller 1304 protrudes outside of the enclosure by a protrusion length S. In some embodiments, the protrusion length S has a value ranging from 8 millimeters to 16 millimeters. In some embodiments, the value may be outside of such example range within the scope of the present invention.

Figure 13G:
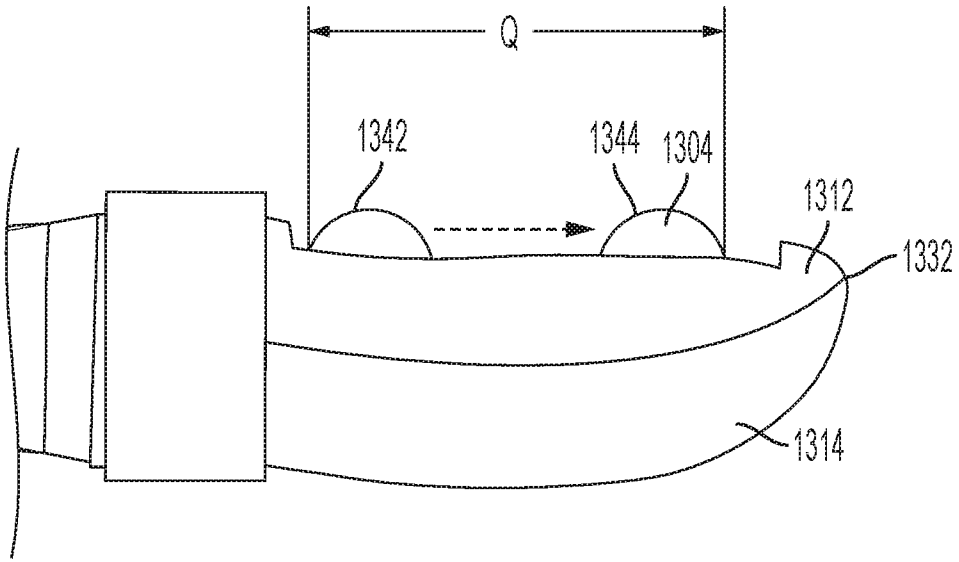
FIG. 13G is a side view showing detail of the roller massager of FIG. 13A with start range and end range positions depicted in accordance with some embodiments of the present invention.

FIG. 13G is a side view showing detail of the insertable stimulator of FIG. 13A with start range and end range positions depicted in accordance with some embodiments of the present invention. In some embodiments, a first position 1342 is a starting range position, and a second position 1344 is the end range position. In some embodiments, the first position 1342 is an end range position, and the second position 1244 is the start range position. By controlling the amount of rotation of the threaded post, the roller 1304 can be made to alternate between the first position 1342 and the second position 1344, or any intermediate locations between those two positions. As shown, the path Q of the roller 1304 traverses a longitudinal axis of the elongate shape of the enclosure 1311 A user may enter the settings for the start range position and/or the end range position via user interface 1334, or via a remote controller.

Referring now again also to FIG. 13D, the opening 1324 of the enclosure 1311 serves as a guide for the roller 1304. The opening 1324 has rails, indicated as 1393*a* and 1393*b*, disposed along two sides of a longitudinal axis of the threaded post with the roller 104 disposed therein between. As the threaded post 1310 rotates, the roller 1304 travels along a path, which is defined by the rails 1393*a* and 1393*b* of opening 1324. In some embodiments, the roller travels along a linear path.

Figure 13H:
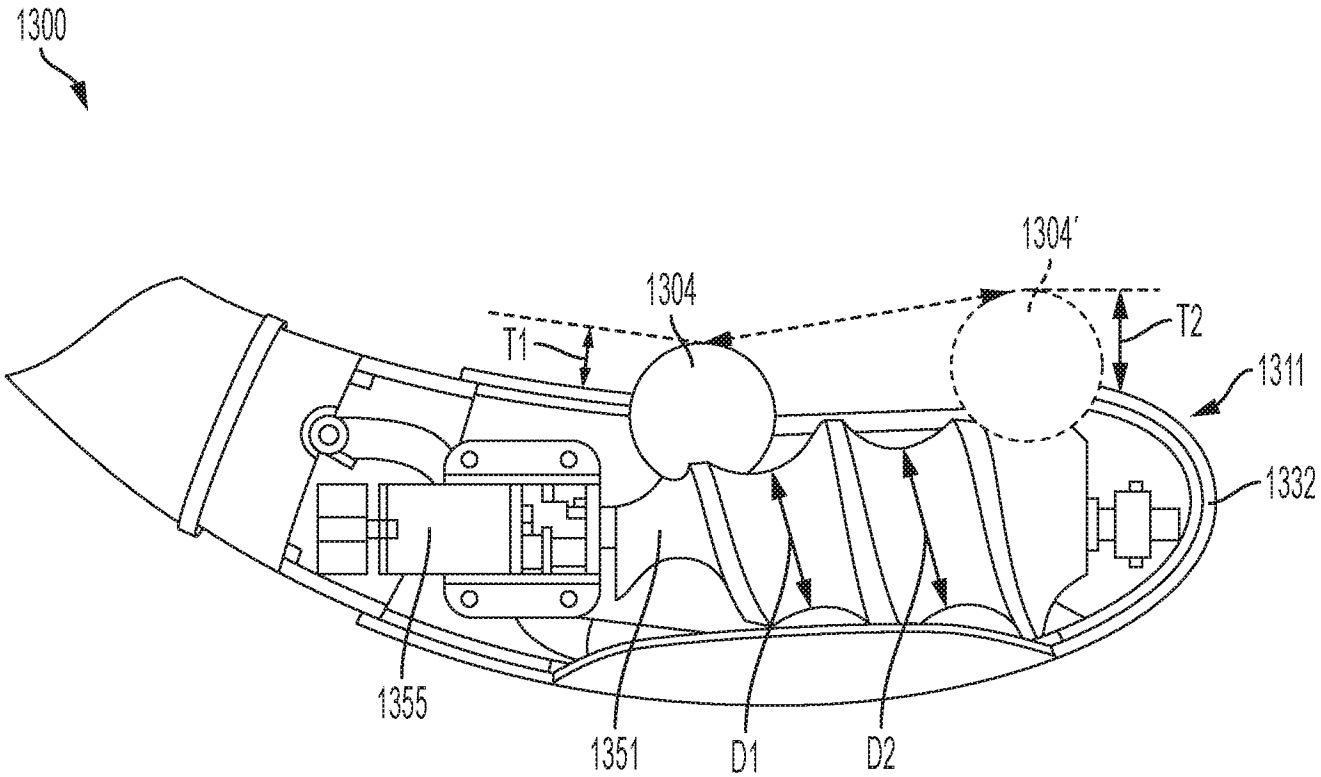
FIG. 13H shows a view of a portion of the roller massager of FIG. 13A having a tapered threaded post.

FIG. 13H shows a view of a stimulator having the tapered threaded post, with external sheath removed for clarity. The tapered threaded post 1351 has an increasing diameter in the direction towards the enclosure tip 1332. In FIG. 3, two diameters are indicated, D1 and D2, where D2 is greater than D1. In embodiments, the diameter of the tapered threaded post may gradually increase over the length of the tapered threaded post. In some embodiments, the tapered threaded post has a minimum diameter ranging from 1 centimeter to 1.5 centimeters, and a maximum diameter of 2 centimeters to 3 centimeters. These values are examples, and any suitable values may be included within the scope of the invention.

During operation, the motor 1355 alternates directions periodically to rotate the threaded post 251 in a clockwise direction for a predetermined duration, followed by a counterclockwise direction for a predetermined duration (or vis versa). This causes the spherical roller 104 to move back and forth between the location indicated by 1304 and 1304'. As the spherical roller 104 moves back and forth, the protrusion length changes. The protrusion length is the length that the spherical roller 1304 extends beyond the enclosure. At the position indicated by 104, the spherical roller has a protrusion length T1. At the position indicated by 104', the spherical roller has a protrusion length T2. In this embodiment, T2 is greater than T1. This is due to the tapered threaded post 251 being disposed to lower the roller at the position indicated by 1304, as compared to the position indicated by 1304'. In embodiments, the position indicated at 1304 is a home position for the roller. When the device is powered off, the motor 1355 operates to return the roller to the position indicated as 1304. A home position is an initialization position that may be used as part of a power-on sequence. During a power-on sequence, the device may first be brought to its home position. In some embodiments, during a power-off sequence, the device may be returned to its home position. This can serve to minimize stretching of an elastic sheath that is disposed over the stimulator when the device is not in use, thereby prolonging the life of the device. In embodiments, a processor executes instructions in memory to perform a homing operation prior to shutdown of the device. The homing operation returns the roller to the position indicates as 104 based on encoder input, limit switches, or other suitable position indicating mechanisms and/or techniques.

In some embodiments, the tapered threaded post 1351 may be installed in a reverse orientation, such that diameter D1 is greater than diameter D2, and thus, protrusion length T1 is greater than protrusion length T2. The increased protrusion length causes the spherical roller 1304 to press harder against the G-spot or prostate area during use. Thus, in the embodiment shown, the applied force of the spherical roller 104 increases as the spherical roller 1304 advances towards the enclosure tip 1332. In other embodiments, where the threaded post 1351 is installed in the reverse orientation, the applied force of the spherical roller 1304 decreases as the spherical roller 104 advances towards the enclosure tip 1332.

Figure 14B:
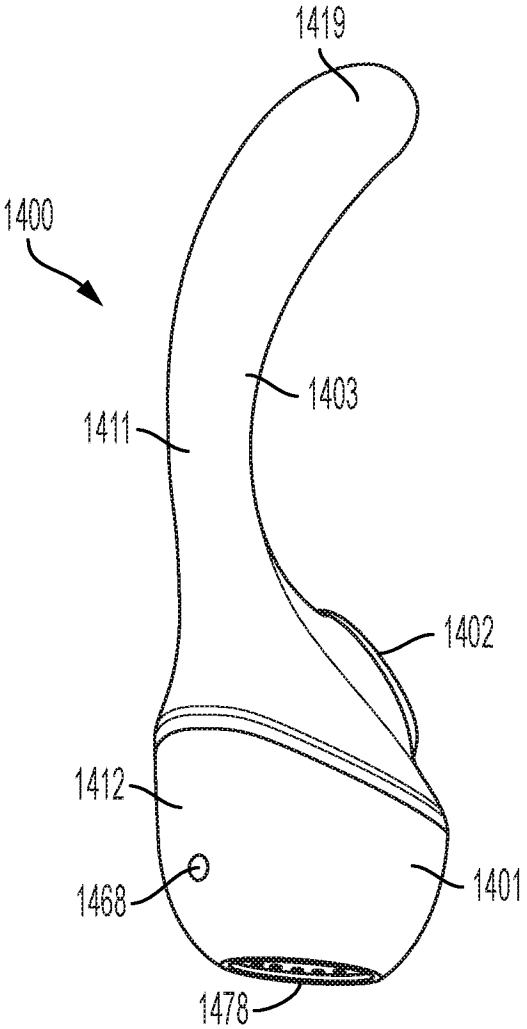
FIG. 14B shows a rear perspective view of the device of FIG. 14A.
Figure 14A:
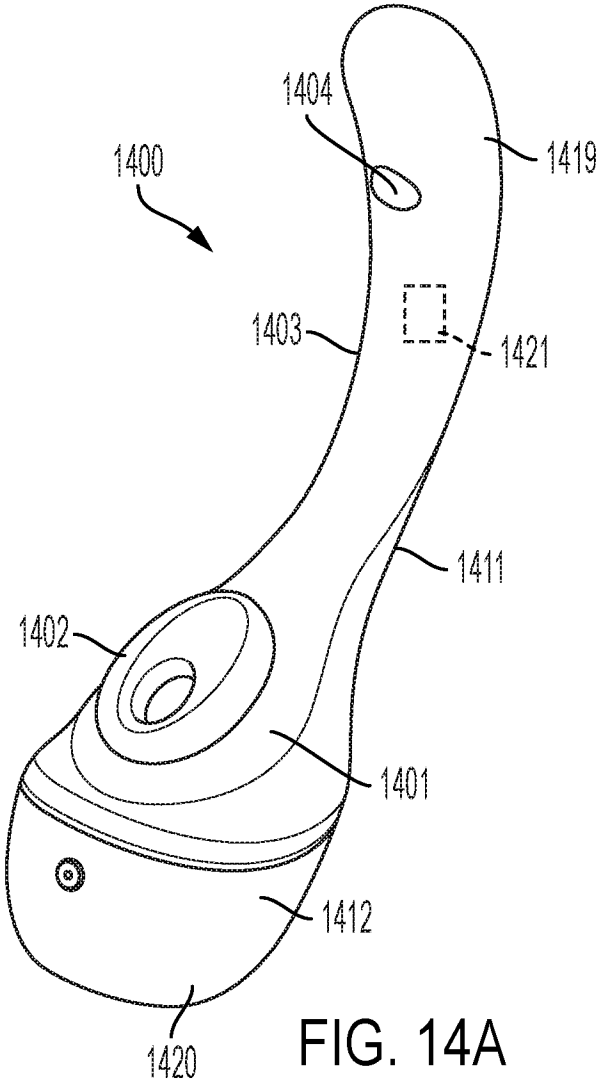
FIG. 14A shows a front perspective view of a stimulation device in accordance with some embodiments of the present invention.

FIG. 14A shows a front perspective view of a stimulation device 1400 in accordance with some embodiments of the present invention. FIG. 14B shows a back perspective view of a stimulation device 1400 in accordance with alternative embodiments of the present invention. In embodiments, the device 1400 has a shaft 1419 and base 1412 having a pressure field stimulator with cup 1402. The pressure field stimulator 1401 has a cup 1402 and driver components (installed within housing 1420). The shaft 1419 and a portion of the base 1412 may be covered in a sheath 1403 such as silicone, TPE, or other suitable material. It is preferable that the material be non-permeable. Shaft 1419 may be adapted for insertion into a vagina or rectum of a user. In some embodiments, shaft 1419 is an elongate shape. Note that in some embodiments, the shaft 1419 may instead be a handle for a user to manually manipulate the device. A shaft or handle of any suitable shape is included within the scope of embodiments of the invention. In some embodiments, housing 1420 and shaft 1419 is made from plastic, metal, or other suitable (preferably non-porous) material. Sheath 1403 may extend over housing 1420. In FIG. 14B, charging port 1468 and user interface 1478 are in view.

Roller 1404 is shown protruding under sheath 1403 on shaft 1419. The insertable shaft 1419 may include additional or alternative stimulation devices, including one or more of a vibrator, oscillator, gyrator, pulsator, and/or other massager, represented generally as 1421. Some embodiments provide simultaneous clitoral and G-spot stimulation. Some embodiments provide simultaneous clitoral and prostate stimulation. In some embodiments, the shaft 1419 and base 1412 may be connected to one another in a fixed position. In other embodiments, the shaft and base may be connected via a flexible arm.

Figure 15B:
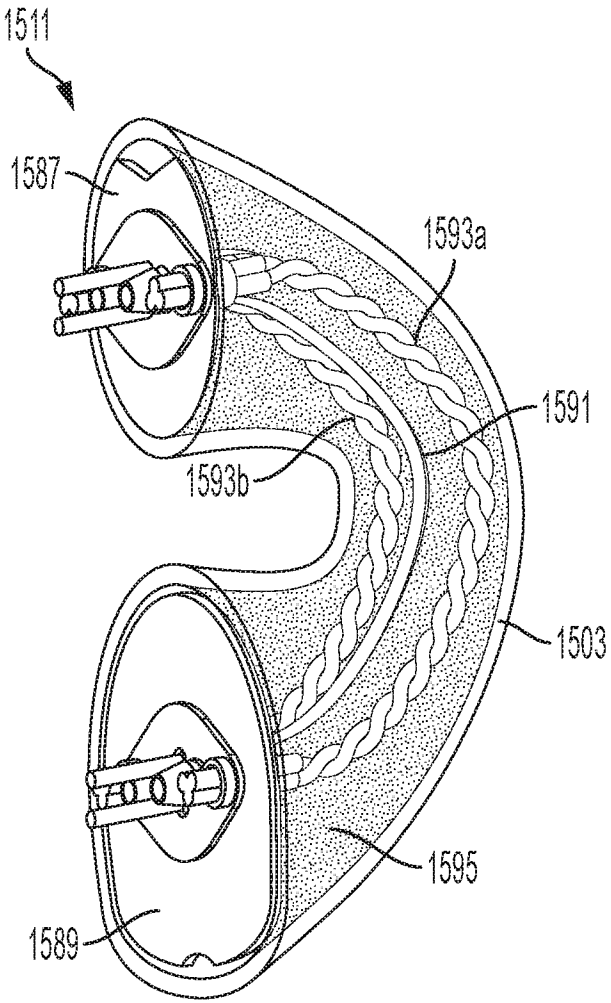
FIG. 15B shows the arm of FIG. 15A with the silicone layer and outer sheath thereon.
Figure 15A:
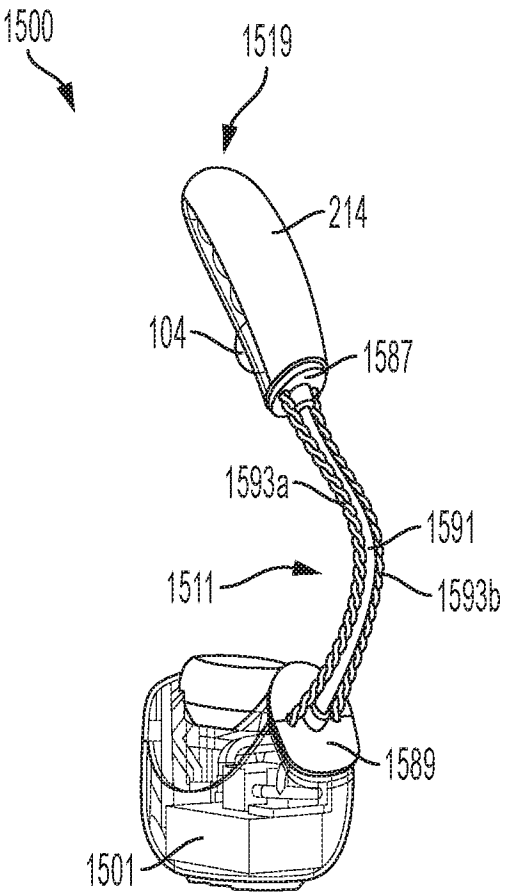
FIG. 15A shows an embodiment of the invention wherein the shaft and base are connected via a flexible arm, without a silicone layer and out sheath thereon for clarity.

FIGS. 15A and 15B show an embodiment of the invention wherein the shaft and base are connected via a flexible arm. FIG. 15A shows an embodiment similar to FIGS. 14A and 14B. In FIG. 15A, the flexible material fill layer 1595 (shown in FIG. 15D) and sheath (outer layer) 1503 removed from the arm for clarity. FIG. 15B shows arm 1511 with flexible material fill layer 1595 present in between endplates 1597 and 1589. Flexible material fill layer may be silicone or other suitable material. Arm 1511 allows the user to adjust distance and/or angle between the cup 1502 and the arm 1511, and the cup 1502 and shaft 1519, when present. The adjustable arm 1511 may be comprised of a flexible metal with silicone or another suitable flexible material there around. The arm is bendable such that it will hold its shape when bent. As shown, arm 1511 has a core, which may be elongate flexible members 1593*a* and 1593*b*, each comprising two wires twisted around one another. Electrical wires or other conduits, referred to generally as 1591 may be embedded within flexible material layer 1595. Layer 1595 may have a shore durometer of Shore A1 and Shore A2, and sheath 1503 may have a shore durometer of between Shore A1 and Shore D40. A first end plate 1589 is an interface with pressure field stimulator 1501, and a second end plate 1587 is an interface with shaft (such as the enclosure portion). Electrical wires/conduits 1591 may be disposed to extend through holes in the end plates 1587 and 1589. Endplate 1587 and endplate 1589 may be made of metal, plastic, or other suitable material. In some embodiments, the endplates 1587 and 1589 may not be present.

Embodiments of the arm not limited to the components shown herein. In some embodiments, more than two flexible members may be includes. In some embodiments, only one flexible member may be included. In some embodiments, flexible member may each include only a single wire, or more than two twisted wires.

Figure 16:
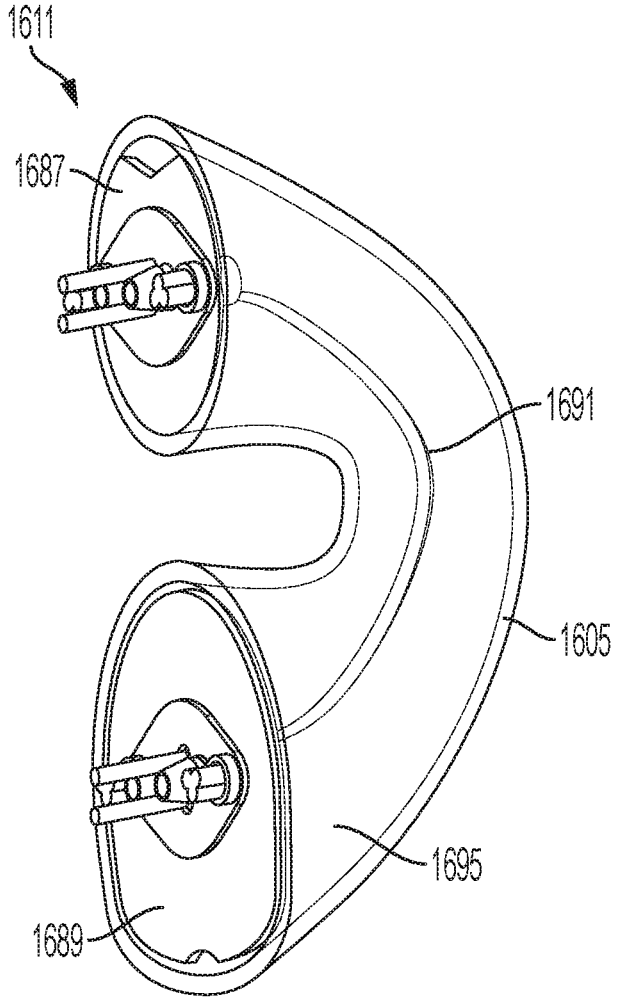
FIG. 16 shows an example of an arm which is not adjustable.

FIG. 16 shows an example of an arm 1611 which is not adjustable. Arm 1611 includes a rigid or substantially rigid frame 1613. Housing 1605 may be made from metal, plastic, glass, or other suitable material. Housing may have a hollow interior 1695. A first plate 1687 is an interface with a shaft and a second plate 1689 is an interface with a pressure field stimulator. Electrical wires/conduits 1691 may be disposed to extend through fill layer 1595 and holes in the end plates 1687 and 1689. Plate 1687 and plate 1689 may be made of metal, plastic, or other suitable material. In some embodiments, the plates 1687 and 1689 may not be present.

Figure 17:
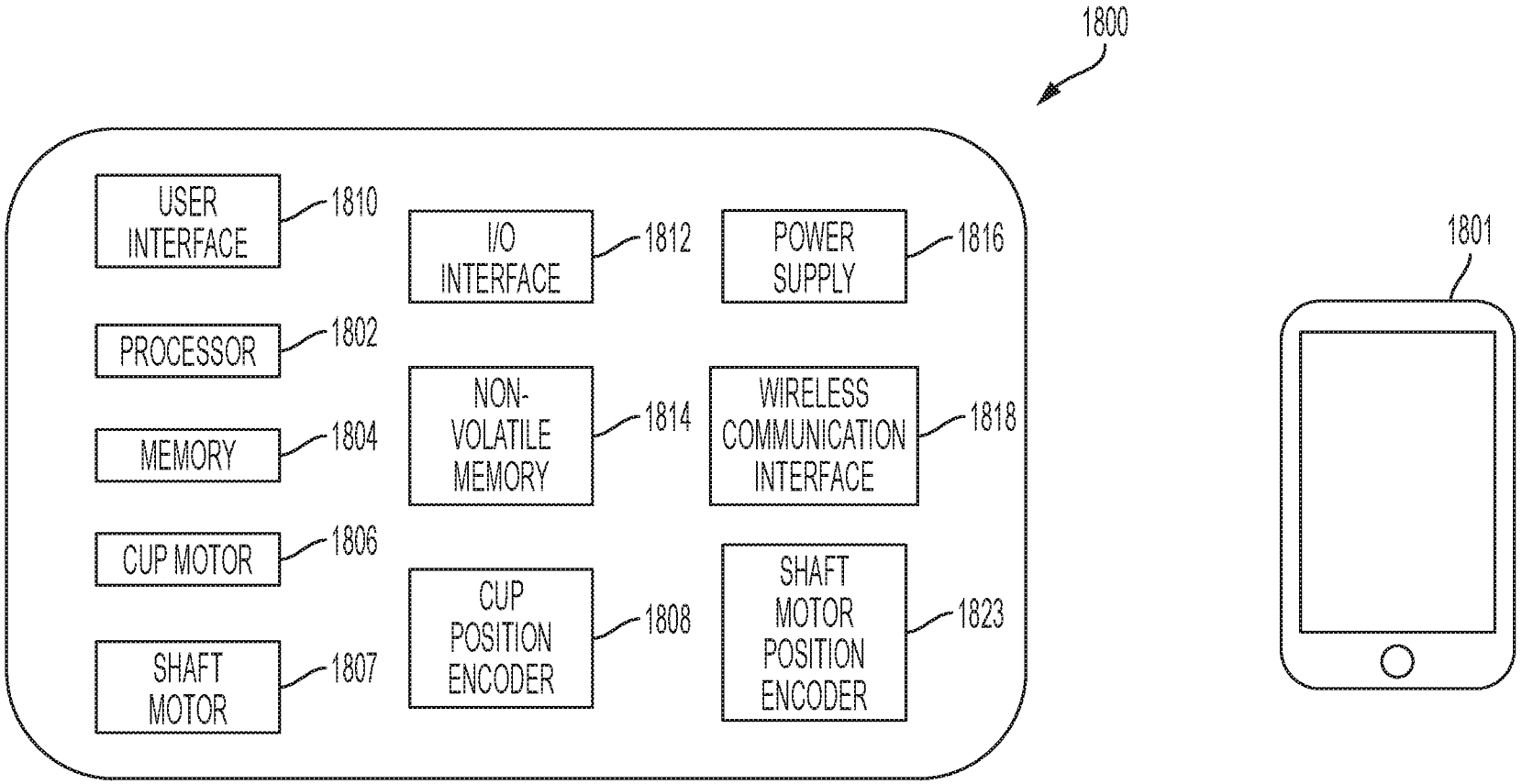
FIG. 17 is a block diagram of an embodiment of a stimulation device of the present invention.

FIG. 17 is a block diagram 1800 of an embodiment of a stimulation device of the present invention. The stimulation device includes a processor 1802 and memory 1804. Memory 1804 may be a computer-readable medium such as flash, battery-backed static RAM, or other suitable computer-readable medium. In some embodiments, the memory may be non-transitory. The memory 1804 contains instructions, that when executed by the processor 1802, perform steps in accordance with embodiments of the present invention.

The stimulation device may include an onboard input/output interface 1812. This may include one or more input, output, and/or bidirectional pins for control of the stimulation device. User interface 1810 may include one or more buttons, switches, knobs, or other suitable controls disposed on the stimulation device. The buttons may be configured to create a signal on one or more input pins of the I/O interface 1812. The processor may utilize interrupt service routines or monitoring loops to detect button presses and change the operation of the cup motor 1806 accordingly. A position encoder 1808 may be internal to the cup motor 1806, or external to the cup motor 1806, in some embodiments. In an alternative embodiment current peaks and valleys may be used to control the position of the motor.

User interface may include a power on/off and one or more buttons, or a slider to vary the speed of the cam. A user may modify the strength of the pressure field via user input. Various settings are associated with corresponding speeds of the driver (e.g., rotations per minute of the cam). Accordingly, a user may choose that the stimulation device generate greater or lower pressure for their comfort level. The higher the speed, generally, the more intense the stimulation. The stimulation device may include non-volatile memory 1814 for storing user settings.

In some embodiments, instead of or in addition to an onboard user interface 1810, the stimulation device may include a wireless communication interface 1818. The wireless communication interface 1818 may include a Bluetooth®, WiFi, or other suitable interface. The wireless communication interface allows pairing with an electronic device 1801 such as a dedicated remote controller, smartphone, tablet computer, or other electronic device. In some embodiments, the electronic device enables a rich user interface display, allowing for more complex programming options. Wireless communication interface 1818 may be in communication with a transceiver in the electronic device 1801. The stimulation device may be controlled by the user via an application on the smartphone or computer. Some embodiments may not have all of the aforementioned components.

The stimulation device further includes a power source 1816. In embodiments, the power source 1816 can include a battery. Battery 1816 may be a replaceable, or internally sealed rechargeable battery. In some embodiments, battery may be USB-chargeable, inductively chargeable, or other suitable charging mechanism now known or hereafter developed. It should be recognized that any power source, now known or hereafter developed, may be used. More than one battery may be included in some embodiments. In some embodiments, the stimulation device may be powered by alternating current power, such as 120V or 240V standard household power, with a power adapter comprising voltage regulators to convert the power to an appropriate DC level (e.g. 12V DC).

Shaft motor 1807 may be similar to motor 1355 for causing a roller 1355 to traverse a path of a stimulator as shown in FIG. 13G. A position encoder 1823 (or other suitable control) may be internal to the motor 1807, or external to the motor 1807. It will be recognized that any suitable stimulation mechanism now known or hereafter developed may be substituted for, or used in addition to, the examples disclosed herein without departing from the scope and purpose of the present invention.

Referring still to FIG. 17, in accordance with some example embodiments herein, in some embodiments, the memory 1804 contains instructions, that when executed by the processor 1802, that cause the driver (including motor 1806) to vary the volume of a cavity of a cup by intermittently decreasing a volume of the cavity of the cup from a first volume to a second volume. In some embodiments, the memory 1804 contains instructions, that when executed by the processor 1802, cause the driver (including motor 1806) to decrease a volume of the cavity of the cup from a first volume to a second volume, and increase the volume of the cavity of the cup from the second volume to the first volume, wherein the first volume is a maximum volume. In embodiments, the memory 1804 contains instructions, that when executed by the processor 1802, alternate motion direction of the shaft motor 1807 such that the spherical roller oscillates between the start range position and the end range position. In some embodiments, the memory 1804 contains instructions, that when executed by the processor 1802, establish a second start range position and a second end range position, wherein the second start range position and second end range position define a second range. In some embodiments, the memory 1804 contains instructions, that when executed by the processor 1802, establish a range transition time to switch between the first range and the second range.

Figure 18:
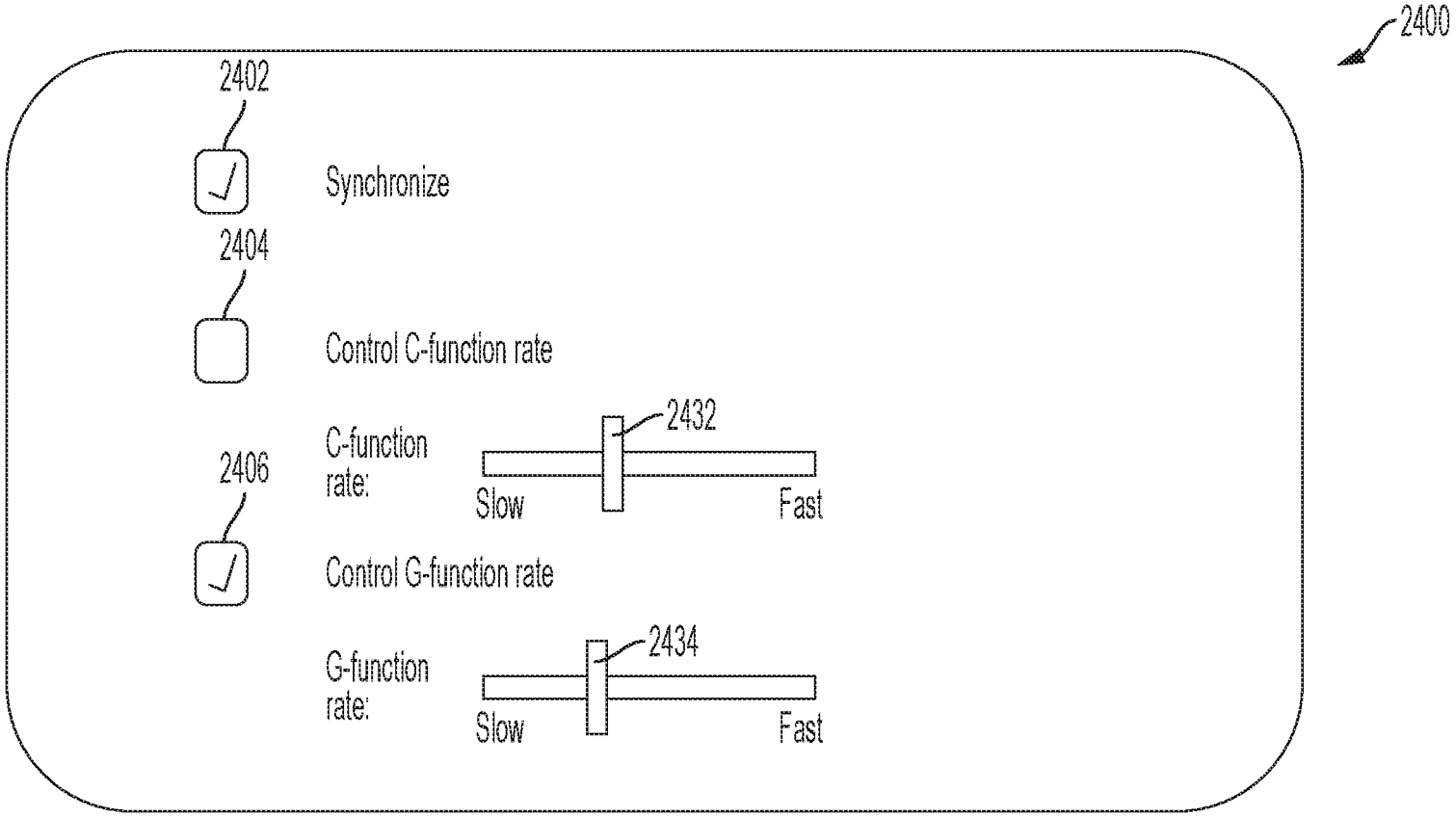
FIG. 18 is an exemplary user interface in accordance with additional embodiments of the present invention.

FIG. 18 is an exemplary user interface 2400 in accordance with additional embodiments of the present invention. It should be recognized that user interface 2400 is an example, and other configurations with more or fewer features thereon may be substituted within the scope of the invention. In embodiments, user interface 2400 may be rendered on a remote controller, such as the screen of a smartphone or tablet computer via an application ("app"), or other suitable electronic device. The electronic device may pair with the massager device via Bluetooth, WiFi or other wireless communication interface. Various operating parameters can be received from entry by a user on the user interface 2400, and then sent to the massager device via wireless communication interface. The processor (1802 of FIG. 17) can implement those operating parameters.

As shown on user interface 2400, there are three checkboxes. Checkbox 2404 allows the user to select to control the rate of the cup motor (1806 of FIG. 17) of the clitoral suction stimulator. When the user selects (using a mouse, finger, stylus, etc.) that input, slider 2432 allows the user to toggle the intensity of the suction and compression from slow to fast. Checkbox 2406 allows the user to select to control the G-spot stimulator. When the user selects that input, slider 2434 allows the user to toggle the movement of the roller from slow to fast. The user can select to control both him/herself by selecting both checkboxes 2404 and 2406. Alternatively, the user can select one of checkbox 2404 or 2406, as well as checkbox 2402, which causes synchronization. If the user selects checkbox 2404 and checkbox 2402, the shaft motor (1807 of FIG. 17) will be synchronized to the speed of the cup motor (1806 of FIG. 17). As shown, the user has selected checkbox 2406 and checkbox 2402, which means the speed of the cup motor (1806 of FIG. 17) is synchronized to the speed of the shaft motor (1807 of FIG. 17).

It should be recognized that user interface 2400 is an example for setting operating parameters. Other suitable user interfaces, and methods, may be substituted within the scope of the invention. It should also be recognized that buttons, sliders, fields, and other input devices on the user interface are examples, and other suitable inputs devices may be substituted within the scope of the invention. There may be more, fewer, or different input options.

Figure 19A:
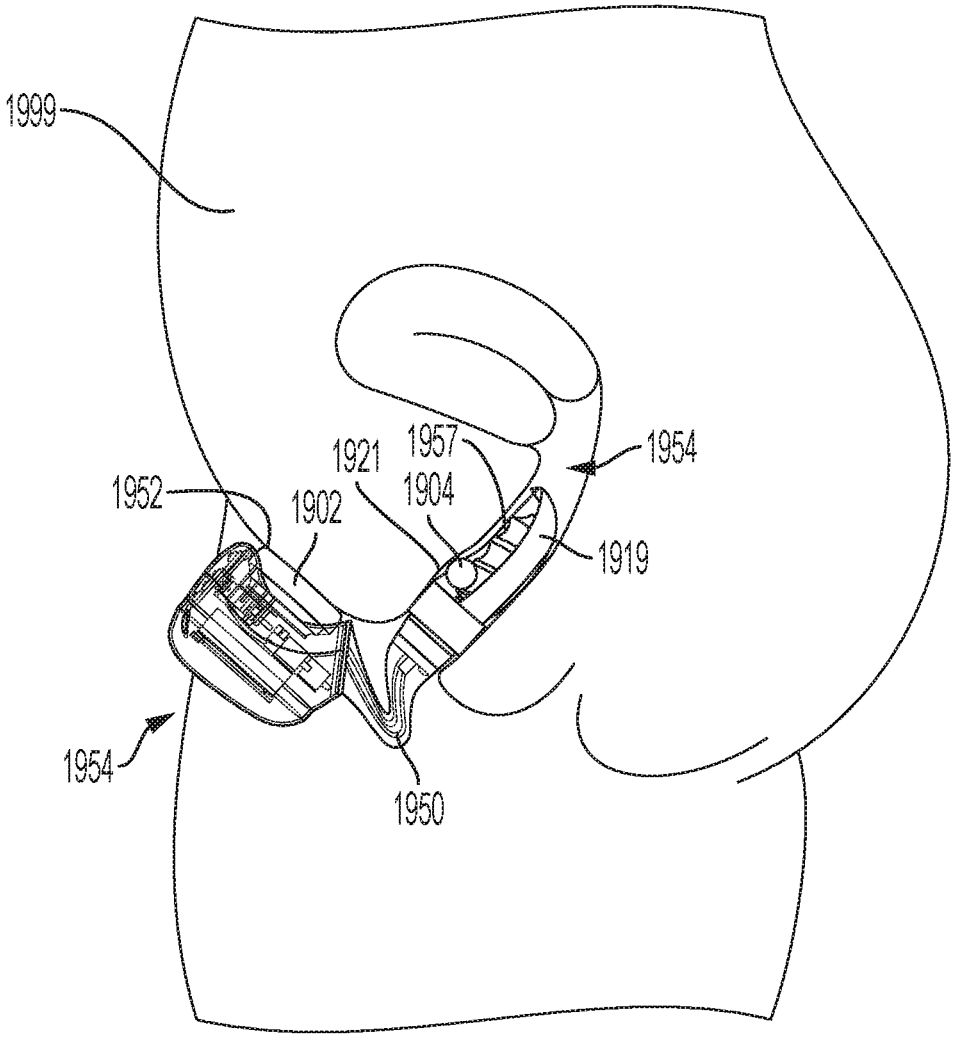
FIG. 19A shows an embodiment positioned on a user's vagina.
Figure 19B:
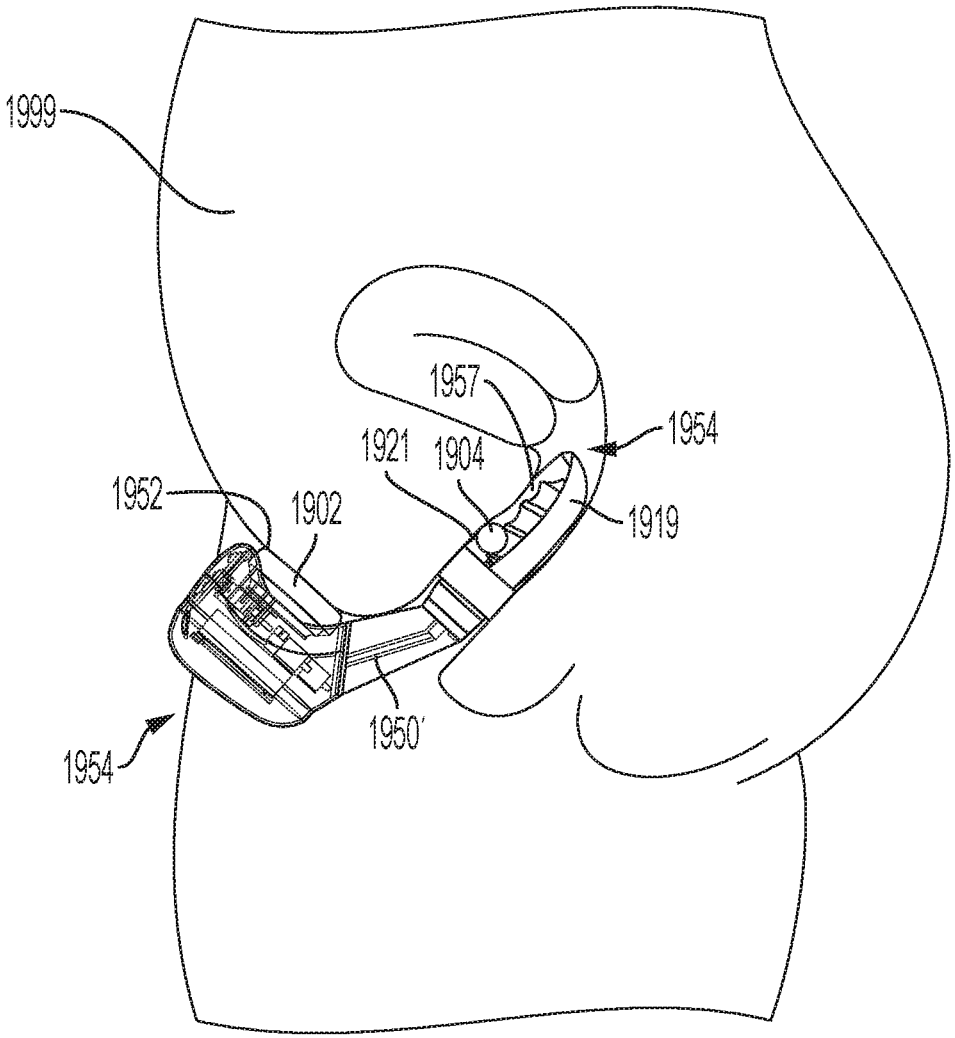
FIG. 19B shows the device with shaft positioned further into the vagina.

FIG. 19A shows an embodiment positioned on a user's body 1999. User's body 1999 is shown as a cross-section. Enclosure portion 214 is shown transparent. Shaft 1919, having roller 1904 and massage surface 1957, is inserted into the vagina 1954. Cup 1902 is positioned around the glans clitoris (referred to as "glans clitoral region" herein) 1952 such that wing regions 108 (see FIG. 1A) are under the labia majora in an interference fit. Arm 1950 is bent into a shape suitable for alignment of the cup 1902 with the glans clitoris and the shaft 1919 inside the vagina with roller 1904 near the G-spot region 1921. FIG. 19B shows the device with shaft 1919 positioned further into the vagina 1954 with arm 1950' in a straightened and extended position as compared with the position of arm 1950 in FIG. 19A.

In some embodiments, the device allows "hands-free" usage such that the user can insert the shaft into the vagina, position the cup 1902, and remove his/her hands as the device operates. In addition, it should be recognized that although shaft 1919 is shown inserted into a vagina, such may instead be configured for insertion into a rectum, via an anus, for prostate stimulation.

Figure 20:
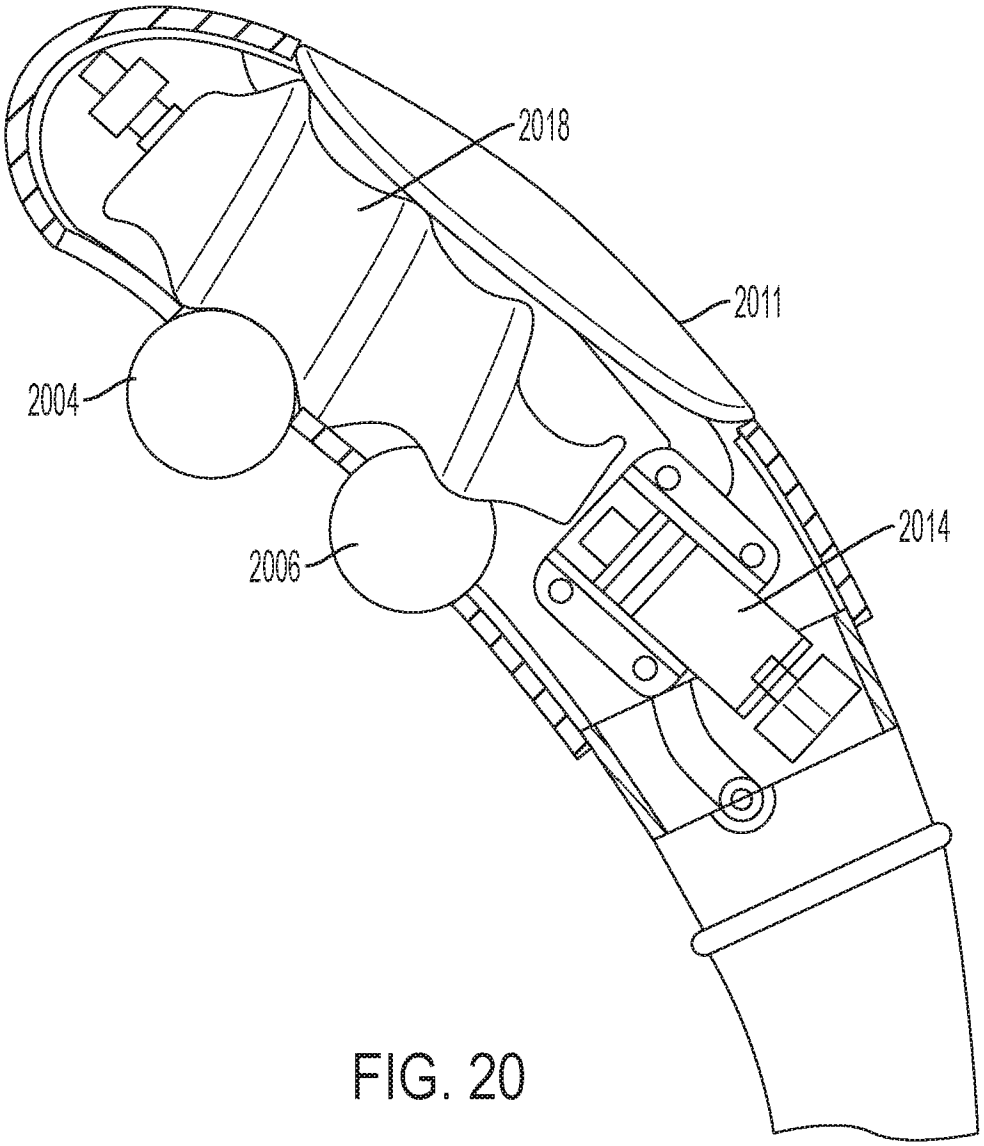
FIG. 20 shows a cutaway view of a portion of an alternative embodiment of the roller massager of the present invention including a plurality of rollers.

FIG. 20 shows a cutaway view of a portion of an alternative embodiment of the present invention including a plurality of rollers, with the external sheath removed for clarity. In this embodiment, a first roller 2004 and a second roller 2006 are included within enclosure 2011. As the motor 2014 turns the threaded post 2018, both rollers 2004 and 2006 are moved back and forth, creating a unique sensation in the G-spot area of a user. Thus, in some embodiments, a plurality of rollers are included. As shown, there are two rollers on a single threaded post 2018 in the example. In some embodiments, there may be more than two rollers included. In some embodiments, the first roller 2004 and second roller 2006 may be of the same size and/or shape. In other embodiments, the first roller 2004 may be of a different size and/or shape than the second roller 2006.

Figure 21:
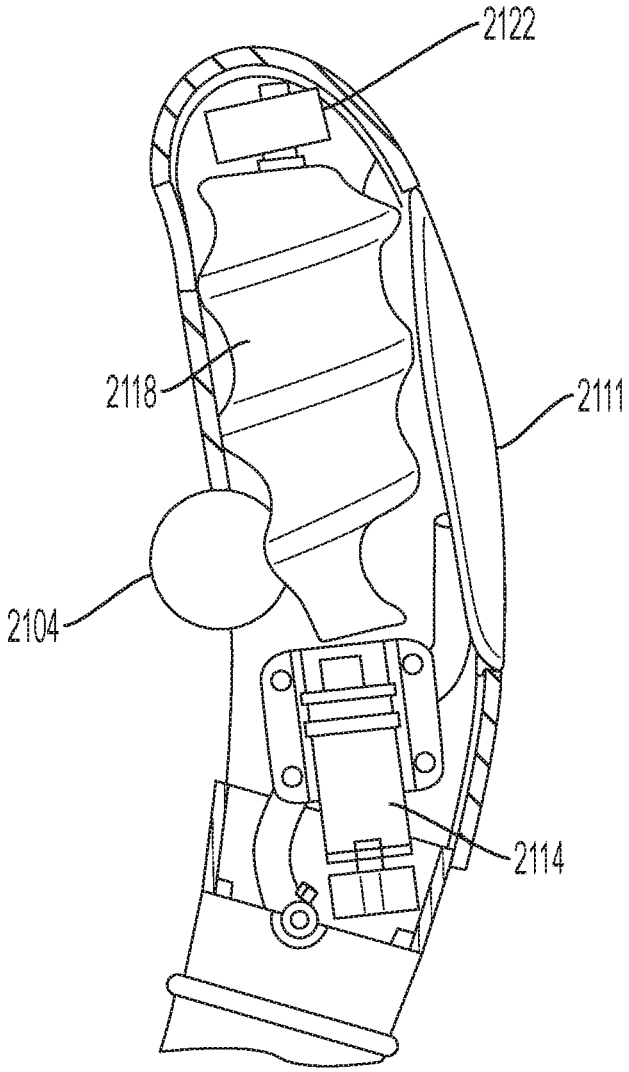
FIG. 21 shows a cutaway view of another alternative embodiment including a vibrator.

FIG. 21 shows a cutaway view of an embodiment, wherein a vibrator 2122 (such as a pancake motor) in included within the shaft/enclosure along with the roller massager. Vibration stimulation can be imparted as well as massage of the roller. In embodiments, the enclosure 2111 includes a first motor 2114 which is coupled to threaded post 2118. Roller 2104 is disposed on threaded post 2118. As the first motor 1414 rotates the threaded post 1418, the roller moves along the threaded post 2118, creating a massaging sensation for the user. A second motor 2122 may be included within enclosure 2111 for imparting vibration to the enclosure 2111. The vibration can provide an additional pleasurable sensation for the user. In embodiments, the second motor may be a pancake motor. In embodiments, the second motor may be disposed at a distal end of the threaded post 2118, opposite the first motor 2114. In embodiments, the second motor 2122 may be configured to operate independently of the first motor 2114, such that the user can enable or disable the vibration independently of the operation of the roller 2104.

Figure 22:
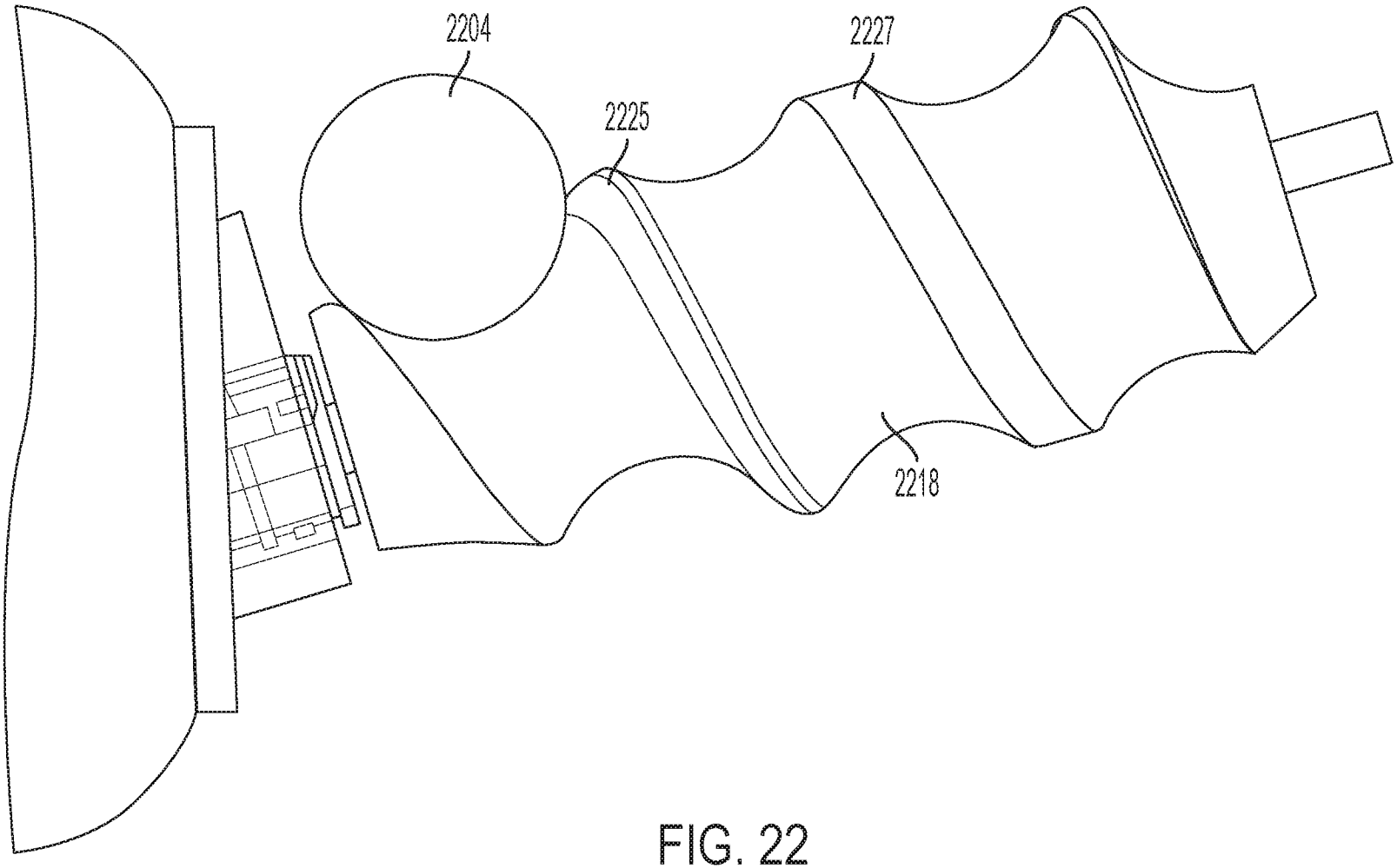
FIG. 22 shows an embodiment where threaded post has one or more flattened portions of the threads.

FIG. 22 shows an embodiment where threaded post 2218 has one or more flattened portions 2227 of the threads such that the friction of the elastic sheath (e.g. 157 of FIG. 1A) causes the roller 2204 to travel over those portions rather than smoothly follow the threads of the threaded post 2218. This creates a "bump" sensation that can be pleasurable to a user. The threaded post 2218 may also include some non-flattened portion(s) 2225 of threads. Accordingly, in some embodiments the threads of the threaded post are of an irregular shape. In some embodiments, the threaded post 2218 includes one or more flattened portions of threads. In some embodiments, the threaded post 2218 may include a combination of flattened and non-flattened portions of threads.

Figure 23B:
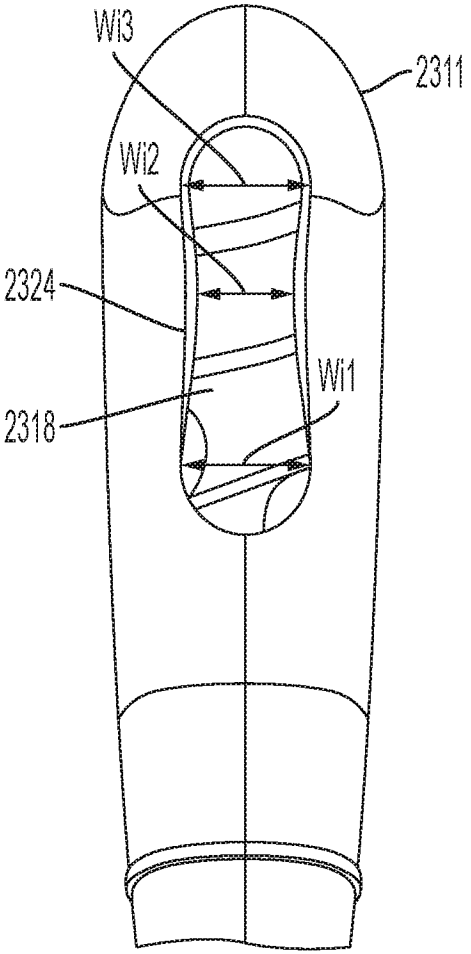
FIG. 23B shows a diagram of how portions of the opening of the enclosure may be narrower in some areas than in others to achieve a desired plane of the roller protruding therefrom.
Figure 23A:
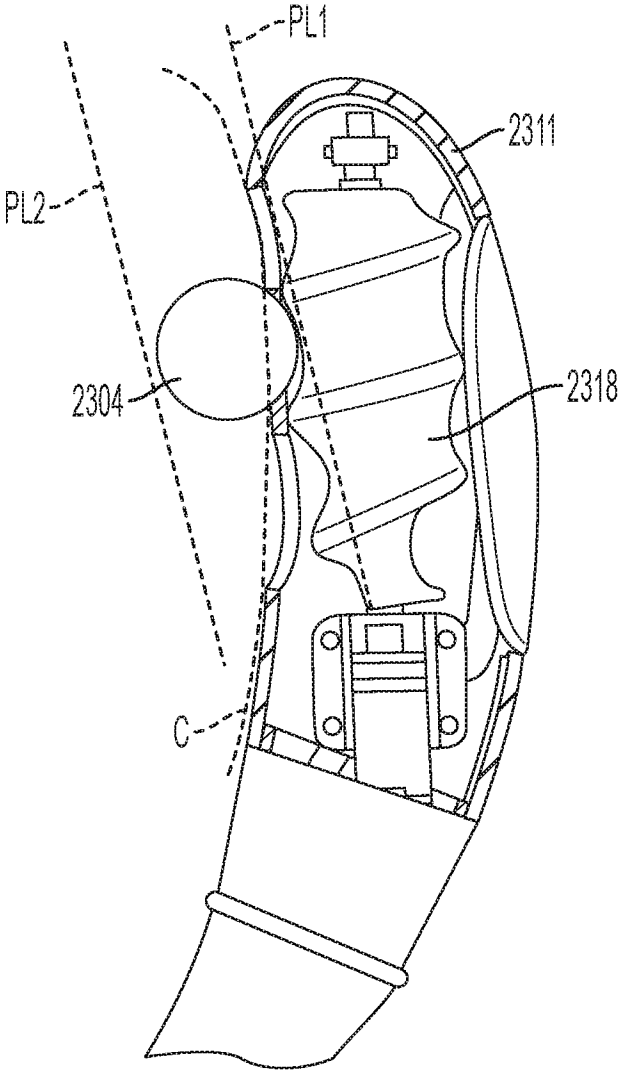
FIG. 23A shows a diagram of planes of the second stimulator of some embodiments of the present invention.

FIG. 23A and FIG. 23B show diagrams of how portions of the opening of the enclosure may be narrower in some areas than in others to achieve a desired plane of the roller protruding therefrom. Referring now to FIG. 23A, showing a side cutaway view of a shaft portion. The threaded post 2318 is disposed such that it has a plane PL1 parallel to its longitudinal axis. The enclosure 2311 is formed with a curvature C such that the protrusion of the roller 2304 is such that the travel of the roller 2304 is along a plane PL2, where plane PL2 is parallel to plate PL1. FIG. 23B shows the opening 2324 having a varying width. As shown in FIG. 23B, there is a first width Wi1, a second width Wi2, and third width Wi3. In some embodiments, width Wi2 is less than width Wi1, and width Wi2 is less than width Wi3. The width of the opening 2324 controls the amount of protrusion of the roller 2304. The width of the opening 2324 can be selected to control the amount of protrusion, and thus, affect the travel path of roller 1604.

Figure 24:
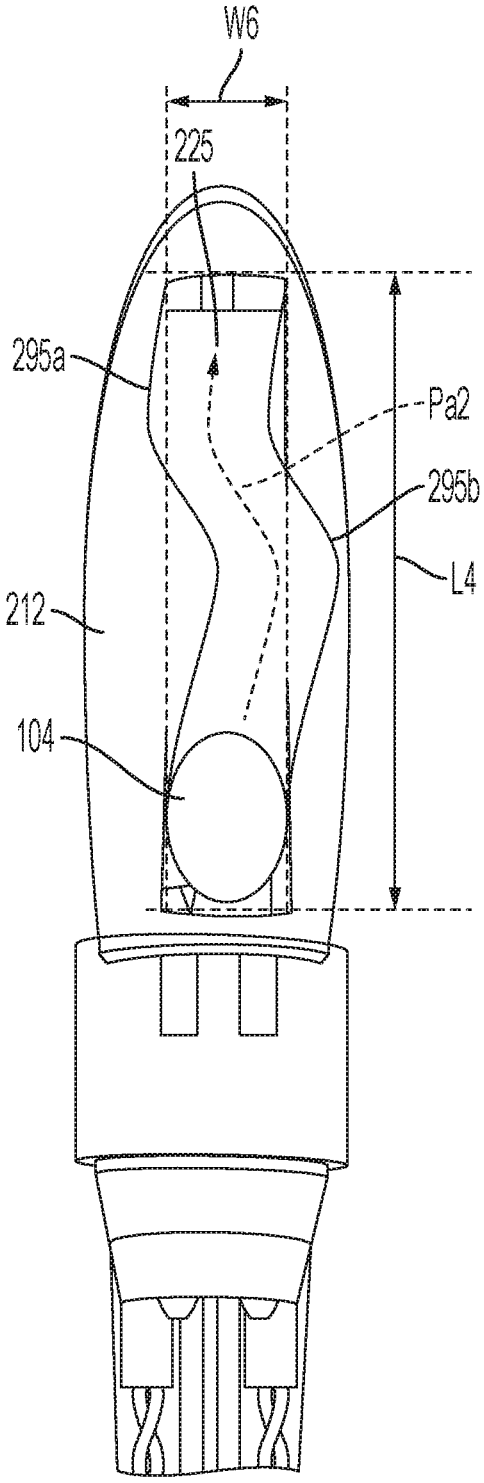
FIG. 24 is a front view of a portion of a roller massager device in accordance with alternative embodiments of the present invention, without an outer sheath thereon.

FIG. 24 is a front view of a portion of a massager device in accordance with alternative embodiments of the present invention showing detail of the enclosure portion 212 without a sheath thereon. The embodiment of FIG. 24 comprises an opening 225 which comprises non-linear rails 295*a* and 295*b*. The non-linear rails cause the roller 104 to move along path Pa2 when the threaded post rotates. Thus, in embodiments, the massager device is configured such that the travel path of the roller is non-linear. In some embodiments, as shown in FIG. 24, the path Pa2 of roller 104 is an S-curve. Thus, in embodiments, the roller travels in an S-curve path between the start range position and the end range position. Other non-linear paths are possible with embodiments of the present invention. The non-linear path of the roller 104 can create a pleasurable sensation in some users, as compared with a linear path as depicted in FIG. 13D. W6 and L4 may have similar dimensions as in FIG. 13D.

Figure 25A:
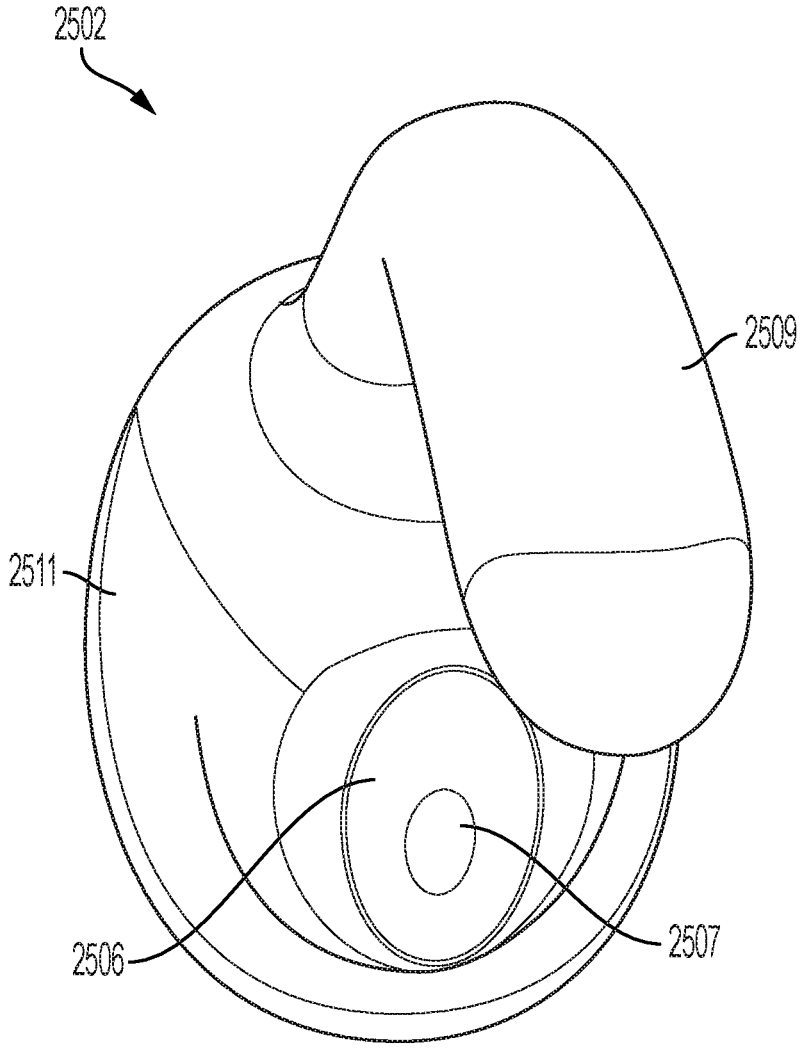
FIG. 25A shows a top-down view of a sheath that is disposed over the device.
Figure 25B:
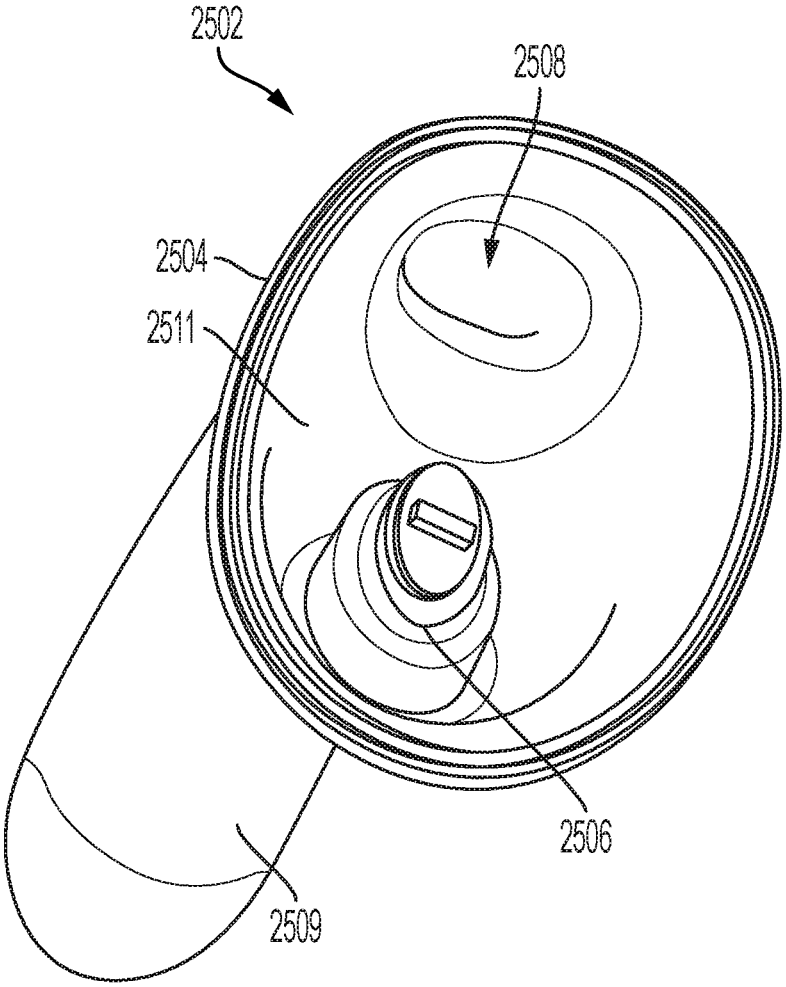
FIG. 25B shows a bottom-up view of a sheath that is disposed over the device.

FIGS. 25A and 25B show views of a sheath that is disposed over the enclosure/shaft arm, and pressure field stimulator, as well as vibrator, if present. FIG. 25A shows a top-down view. The sheath 2502 is flexible, resilient, and elastic, and includes a shaft portion 2509 that stretches over the shaft and an integrated base portion 2511 that attaches to the enclosure and/or housing of the base/pressure field stimulator of embodiments with a tight fit. Cup 2506 includes cavity 2507. In some embodiments, the sheath is made of silicone, rubber, TPE, plastic or other flexible and elastic material. "Elastic material" herein is a material that is expandable by force (such as roller), but returns to its original size when the force (e.g., of the roller) is removed. The cup 2506, in some embodiments, is monolithic with the sheath. The cup 2506, in some embodiments, is molded into the sheath as a single piece. In such embodiments, the cup and sheath may be injection molded via a single mold such that the resulting cup-sheath consists of a single piece and is not made of two pieces. Thus, in embodiments, the covering of the shaft, base, and the cup is formed as an integrated piece of elastic material. Note that injection molding is an example process, and any suitable method of making is included within the scope of the invention.

Referring to FIG. 25B, a bottom-up view of sheath 2502 is shown, illustrating the interior of the sheath. During assembly of disclosed embodiments, an interior shaft opening 2508 is configured and disposed to receive an enclosure comprising one or more rollers and a threaded post. An attachment point 2504 is formed around the base portion 2511. In embodiments, attachment point 2504 comprises a raised lip (protrusion) of material. The sheath is attached to the shaft or housing in any suitable way. In some embodiments, it may be via reciprocal grooves and protrusions on the shaft or base housing, and sheath, noted as attachment point on the sheath. The sheath may be adhered to the shaft/housing instead or in addition to reciprocal grooves and protrusions.

Figure 26:
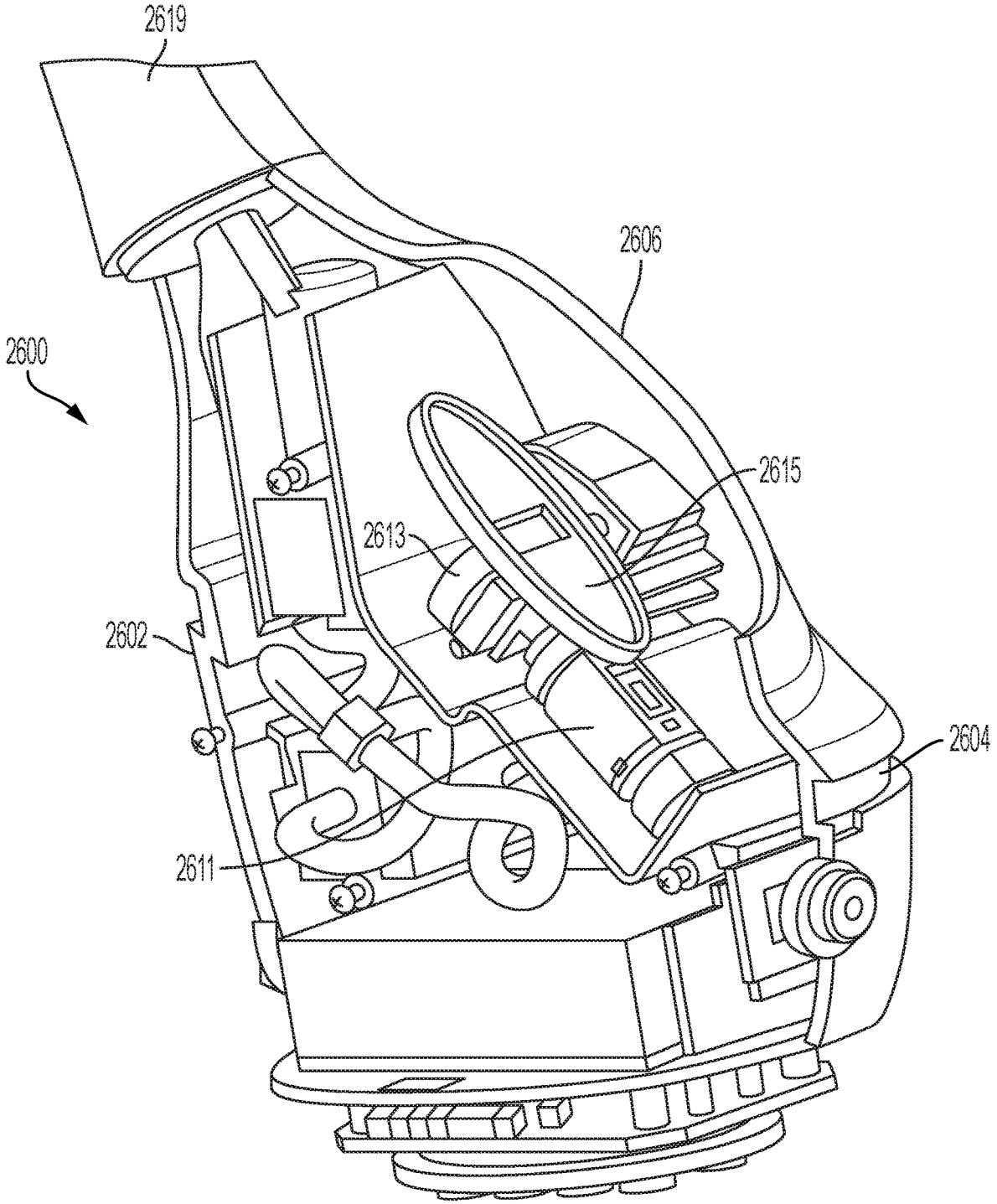
FIG. 26 shows a partial view of the internal components of a base including a pressure field stimulator in accordance with some embodiments of the invention.

FIG. 26 shows a partial view of the internal components of a base including a pressure field stimulator 1900 in accordance with some embodiments of the invention. In some embodiments, a shaft, arm, or handle is attached, a portion thereof is shown at 2619. A portion of the housing and where the sheath attaches is in view. The pressure field stimulator 2600 includes a housing 2602 that houses internal components, including, but not limited to, motor(s), pump(s), batteries, circuits, and/or other components. Inside the housing is shown an example driver, including a motor 2611, cam 2613, and plate 2615. An attachment point, such as groove 2604, is formed within the housing 2602 that is configured and disposed to receive attachment point (protrusion 2504 of FIG. 25B) of the sheath 2502. The housing 2602 may further include at least one support flange 2606, which provides mechanical support for the base portion 2511 and/or cup 2506 of the sheath 2502. In some embodiments, the width of the groove 2604 and the width of protrusion 2504 are sized such that a tight friction fit forms between them when the protrusion 2504 is applied to groove 2604. In some embodiments, the sheath 2502 may be removable by the user to facilitate cleaning. In other embodiments, the sheath 2502 may be permanently affixed to the housing 2602 via adhesive, sealant, or other suitable technique.

In some embodiments, the sheath and the cup are shown integrated. They are formed of a single piece of material. In some embodiments, they consist of a single piece of material. In such embodiments, they are a single connected piece, and not two separate pieces. The cup may be molded into the sheath to achieve this result. An example non-limiting process for molding is as follows. A four part mold is constructed which includes: an interior surface part, an exterior portion on the right, an exterior portion on the left, and a final piece to mold the detail of the outside of the cup. The mold is assembled, and then liquid silicone is injected into the mold. The mold is disassembled after the silicone solidifies, such that the cup and sheath remain as a single piece. In some embodiments, there can be post molding processing to remove mold flash and to achieve a desired surface finish.

It should be recognized that although described as applicable to massage of a G-spot, prostate, or clitoris, that embodiments may be used for stimulation of any suitable body part.

It should also be recognized that the various pressure field stimulators described herein are non-limiting examples. Any suitable configuration of the pressure field stimulator is included within the scope of the invention, regardless of the type of pressure field created within the chamber. The pressure field may: consist of pressures at or above a reference pressure only, consist of pressures at or below a reference pressure only, consist of pressures above a reference pressure only, consist of pressure below a reference pressure only, or include any pressures in relation to the reference pressure within the scope of embodiments of the invention.

Some embodiments are waterproof such that they may be washed with fluids, like soap and water. Accordingly, the attachment points of the sheath and any other external portions are sealed where necessary. This allows a user to clean the device thoroughly between uses.

In some embodiments, the pressure field stimulation device is unitary in structure, meaning the components thereof together form a single product, rather than multiple products which may be used together by a user.

While the invention has been particularly shown and described in conjunction with exemplary embodiments, it will be appreciated that variations and modifications will occur to those skilled in the art. The embodiments according to the present invention may be implemented in association with the formation and/or processing of structures illustrated and described herein as well as in association with other structures not illustrated. Moreover, in particular regard to the various functions performed by the above described components (assemblies, devices, circuits, etc.), the terms used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application. Therefore, it is to be understood that the appended claims are intended to cover all such modifications and changes that fall within the true spirit of the invention.

What is claimed is:

1. A sexual stimulation device comprising:

a cup;

a housing comprising an opening;

a driver, disposed inside the housing, configured to vary a volume of the cup;

a sheath bound to the housing; and wherein the cup is disposed within the opening of the housing; and wherein the sheath and the cup are integral with one another.

2. The sexual stimulation device of claim 1, wherein the cup is molded into the sheath such that the cup and the sheath are not separate pieces.

3. The device of claim 1, wherein the sheath is made of silicone, plastic, rubber, or TPE.

4. The sexual stimulation device of claim 1, wherein the sheath and the cup are made of a resilient flexible material.

5. The sexual stimulation device of claim 4, wherein the driver further comprises:

a plate disposed on an underside of the cup;

a cam disposed adjacent to the plate; and a motor mechanically coupled to the cam.

6. The sexual stimulation device of claim 5, wherein the cam is not connected to the plate.

7. The sexual stimulation device of claim 5, wherein the driver further comprises a motor shaft guide; and wherein the plate comprises a cam strike.

8. The sexual stimulation device of claim 1, further comprising an insertable shaft, wherein the sheath is disposed over the insertable shaft.

9. The sexual stimulation device of claim 8, wherein the insertable shaft comprises a roller massager.

10. The sexual stimulation device of claim 9, wherein the roller massager comprises:

an enclosure comprising an opening;

a threaded post disposed within the enclosure, the threaded post comprising a plurality of pitched threads;

a roller disposed within the plurality of pitched threads, wherein the roller protrudes outside the opening of the enclosure; and a motor configured to rotate the threaded post.

11. The sexual stimulation device of claim 10, wherein the enclosure is formed with a curvature such that a path of the roller is along a plane parallel to a longitudinal axis of the threaded post.

12. The sexual stimulation device of claim 11, wherein a second roller is disposed on the threaded post.

13. The sexual stimulation device of claim 11, further comprising an arm, wherein the cup and the driver are disposed on a first end of the arm and the roller massager is disposed on a second end of arm.

14. The sexual stimulation device of claim 13, wherein the arm is flexible.

15. The sexual stimulation device of claim 14, wherein the arm has a metal core and a flexible material fill disposed there around.

16. The sexual stimulation device of claim 15, wherein the metal core is a set of flexible wires wrapped around one another.

17. The sexual stimulation device of claim 15, further comprising a pressure field stimulator, and wherein a first endplate is attached to the first end of the arm between the flexible material fill and the pressure field stimulator, and a second endplate is attached to the second end of the arm between the flexible material fill and the insertable shaft.

18. The sexual stimulation device of claim 1, further comprising a vibrator.

19. The sexual stimulation device of claim 10, wherein the threaded post comprises one or more flattened portions of threads, and one or more non-flattened portions of threads.

20. The sexual stimulation device of claim 1, wherein the sexual stimulation device is a pressure field stimulator and wherein the pressure field stimulator is controllable by a remote control.

21. The sexual stimulation device of claim 9, wherein the roller massager is controllable by a remote control.

* * * * *